US006489720B1

(12) United States Patent
Gofuku et al.

(10) Patent No.: US 6,489,720 B1
(45) Date of Patent: Dec. 3, 2002

(54) IMAGE-FORMING APPARATUS AND FABRICATION METHOD THEREFOR

(75) Inventors: Ihachiro Gofuku, Chigasaki (JP); Hiroshi Takagi, Yokohama (JP); Mitsutoshi Hasegawa, Yokohama (JP); Kazuya Shigeoka, Yokohama (JP); Yutaka Arai, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/388,428

(22) Filed: Sep. 2, 1999

(30) Foreign Application Priority Data

| | | |
|---|---|---|
| Sep. 7, 1998 | (JP) | 10-253035 |
| Jan. 22, 1999 | (JP) | 11-014753 |
| Feb. 25, 1999 | (JP) | 11-049070 |
| Aug. 26, 1999 | (JP) | 11-240004 |

(51) Int. Cl.[7] ..... H01J 19/70
(52) U.S. Cl. ..... 313/558; 313/553; 313/554
(58) Field of Search ..... 313/553, 554, 313/555, 556, 557, 558, 559, 560, 561, 562; 428/331, 446

(56) References Cited

U.S. PATENT DOCUMENTS

| | | | | | |
|---|---|---|---|---|---|
| 3,801,850 | A | * | 4/1974 | Maegdefessel et al. | 313/174 |
| 3,926,832 | A | * | 12/1975 | Barosi | 252/181.6 |
| 5,444,331 | A | * | 8/1995 | Matsuno et al. | 313/553 |
| 5,453,659 | A | | 9/1995 | Wallace et al. | 313/495 |
| 5,498,925 | A | * | 3/1996 | Bell et al. | 313/497 |
| 5,525,861 | A | * | 6/1996 | Banno et al. | 313/495 |
| 5,689,151 | A | * | 11/1997 | Wallace et al. | 313/495 |
| 5,912,531 | A | | 6/1999 | Hasegawa et al. | 313/495 |
| 5,936,342 | A | | 8/1999 | Ono et al. | 313/495 |
| 5,952,775 | A | * | 9/1999 | Sato et al. | 313/422 |
| 6,114,806 | A | * | 9/2000 | Itoh | 313/553 |
| 6,116,974 | A | * | 9/2000 | Browning et al. | 445/24 |
| 6,191,529 | B1 | * | 2/2001 | Park | 313/553 |
| 6,396,207 | B1 | * | 5/2002 | Hasegawa et al. | 313/495 |
| 2001/0020820 | A1 | * | 9/2001 | Kaneko et al. | 313/623 |

FOREIGN PATENT DOCUMENTS

| | | | | |
|---|---|---|---|---|
| GB | 2058450 | * | 4/1981 | H01K/1/56 |
| JP | 56-162447 | | 12/1981 | |
| JP | 63-181248 | | 7/1988 | |
| JP | 1-235152 | | 9/1989 | |
| JP | 2-250243 | * | 10/1990 | 313/553 |
| JP | 4-12435 | | 1/1992 | |
| JP | 4-12436 | | 1/1992 | |
| JP | 4-289640 | | 10/1992 | |
| JP | 5-070738 | * | 3/1993 | C09D/183/04 |
| JP | 5-151916 | | 6/1993 | |
| JP | 7-235255 | | 9/1995 | |
| JP | 9-82245 | | 3/1997 | |
| JP | 10-12164 | | 1/1998 | |

* cited by examiner

*Primary Examiner*—Nimeshkumar D. Patel
*Assistant Examiner*—Thelma Sheree Clove
(74) *Attorney, Agent, or Firm*—Fitzpatrick, Cella, Harper & Scinto

(57) ABSTRACT

Image-forming apparatuses include getters that are suitably placed. The getters can be fixed using inorganic adhesives and function effectively by suitably setting weight ratios between getter powder and the adhesives.

37 Claims, 30 Drawing Sheets

IMAGE-FORMING APPARATUS AND FABRICATION METHOD THEREFOR

BACKGROUND OF THE INVENTION

1. Field of the Invention

The present invention relates to image-forming apparatuses having a vacuum and a fabrication method therefor.

2. Description of the Related Art

In a so-called image-forming apparatus in which a phosphor in an image display member is irradiated with an electron beam emitted from an electron source so that the phosphor emits light to display an image, the inside of an envelope having the electron source and the image display member must be kept at a high vacuum. This is because of the fact that if gases are generated in the envelope and the pressure is increased, the electron source is adversely affected depending on the type of gases, and the amount of electron emission is decreased. Thus, a bright image cannot be displayed.

The generated gases are ionized by the electron beam, and the ionized gases collide with the electron source because they are accelerated by an electric field and may damage the electron source. Furthermore, in some cases, a discharge may take place in the envelope, resulting in the apparatus breaking.

Generally, the envelope of an image-forming apparatus includes a plurality of glass components. In such a case, the components are joined to each other by glass frit or the like. Once the joining is completed, the pressure is maintained by a getter placed in the envelope. As such a getter, in a typical CRT, an alloy having Ba as a major constituent is employed. In the evacuated envelope, in which joining has been completed, the alloy is heated by passing an electric current or by high frequency irradiation so that an evaporated film is formed on the inner wall of the envelope, and thus gases generated inside are adsorbed and high vacuum conditions are maintained. For this purpose, an evaporative getter having a clean metal surface, such as Ba, is employed, which adsorbs evaporated gases by heating in a vacuum.

However, in a flat-display image-forming apparatus using an electron source in which many electron-emitting elements are disposed on a flat substrate, that has been recently under development, in comparison with the CRT, the ratio of the volume of the envelope to the area of the inner wall of the envelope emitting gases is substantially decreased. In the case of the comparable generation of gases, the pressure inside the envelope increases, and its adverse effect may become rather serious.

In the CRT, since the envelope has an ample inside wall surface in which the electron source or the image display member are not placed, the getter as described above can be mounted thereon by evaporation or the like. In the flat image-forming apparatus using electron-emitting elements, most of the inside surface area of the envelope is occupied by the electron source and the image-forming member. Therefore, if a getter as the evaporated film adheres thereto, inconveniences such as a short circuit may occur, and thus the position in which the getter is mounted is strongly restricted.

Generally, a spot such as a corner of the envelope is used for forming the getter film so that the getter material does not adhere to the region occupied by the image-forming member and the electron source (hereinafter referred to as "an image display region"). If the display area is increased more than a certain amount, it is not possible to secure an area of the evaporated getter film sufficient for the amount of emission gases in the envelope.

In order to overcome the above and to secure a sufficient area of the getter film, a method is disclosed in Japanese Patent Laid-Open No. 5-151916, in which, as shown in FIG. 2A, a wire getter 1008 is stretched tightly in the exterior of an image display region between a phosphor 1006 and a field emission element 1007 which are opposed to each other in an envelope 1005, for example, in the periphery of the envelope 1005, and by using the wire getter 1008, a getter film 1009 is formed by evaporation on the inner wall of the periphery. Another method is disclosed in Japanese Patent Laid-Open No. 4-289640, in which, as shown in FIG. 2B, on the side of a space between a faceplate 1014 (an image display member) and a rear plate 1012 (an electron-source substrate) constituting an envelope, a getter chamber 1015 having a getter material 1018 for forming a getter film in the envelope is attached. Alternatively, another method is disclosed in Japanese Patent Laid-Open No. 1-235152, in which a given space is provided between an electron-source substrate and a rear plate of an envelope, and a getter film is formed therein.

Additionally, in the thin (flat) image-forming apparatus, when the generation of gases in the vacuum envelope is treated, the pressure is easily increased locally. With respect to an image display apparatus having an electron-source substrate and an image display member, in an evacuated envelope, gases are generated in the image display region irradiated with an electron beam and by the electron source itself.

In the conventional CRT, since an image display member and an electron source are separated and there is a space between them for forming a sufficient getter film smoothly, gases generated from the image display member are widely diffused before reaching the electron source and a portion thereof is adsorbed by the getter film, and thus the pressure is not extremely increased at the electron source. Since a getter film is also provided around the electron source, the pressure is not strongly increased locally.

However, in the thin image-forming apparatus, since an image display member and an electron-source substrate are placed closely, gases generated from the image display member reach the electron source before being sufficiently diffused, resulting in a local pressure increase. In particular, in the center of the image display region, a higher local pressure increase is observed in comparison with the periphery, because the distance to the getter film is longer than the distance between the image display region and the electron-source substrate, and the gases cannot be diffused to the region where the getter film is formed. Therefore, the generated gases are ionized by electrons released from the electron source and are accelerated by an electric field formed between the electron source and the image display member, and thus the electron source may be broken or damaged.

In view of the above, a thin image-forming apparatus provided with a specific structure, that is, an image-forming apparatus in which a getter material is disposed in the image display region so that the generated gases are immediately adsorbed, is also disclosed. For example, in accordance with an apparatus disclosed in Japanese Patent Laid-Open No. 4-12436, with respect to an electron source having a gate electrode for supplying electrons for an electron beam, the gate electrode is composed of a getter material, and a field emission electron source having a conical protrusion as a negative electrode and a semiconductor electron source having a pn junction are described as examples. In accordance with a method disclosed in Japanese Patent Laid-Open No. 63-181248, with respect to a flat panel display having a structure in which an electrode, such as a grid, for controlling an electron beam is disposed between a cathode (negative electrode) group and a faceplate in an evacuated envelope, a getter material film is formed on the controlling electrode.

In U.S. Pat. No. 5,453,659, a structure is disclosed in which a getter is formed in the interstices of phosphors in the form of stripes on an image display member (anode plate). In this case, the getter is electrically isolated from the phosphors and a conductor which is electrically connected thereto, and the getter is activated by the irradiation with electrons emitted from the electron source by applying an appropriate electric potential, or by heating the getter by passing an electric current.

Meanwhile, in a thin image-forming apparatus, it is desirable to simplify the structure and fabrication method in view of production technology, production costs, and the like. Therefore, the fabrication of electron-emitting elements constituting the electron source must be achieved by the deposition of thin films and simple processes. When a large apparatus is fabricated, the fabrication must be achieved by a technique that does not require a vacuum apparatus, such as by printing.

A background technique for the present invention is disclosed in Japanese Patent Laid-Open No. 56-162447 in which a mixture of getter powder and a heat-resistant inorganic adhesive is used in an electron tube.

In Japanese Patent Laid-Open No. 10-12164, a technique is disclosed, in which a bulk getter is fixed using silver paste in a flat panel display device.

SUMMARY OF THE INVENTION

It is an object of the present invention to provide image-forming apparatuses in which getters are suitably placed, and to provide a suitable method for fabricating the same.

In accordance with the present invention, image-forming apparatuses have the following structures.

In one aspect, an image-forming apparatus includes a hermetically sealed container and a getter provided in the hermetically sealed container. The getter is fixed by an inorganic high polymer or a substance originating from the inorganic high polymer.

In another aspect, an image-forming apparatus includes a hermetically sealed container and a getter provided in the hermetically sealed container. The getter is fixed by a silicate adhesive or a substance originating from the silicate adhesive.

In another aspect, an image-forming apparatus includes a hermetically sealed container and a getter provided in the hermetically sealed container. The getter is fixed by a phosphate adhesive or a substance originating from the phosphate adhesive.

In another aspect, an image-forming apparatus includes a hermetically sealed container and a getter provided in the hermetically sealed container. The getter is fixed by a colloidal silica adhesive or a substance originating from the colloidal silica adhesive.

In another aspect, an image-forming apparatus includes a hermetically sealed container and a getter provided in the hermetically sealed container. The getter is fixed by a ladder silicone adhesive or a substance originating from the ladder silicone adhesive.

In another aspect, an image-forming apparatus includes a hermetically sealed container and a getter provided in the hermetically sealed container. The getter is fixed by a ladder silicone oligomer or a substance originating from the ladder silicone oligomer.

In another aspect, an image-forming apparatus includes a hermetically sealed container and a getter provided in the hermetically sealed container. The getter is fixed by an adhesive containing silicon-oxygen bonds.

In another aspect, an image-forming apparatus includes a hermetically sealed container and a getter provided in the hermetically sealed container. The getter is fixed by a solder or a substance originating from the solder.

In another aspect, an image-forming apparatus includes a hermetically sealed container and a getter provided in the hermetically sealed container. The getter is fixed by glass frit or a substance originating from the glass frit.

In another aspect, an image-forming apparatus includes a hermetically sealed container, a first member provided in the hermetically sealed container, and a getter fixed in contact with the first member. The fixed portion of the getter and a constituent of the first member form a solid solution.

In another aspect, an image-forming apparatus includes a hermetically sealed container and a getter provided in the hermetically sealed container. The getter constitutes a material getter member containing a non-evaporable getter, and the getter member is fixed at a cut-out section or a hole section of the getter member by an adhesive.

The cut-out section or the hole section may be formed by making a cut-out or a hole after the getter member is formed. The cut-out or the hole may be simultaneously made when the getter member is formed. The adhesive may be present in a region excluding the cut-out section or the hole section.

In another aspect, an image-forming apparatus includes a hermetically sealed container and a getter provided in the hermetically sealed container. The getter constitutes a material getter member, and the getter member is fixed at a cut-out section or a hole section of the getter member by an inorganic adhesive or a substance originating from the inorganic adhesive.

In another aspect, an image-forming apparatus includes a hermetically sealed container and a getter provided in the hermetically sealed container. At least a portion of the getter is present in an image-forming region in the hermetically sealed container, and the getter is fixed by an adhesive.

In another aspect, an image-forming apparatus includes a hermetically sealed container and a getter provided in the hermetically sealed container. The getter is provided both in an image-forming region and in a region excluding the image-forming region within the hermetically sealed container, and at least one fixed portion of the getter is provided in the region excluding the image-forming region.

In another aspect, an image-forming apparatus includes a hermetically sealed container and a getter provided in the hermetically sealed container. The getter is obtained by heating after a mixture containing a particulate getter material and an adhesive at a weight ratio of 10:1 to 20:1 is placed at a given position.

With respect to the structures of the present invention described above, the hermetically sealed container is preferably provided with an electron-emitting element. The hermetically sealed container is also preferably provided with an electrode for applying an electric potential in order to accelerate electrons emitted by the electron-emitting element. A potential difference of 5 kV or more is preferably applied between the electron-emitting element and the electrode during operation.

The inner space of the hermetically sealed container is preferably thin and flat. With respect to the inner space of the hermetically sealed container, a diagonal line parallel to the plane for forming an image is preferably 4.5 or more times as long as a length perpendicular to the plane for forming the image.

When the getter is in contact with wiring provided in the hermetically sealed container, the getter is preferably electrically connected to the wiring.

When the getter is provided in the vicinity of a phosphor, the getter is preferably provided in the interstices of a plurality of phosphors.

The getter may contain a powdered getter material having a particle diameter of 1 to 300 $\mu$m.

In accordance with the present invention, a method for fabricating an image-forming apparatus includes the steps of bonding a non-evaporable getter in a hermetically sealed container, and degassing an adhesive used in the bonding step.

Preferably, the degassing step is a step of heating at temperatures of 250° C. or more, or at temperatures of 350° C. or more. Preferably, the degassing step is a step of heating at temperatures of 450° C. or less, or at temperatures of 400° C. or less.

Preferably, the degassing step is a step of heating for 1 hour or more.

When the temperature in the degassing step is low, heating is preferably performed for 3 hours or more, and when the temperature is high, heating is preferably performed for 3 hours or less. Preferably, heating is performed for less than 30 hours.

The degassing step is preferably started after the adhesive-curing step is started.

The adhesive used in the fabrication method described above is preferably an inorganic adhesive.

Further objects, features and advantages of the present invention will become apparent from the following description of the preferred embodiments with reference to the attached drawings.

DESCRIPTION OF THE PREFERRED EMBODIMENTS

The preferred embodiments of the present invention will be described in detail with reference to the drawings.

First Embodiment

Figure 1:
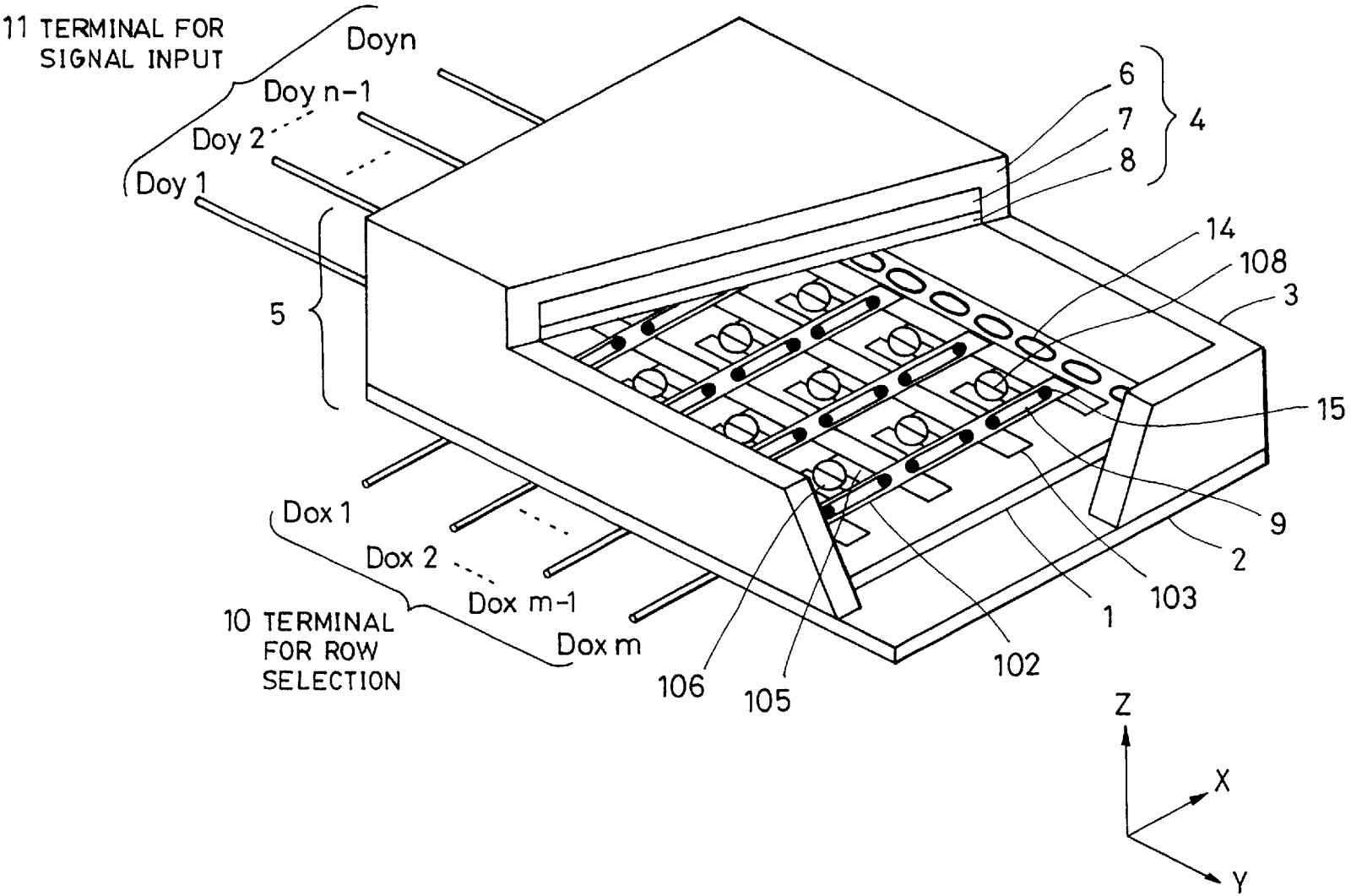
FIG. 1 is a schematic diagram of an example of a surface-conduction electron-emitting element in accordance with the present invention.
Figure 2A:
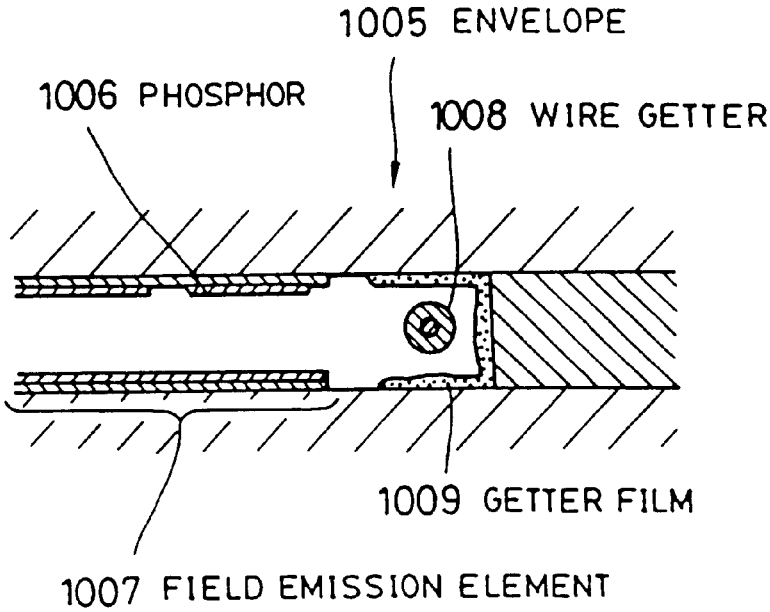
FIG. 2A (PRIOR ART)
FIGS. 2A and 2B are sectional views of portions for gettering treatment with respect to conventional flat-panel image-forming display devices.
Figure 2B:
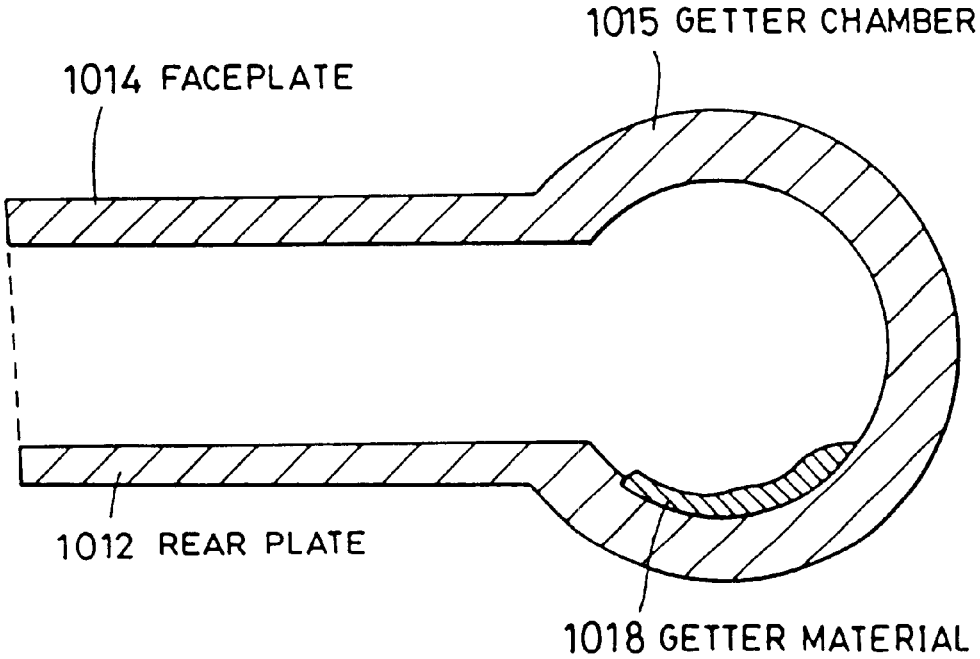
FIG. 2B (PRIOR ART)

FIG. 1 is a schematic diagram which shows an envelope of an image-forming apparatus provided with surface-conduction electron-emitting elements according to the present invention. A plurality of electron-emitting elements are disposed on an electron-source substrate 1, and upper wiring 102 and lower wiring 103 are mounted thereon. Numeral 2 represents a rear plate for supporting the electron-source substrate 1, numeral 3 represents a frame, and numeral 4 represents a faceplate. The faceplate 4 and the rear plate 2 are bonded to upper and lower faces of the frame 3 around the periphery, using frit glass, to form an envelope 5.

The faceplate 4 includes a glass substrate 6, and a fluorescent film 7 and a metal back 8 are formed on the glass substrate 6, which corresponds to an image display region. In a black-and-white display, the fluorescent film 7 is composed of a phosphor only. In a color display, pixels are formed of three primary-color phosphors, i.e., red, green, and blue, and the phosphors are separated by a black conductive material. The black conductive material is called a black stripe, a black matrix, or the like, depending its shape. The details thereof will be described below.

The metal back 8 is composed of a conductive thin film such as aluminum. The metal back 8 reflects light which is emitted from the phosphors and travels towards the electron-source substrate 1 back towards the glass substrate 6, thus improving the brightness. The metal back 8 also prevents phosphors from being damaged by the bombardment of ions which are generated from residual gases in the envelope 5 because of electron beams. The metal back 8 makes the image display region of the faceplate 4 conductive, thus avoiding charge storage, and functions as an anode for the electron-source substrate 1.

Numeral 9 represents a non-evaporable getter (hereinafter referred to as "NEG") chip, and numeral 15 represents an inorganic adhesive for fixing the NEG chip to the upper wiring 102. In addition, numeral 14 represents a ring getter. In the envelope 5 of this embodiment, the upper wiring 102 on the electron-source substrate 1 has a pitch of approximately 0.5 to 1 mm, and the wiring itself has a width of several hundreds of microns. Thus, NEG chips are arranged by relatively fine patterning.

When NEG chips are arranged in a section other than the wiring 102, finer patterning is required. Therefore, it is difficult to arrange and fix the NEG chips by using a liquid having a low viscosity, such as a low-viscosity adhesive or a solder, or to fix the chips mechanically. Since the NEG is mainly composed of an alloy of metals having high melting points, it is not easy to arrange and fix the NEG chips by various methods for joining metals, such as welding, soldering, and bonding, which are based on alloying. Furthermore, since a member for arrangement and fixing is directly in contact with the NEG chips, a material which emits a large amount of gases, such as an organic adhesive, may destroy the characteristics of the arranged NEG.

Accordingly, in this embodiment of the present invention, an inorganic adhesive is employed to arrange and fix the NEG chips. In the inorganic adhesive, alloying is not used, and the inorganic adhesive is a liquid having a high viscosity, thus facilitating the application to relatively fine patterns. Since it is also possible to apply the inorganic adhesive by a dispenser or by printing, the step of fixing the NEG can be incorporated in the fabrication process for image-forming apparatuses at low cost.

Figure 3:
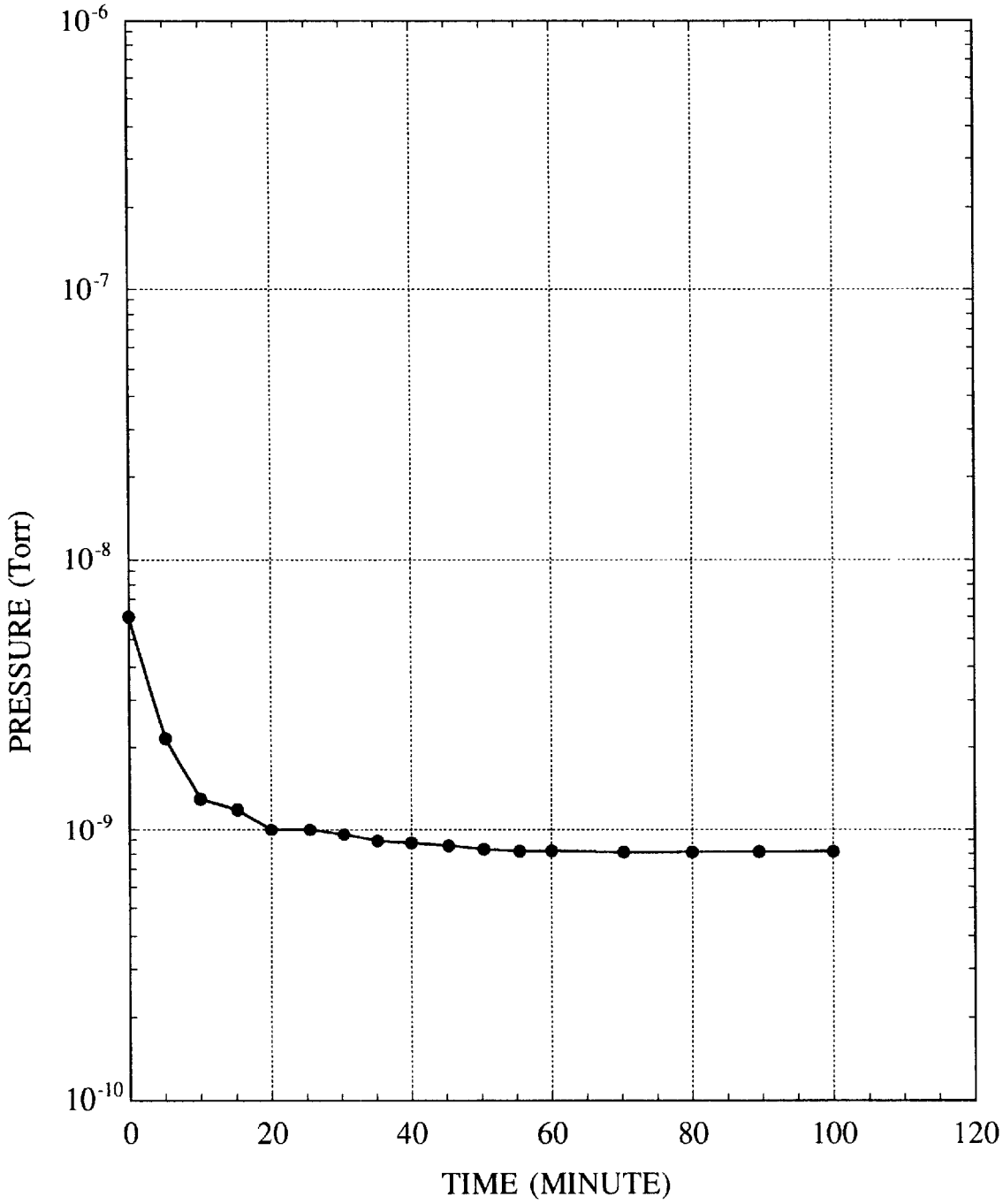
FIG. 3 is a graph showing gas emission characteristics of an inorganic adhesive used in the present invention, namely, the change in the pressure over time at 300° C.

Since the inorganic adhesive has a lower amount of gas emission than that of glass frit which is used for sealing when image-forming apparatuses are fabricated, degradation of the NEG characteristics can be minimized, and an improvement of the vacuum and long-life elements can be achieved. The degassing step for suppressing the degradation of the NEG will be described with reference to TDS data of a typical inorganic adhesive shown in FIGS. 3 and 4. FIG. 3 is a graph showing gas emission characteristics, namely, the change in the pressure over time when a sample of the inorganic adhesive is placed in a vacuum chamber and kept at 300° C., of an inorganic adhesive used in the present invention. As is clear from FIG. 3, the pressure decreases over time, and emission gases can be reduced by degassing.

Figure 4:
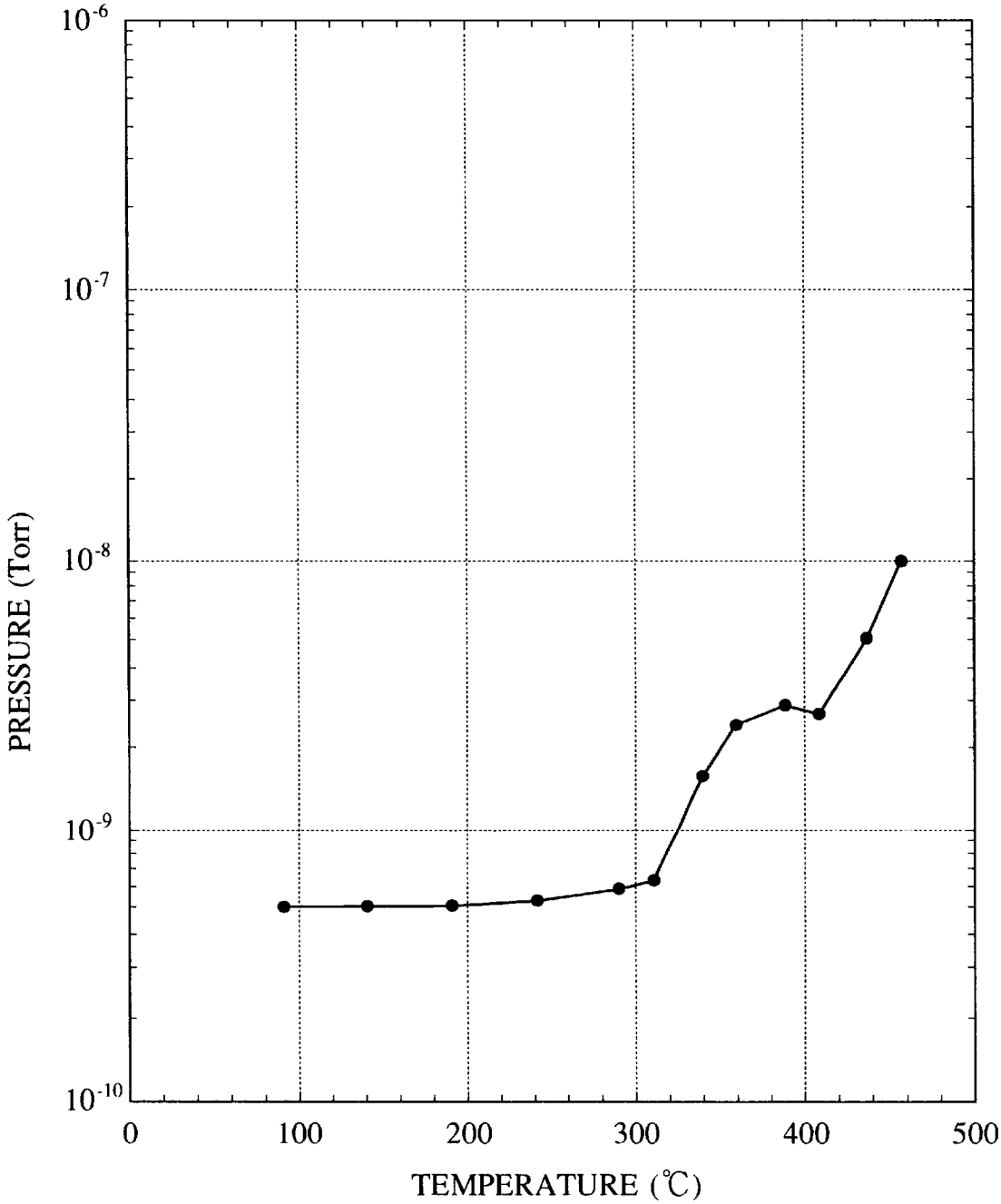
FIG. 4 is a graph showing gas emission characteristics of an inorganic adhesive used in the present invention, namely, the relationship between the pressure and temperature.

FIG. 4 is a graph showing gas emission characteristics, namely, the relationship between the pressure and temperature, of an inorganic adhesive used in the present invention. Between 300° C. and 450° C., the pressure changes approximately threefold every 50° C. That is, with a temperature rise of 50° C., the degassing rate is increased threefold, or, in other words, a threefold increase in the degassing effect is obtained.

The conditions of the degassing step are determined depending on the temperature and time in the baking step, for example, baking at 300° C. for 10 hours, and the upper time limit for the degassing step is set in view of throughput. In other words, on the production line, considering a baking time of the same order, the upper time limit for obtaining effective degassing is approximately three times greater (that is, 30 hours). However, in order to achieve the effect in 30 hours, the degassing rate must exceed the value at 300° C. by one third. As a result, the lower limit of the degassing temperature can be set at 250° C. Although the temperature may depend on the type of adhesives, this value is substantially appropriate.

Figure 5:
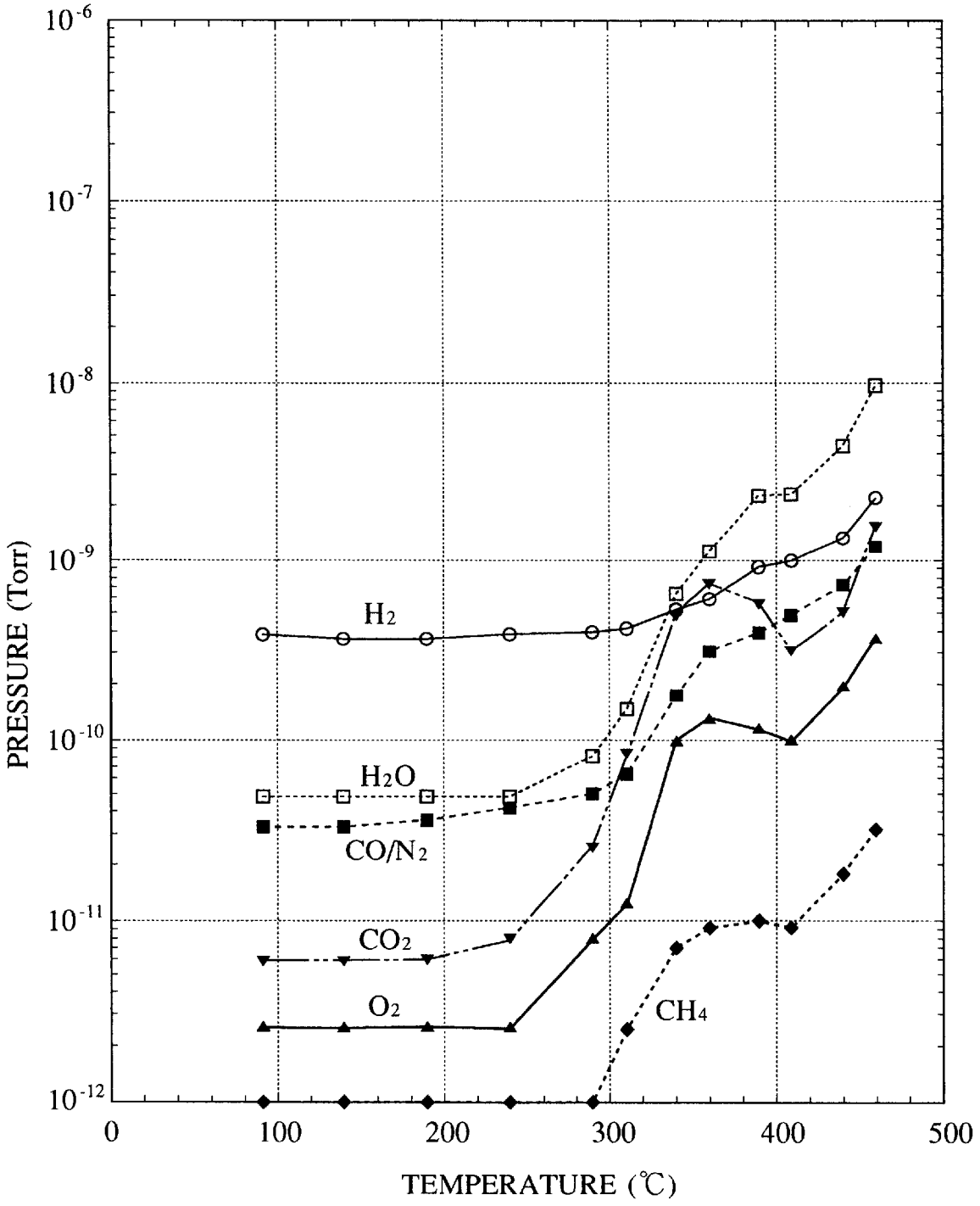
FIG. 5 is a graph showing gas emission characteristics of an inorganic adhesive used in the present invention, namely, the relationship between partial pressures of major gases and temperature.

By further investigating the degassing step, the time and temperature ranges are further restricted. That is, the change of the pressure in relation to temperature, which is assumed to be threefold for every 50° C., has a peak at approximately 350 to 400° C. FIG. 5 is a graph showing gas emission characteristics of an inorganic adhesive used in the present invention. The pressure shown in FIG. 4 is broken down to partial pressures of major gases. Although a substantially straight change is observed in FIG. 4, it is clear from FIG. 5 that many gases have their emission peaks at approximately 350° C. Although the peaks slightly differ depending on the adhesive materials, they lie at approximately 350° C. to 400° C. That is, in the degassing step, the temperatures to be applied are preferably 350° C. to 400° C.

With respect to the temperature, the upper limit may be set from another point of view. The factor is that frit which is generally used for bonding in image-forming apparatuses has a melting temperature of 400° C. to 450° C., and thus the upper limit of temperature at the degassing step is restricted to 400° C. On the other hand, the appropriate time for effectively obtaining the degassing effect is set at 1 to 3 hours (one tenths to one third of the baking time) because the temperature is set higher than that of the baking step by approximately 50 to 100° C. When the gas emission rate in the entire envelope during baking is taken into consideration, it is meaningless to perform the degassing step for 3 hours or more at heating temperatures of 350 to 400° C. In view of the effectiveness, the proper upper time limit for the degassing step is 3 hours.

As described above, by heating at least at 250° C., preferably at 350 to 400° C., for 1 to 3 hours, the improvement of the vacuum and long life of elements can be achieved.

Figure 6A:
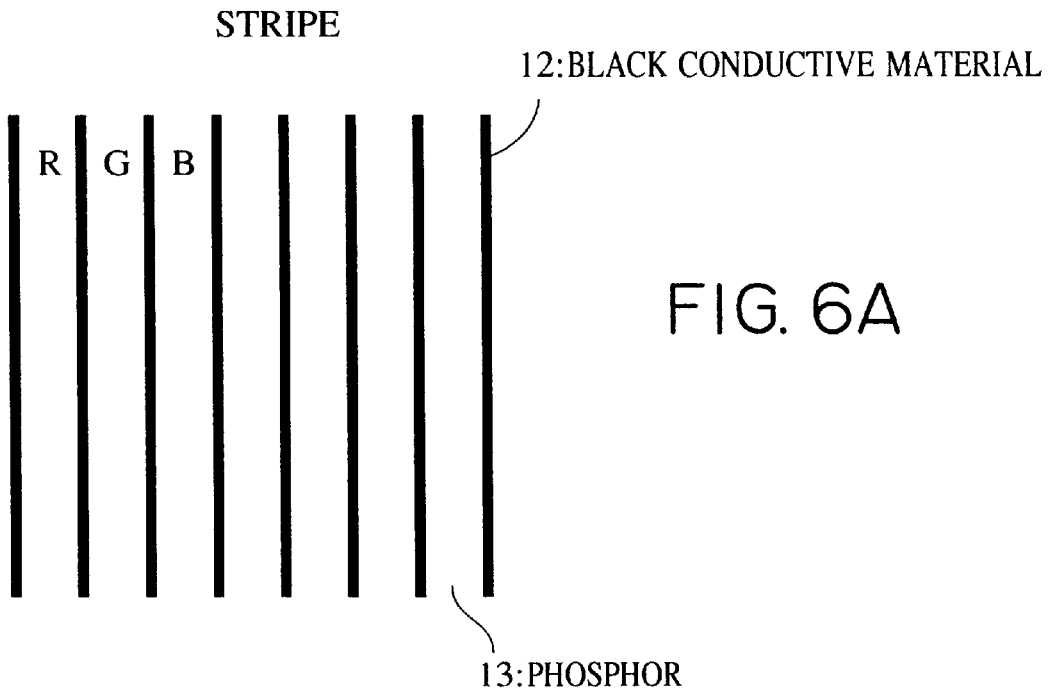
FIGS. 6A and 6B show array patterns of phosphors and black conductive materials used in the present invention.
Figure 6B:
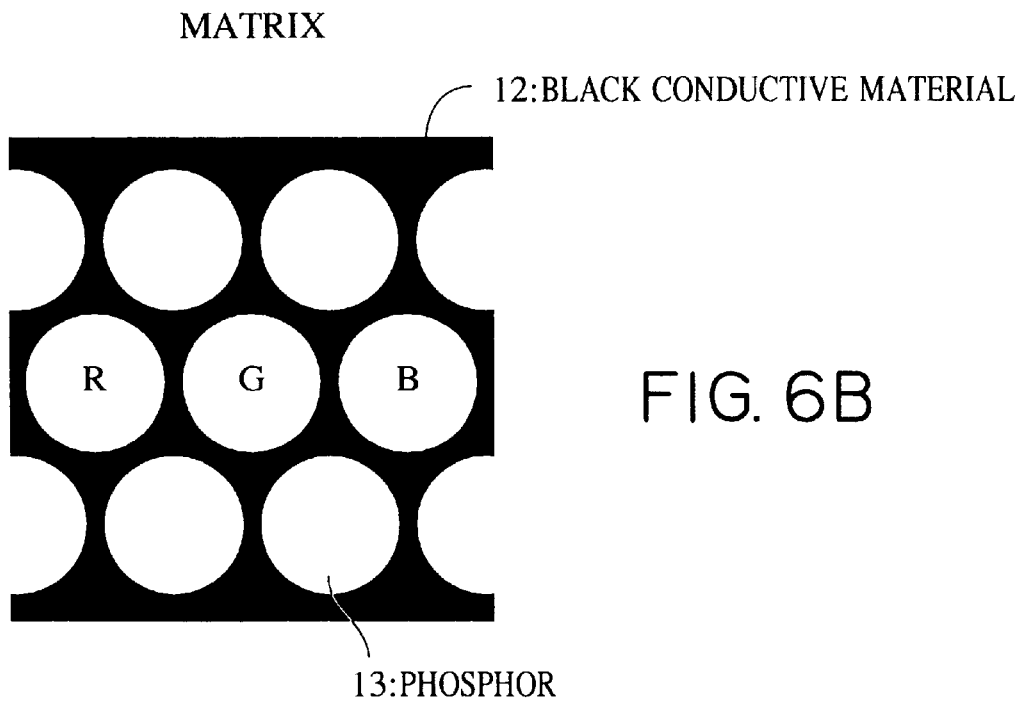

Next, the fluorescent film 7 will be described. FIGS. 6A and 6B show array patterns of phosphors and black conductive materials used in the present invention. In FIG. 6A, phosphors 13 are arrayed in a striped pattern. Phosphors 13 of three primary colors, red (R), green (G), and blue (B), are formed in order, and black conductive material 12 is placed in the spaces between the phosphors 13. In such a case, the black conductive material 12 is called a black stripe. In FIG. 6B, dots of the phosphor 13 are arranged in a grid pattern, and the black conductive material 12 occupies the space therebetween. In such a case, the black conductive material 12 is called a black matrix. There are several types of arrangements of the phosphors 13 of the individual colors, and accordingly the dots may be arranged in a delta grid pattern as shown in the drawing, or in a square grid pattern.

In order to perform patterning of the black conductive material 12 and the phosphor 13 on the glass substrate 6, a slurry method or a printing method may be employed. After the fluorescent film 7 is formed, the metal back 8 is formed using a metal such as Al.

Figure 7A:
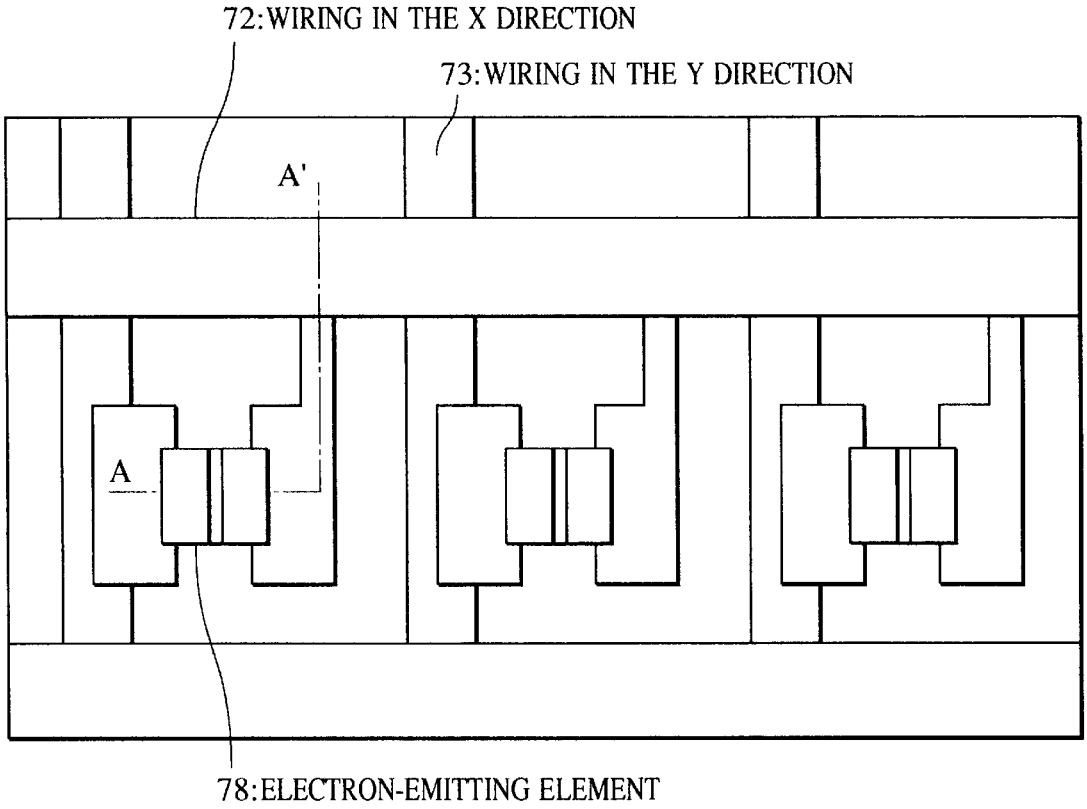
FIGS. 7A and 7B are a plan view and a sectional view, respectively, of surface-conduction electron-emitting elements to which the present invention is applicable.
Figure 7B:
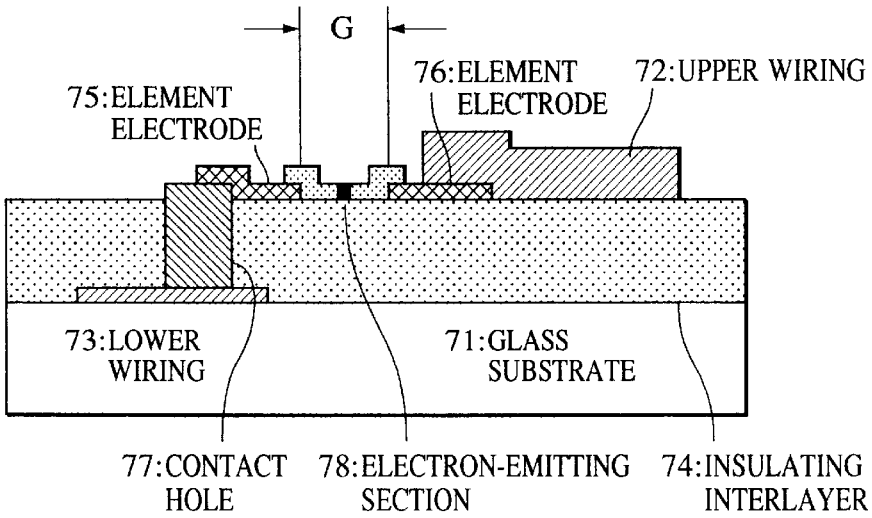

FIGS. 7A and 7B schematically show two-dimensionally arranged surface-conduction electron-emitting elements which are connected by matrix wiring. FIG. 7A is a plan view and FIG. 7B is a sectional view taken along the line A–A' in FIG. 7A. Wiring 72 in the X direction (upper wiring) and wiring 73 in the Y direction (lower wiring) are connected to electron-emitting elements 78. The wiring 73 in the Y direction is disposed on an insulating substrate 71, an insulating interlayer 74 is formed thereon, and the wiring 72 in the X direction and the electron-emitting element 78 are further formed thereon. The wiring 73 in the Y direction and the electron-emitting element 78 are connected to each other through a contact hole 77. The wiring may be formed by combining a thin film deposition technique, such as sputtering, vacuum evaporation, or plating, with photolithography, or by printing.

A non-evaporable getter (NEG) is mounted on the faceplate and the electron-source substrate formed as described above. The NEG is placed on the black conductive material on the side of the faceplate, and on the wiring in the X direction on the side of the electron-source substrate. The NEG may be mounted on either of them or both of them. Preferably, the NEG is spread evenly in the entire image display region. (In this sense, the NEG of the present invention may be referred to as an "in-plane getter".)

The NEG disposed on the black stripe or the wiring is composed of at least one metal selected from the group consisting of Ti, Zr, Cr, Al, V, Nb, Ta, W, Mo, Th, Ni, Fe, and Mn, or an alloy having at least one of the above as a major constituent.

The NEG is used as a chip in which the NEG material described above is fixed on a substrate, such as a plate material or a wire rod, composed of a metal such as Fe, Cr, Ni, or Cu, or an alloy thereof, or composite carbon materials containing carbon fiber, by means of sintering or the like. Fine particles having particle sixes of 1 to 300 $\mu$m may be directly used as the NEG material.

As the inorganic adhesive for fixing the NEG material on the wiring of the electron-source substrate or on the black stripe, a reactive adhesive comprising a bonding agent, a curing agent, and a filler is used. Reactive adhesives are broadly classified into silicate adhesives, phosphate adhesives, and colloidal silica adhesives.

In silicate adhesives, as a bonding agent, an alkali metal silicate represented by a general formula: $M_2O.XSiO_2.YH_2O$ is used, where M represents an alkali metal, such as Li, K, or Na. As a curing agent, a metal oxide such as ZnO or MFG., a hydroxide, a phosphate, a borate, or a silicofluoride is used. As a filler, an oxide such as alumina, silica, zirconia or spinel, a nitride, or a carbide which has satisfactory fire resistance is used.

In phosphate adhesives, as a bonding agent, a metal phosphate, such as aluminum phosphate or magnesium phosphate, is used, which is represented by a general formula: $MO.XP_2O_3.YH_2O$. M represents a metal such as Al, Mg, Ca, Cu, or Zn. As a curing agent, in addition to a metal oxide, magnesium silicate, strontium titanate, or the like is used, and as a filler, the same substance as that in silicate adhesives is used.

In colloidal silica adhesives, as a bonding agent, colloidal silica having a particle size of 10 to 100 $\mu$m, which is dispersed in water or alcohol, is used, and a curing agent, such as a metal oxide, and a filler using the same substance as that in silicate adhesives, are blended thereinto.

NEG chips are preliminarily fixed on the substrate (the faceplate or the electron-source substrate) using the inorganic adhesive, and the substrate provided with the NEG chips is fired to be fixed. Generally, the heating is performed at approximately 100 to 200° C. for approximately 30 to 90 minutes. The heating may be performed in an atmosphere of an inert gas such as Ar or $N_2$, or in an atmosphere of dry air.

The faceplate 4 fabricated as described above, the frame 3, the rear plate 2, the electron-source substrate 1, and other components are combined, and the faceplate 4 and the rear plate 2 are joined to the frame 3 by frit glass. The joining is performed by heating at 400 to 450° C. after frit glass is attached to the upper and lower faces of the frame. An inner structure of the electron-source substrate 1 is fixed in a similar manner. Specifically, in order to remove components contained as a binder in frit glass, firstly, low-temperature firing is performed in an atmosphere containing oxygen (a preliminary firing step). At this stage, the oxygen concentration and temperature are preferably decreased within the possible ranges. Although the conditions depend on the types of frit, a temperature of 250° C. or less is preferred. Next, heating treatment is performed in an inert gas, such as Ar, at 400 to 450° C. to weld the joints (a sealing step).

The envelope 5 is then evacuated, and required treatment such as activation treatment for the electron-source substrate 1 is performed. Next, a sufficient vacuum is obtained in the envelope 5 by evacuation and heat degassing (a baking step), and an exhaust pipe (not shown in the drawing) is heated by a burner and is sealed off. Lastly, getter treatment is performed, in which an evaporative getter 14 (in FIG. 1, a ring getter is schematically shown) provided within the envelope 5 is heated and evaporated on the inner wall of the envelope 5 to form a getter film (getter flashing). The getter film formed lies in the exterior of the image display region within the envelope 5.

The degassing step of the inorganic adhesive is incorporated between the sealing step and the baking step depending on the timing of the final aeration. For example, when the vacuum is broken after the electron source activation step, and baking is then performed, the degassing step of the inorganic adhesive is done immediately before the baking. On the other hand, when the activation of the electron source and the baking are performed in a continuous vacuum, the degassing step of the adhesive may be done at any point before the activation of the electron source or before the baking. Furthermore, when the process works in a vacuum atmosphere before the sealing step and after the faceplate and the electron-source substrate are completed, the degassing step of the adhesive may be set before the sealing step.

The conditions of the degassing step of the adhesive will be described. The temperature is set at 250° C. or more, and preferably at 350 to 400° C. The heating period depends on the temperature, and is set at 3 hours to 30 hours at 250° C. and at approximately 1 to 3 hours at 350 to 400° C.

Figure 8:
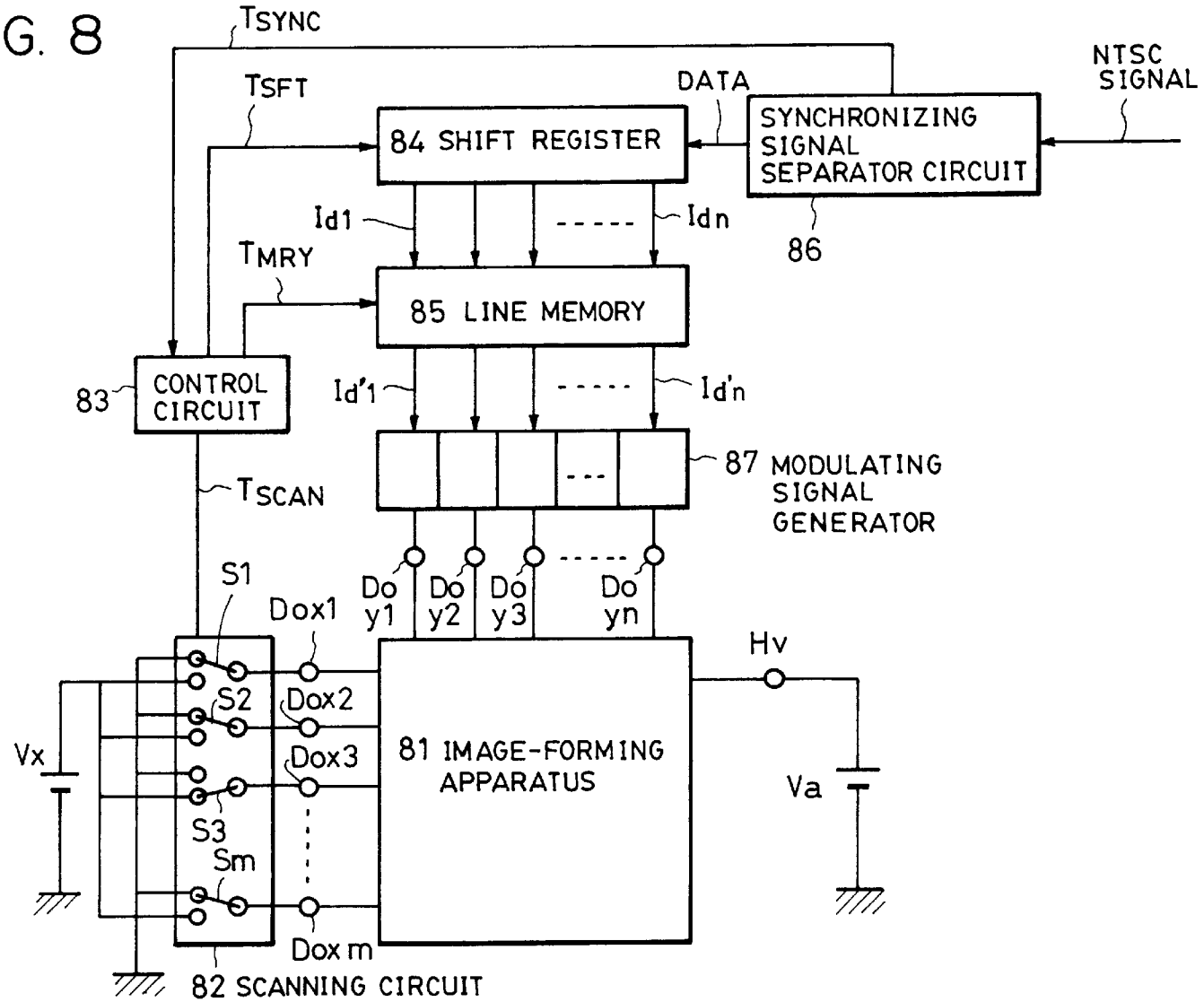
FIG. 8 is a block diagram which shows an example of a drive circuit for displaying an image in response to NTSC television signals with respect to an image-forming apparatus in accordance with the present invention.

FIG. 8 is a block diagram which shows an example of a drive circuit for displaying an image in response to NTSC television signals with respect to an image-forming apparatus in accordance with the present invention. In FIG. 8, numeral 81 represents an image-forming apparatus, numeral 82 represents a scanning circuit, numeral 83 represents a control circuit, numeral 84 represents a shift register, numeral 85 represents a line memory, numeral 86 represents a synchronizing-signal separator circuit, numeral 87 represents a modulating-signal generator, and symbols Vx and Va represent direct-current voltage sources.

The image-forming apparatus 81 is connected to external electric circuits through terminals Dox1 to Doxm, terminals Doy1 to Doyn, and a high-tension terminal Hv. The terminals Dox1 to Doxm drive the electron source provided in the image-forming apparatus, namely, surface-conduction electron-emitting elements arrayed in a matrix with M rows and N columns, by rows (N elements). Scanning signals are applied to the terminals Dox1 to Doxm.

Modulating signals are applied to the terminals Doy1 to Doyn for controlling the electron beam output from each of the surface-conduction electron-emitting elements in a row selected by the scanning signals. For example, a direct-current voltage of 10 kV is applied to the high-tension terminal Hv from the direct-current voltage source Va, and this is an acceleration voltage for providing sufficient energy for the electron beam emitted from the surface-conduction electron-emitting elements to excite the phosphors.

In the scanning circuit 82, M number of switching elements S1 to Sm are provided, as schematically shown in FIG. 8. The individual switching elements select either the output voltage of the direct-current voltage source Vx or 0 V, and are electrically connected to the terminals Dox1 to Doxm of the image-forming apparatus 81. The individual switching elements S1 to Sm are operated in response to a control signal $T_{SCAN}$ output by the control circuit 83, and may be structured, for example, by combining switching elements such as FETs.

In this example, the direct-current voltage source Vx outputs a given voltage so that a driving voltage applied to the elements which are not scanned is lower than a threshold voltage for electron emission based on the characteristics of the surface-conduction electron-emitting element.

The control circuit 83 matches the operation of each unit so that an appropriate display is performed based on externally-input image signals. The control circuit 83 generates control signals $T_{SCAN}$, $T_{SFT}$, and $T_{MRY}$ to the individual units based on synchronizing signals $T_{SYNC}$ sent from the synchronizing-signal separator circuit.

The synchronizing-signal separator circuit 86 separates a synchronizing signal component and a brightness signal component from an externally-input NTSC television signal, and is composed of a general frequency separator (filter) circuit or the like. The synchronizing signal separated by the synchronizing-signal separator circuit 86 consists of a vertical synchronizing signal and a horizontal synchronizing signal, and is shown as $T_{SYNC}$ in the drawing. The brightness signal component separated from the television signal is shown as DATA in the drawing. The DATA signal is input to the shift register 84.

The shift register 84 performs serial-parallel conversion by row of the image with respect to the DATA signal which is serially input in time series, and is operated based on the control signal $T_{SFT}$ sent from the control circuit 83. (That is, the control signal $T_{SFT}$ may be defined as a shift clock of the shift register 84.) The data of one row of the image that has been subjected to serial-parallel conversion (which corresponds to drive data for N number of electron-emitting elements) are output from the shift register 84 as N number of parallel signals Id1 to Idn.

The line memory 85 is a memory for storing the data for one row of the image for the required period of time, and stores the contents of Id1 to Idn as required in accordance with the control signal $T_{MRY}$ sent from the control circuit 83. The contents stored are output as Id'1 to Id'n, and input to the modulating-signal generator 87.

The modulating-signal generator 87 is a signal source for properly driving and modulating the individual surface-conduction electron-emitting elements in response to the image data Id'1 to Id'n. The output signals from the modulating-signal generator 87 are applied to the surface-conduction electron-emitting elements in the display panel 81 through terminals Doy1 to Doyn.

The electron-emitting element to which the present invention is applicable has the following basic characteristics with respect to an emission current Ie. Electron emission has a specific threshold voltage Vth, and electron emission occurs only when a voltage of Vth or higher is applied. With respect to a voltage which is equal to or higher than the electron emission threshold voltage, the emission current changes in accordance with the change in the applied voltage to the element. Consequently, when a voltage pulse is applied to the element, even if a voltage lower than the threshold voltage is applied, electron emission does not occur. If a voltage equal to or higher than the electron emission threshold voltage is applied, an electron beam is generated. In such a case, by changing the peak value Vm of the pulse, the intensity of the generated electron beam can be controlled. By changing a pulse width Pw, the total volume of the electrical charge of the generated electron beam can be controlled.

Therefore, in order to modulate electron-emitting elements in response to input signals, voltage modulation, pulse-width modulation, or the like may be employed. When voltage modulation is performed, as the modulating-signal generator 87, a voltage modulation circuit may be used, in which a voltage pulse having a given length is generated and the peak value of the pulse is modulated in response to input data.

When pulse-width modulation is performed, as the modulating-signal generator 87, a pulse-width modulation circuit may be used, in which a voltage pulse having a given peak value is generated and the voltage pulse width is modulated in response to input data.

With respect to the shift register 84 and the line memory 85, both digital signal types and analog signal types may be employed, because they are acceptable as long as the serial-parallel conversion and storage of image signals are performed at a given rate.

When the digital signal types are used, the output signal DATA from the synchronizing-signal separator circuit 86 must be digitized, and for that purpose, an A/D converter may be disposed on the output section of the synchronizing-signal separator circuit 86. With this regard, slightly different circuits are used in the modulating-signal generator 87 depending on whether the output signal of the line memory 85 is digital or analog. That is, in the case of voltage modulation using digital signals, as the modulating-signal generator 87, for example, a D/A conversion circuit is used, and an amplifier circuit or the like may be added as required. In the case of pulse-width modulation, as the modulating-signal generator 87, for example, a circuit is used in which a high-speed oscillator, a counter for counting the number of waves generated by the oscillator, and a comparator for comparing the output of the counter with the output of the memory are combined. An amplifier may be added as required in order to amplify the modulation signal, generated by the comparator, that has been subjected to pulse-width modulation, to the drive voltage for the surface-conduction electron-emitting elements.

In the case of voltage modulation using analog signals, as the modulating-signal generator 87, for example, an amplifier circuit using an operational amplifier is employed, and a level-shift circuit or the like may be added as required. In the case of pulse-width modulation, as the modulating-signal generator 87, for example, a voltage-controlled oscillator circuit (VOC) is employed, and as required, an amplifier for amplifying to the drive voltage for the surface-conduction electron-emitting elements may be added.

In the image-forming apparatus having a configuration as described above, electron emission occurs by applying a voltage to the individual electron-emitting elements through the external terminals Dox1 to Doxm, and Doy1 to Doyn. A high voltage is applied to the metal back 8 or a transparent electrode (not shown in the drawing) through the high-tension terminal Hv to accelerate the electron beam. When accelerated electrons collide with the fluorescent film 7, light is emitted to form an image.

The configuration of the image-forming apparatus described above is an example of image-forming apparatuses to which the present invention is applicable, and various modifications may be made based on the technological idea of the present invention. That is, the mode of image-forming apparatuses is not limited to the image-forming apparatus using electron-emitting elements, and it is also applicable to a plasma display using a gas discharge.

Input signals are not limited to the NTSC signals described above, and PAL, SECAM, and other television signals comprising more scanning lines (for example, a high-definition television system such as MUSE) may be employed. The image-forming apparatuses in accordance with the present invention may be used as image-forming apparatuses for photo printers which include photosensitive drums, in addition to display devices for television broadcasting, and as display devices for video conference systems and computers.

The embodiment of the present invention described above will be described in detail with reference to the following examples. It is to be understood that the invention is not limited to the examples and the invention is intended to cover various modifications and changes in design within the scope of the invention.

EXAMPLE 1

Figure 9:
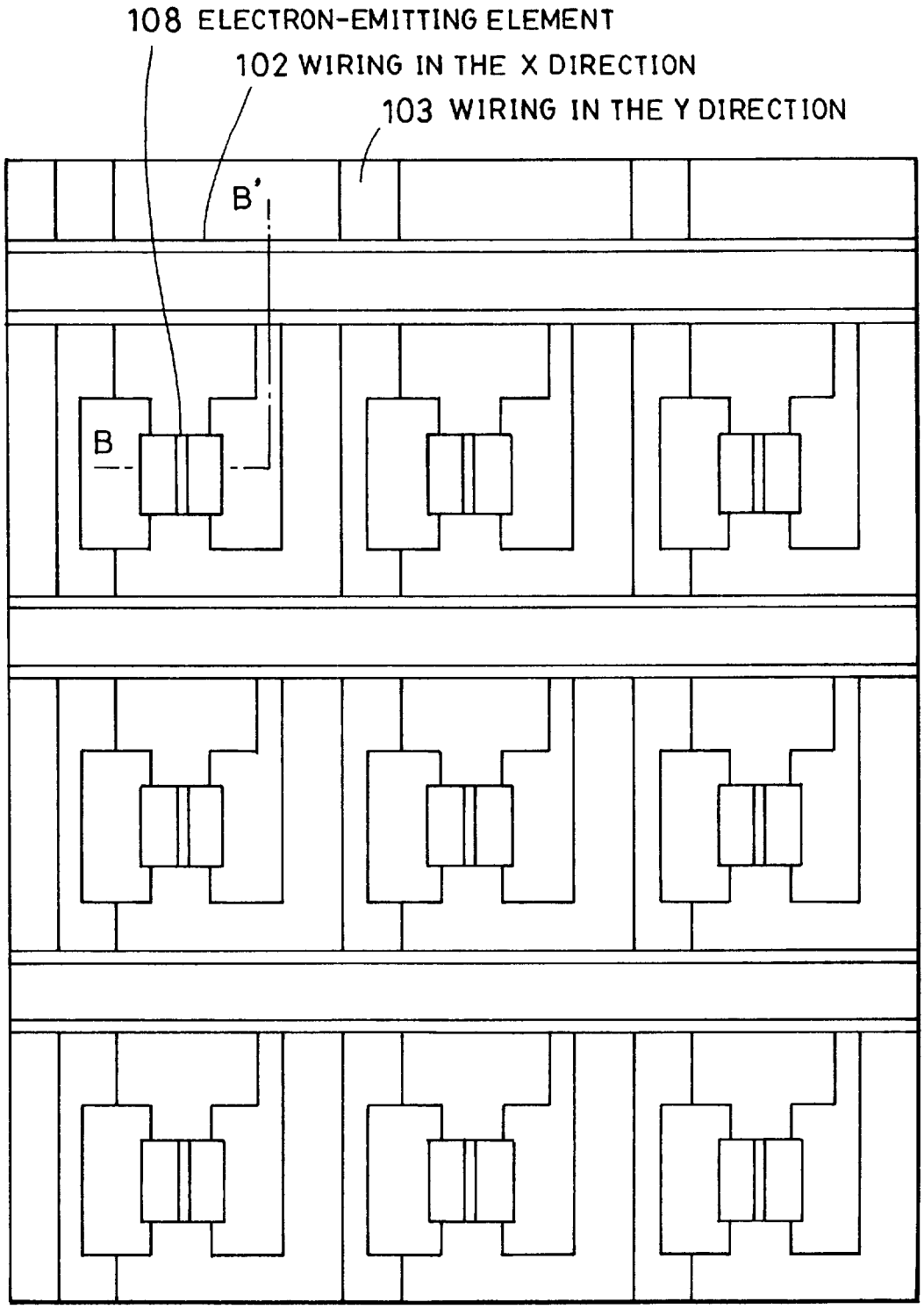
FIG. 9 is a plan view of an electron source arrayed in a simple matrix in accordance with the present invention.
Figure 10:
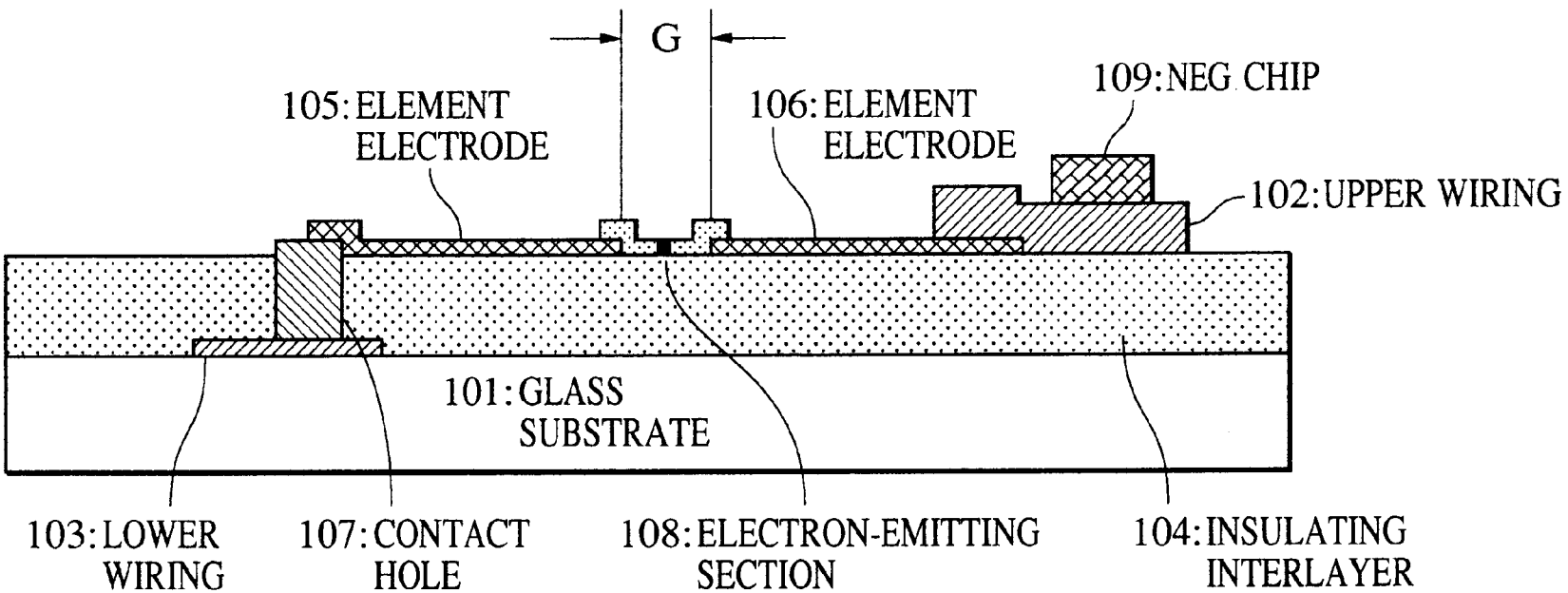
FIG. 10 is a sectional view of the electron source arrayed in a simple matrix shown in FIG. 9.

An image-forming apparatus in this example has the same structure as that of the apparatus schematically shown in FIG. 1. NEG chips are arrayed substantially on the entire surface of the wiring in the X direction (upper wiring) in the image display region. The image-forming apparatus in this example is provided with an electron-source substrate in which a plurality (100 rows×300 columns) of surface-conduction electron-emitting elements are wired in a simple matrix on a substrate. FIG. 9 is a plan view showing a portion of the electron-source substrate. FIG. 9 schematically shows an example of an electron source arrayed in a simple matrix in accordance with the present invention, and FIG. 10 is a sectional view taken along the line B–B' in FIG. 10. In FIGS. 9 and 10, the same components are marked with the same symbols. Numeral 101 represents an electron-source substrate, numeral 102 represents wiring in the X direction (upper wiring) corresponding to Doxm in FIG. 1, and numeral 103 represents wiring in the Y direction (lower wiring) corresponding to Doyn in FIG. 1. Numeral 108 represents a conductive film including an electron-emitting section, numerals 105 and 106 represent element electrodes, numeral 104 represents an insulating interlayer, and numeral 107 represents a contact hole for electrically connecting the element electrode 105 and the lower wiring 103 to each other.

With respect to a method for fabricating the image-forming apparatus in this example, a process for forming an electron-source substrate in which surface-conduction electron-emitting elements in accordance with the present invention are arrayed will be described with reference to FIGS. 11A through 11H, 11X, and 11K.

(Step a) A substrate was cleaned thoroughly using a detergent, pure water, and an organic solvent. A silicon oxide film was formed thereon by sputtering to a thickness of 0.5 $\mu$m to produce an electron-source substrate 101. A photoresist (trade name: AZ1370 manufactured by Hoechst AG) was spin-coated thereon by a spinner, and after baking, a photo-mask image was exposed and developed to form a resist pattern for lower wiring 103. Cr and Au were then deposited by vacuum evaporation to thicknesses of 5 nm and 600 nm, respectively, and an unwanted portion of the Au/Cr deposition was removed by lift-off to form lower wiring 103 having a predetermined pattern (refer to FIG. 11A).

Figure 11A:
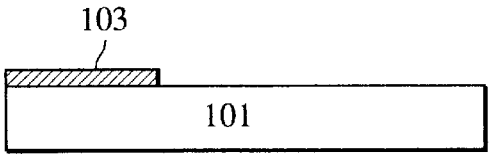
FIGS. 11A through 11H, 11X, and 11K illustrate steps in a process for forming a substrate provided with surface-conduction electron-emitting elements in accordance with the present invention.
Figure 11B:
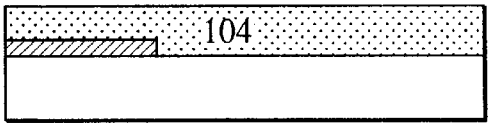
Figure 11C:
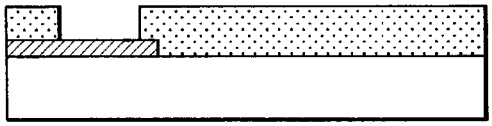
Figure 11D:
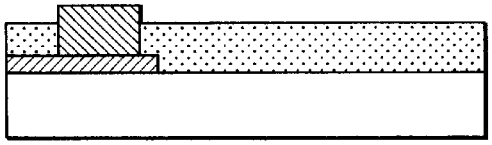
Figure 11E:
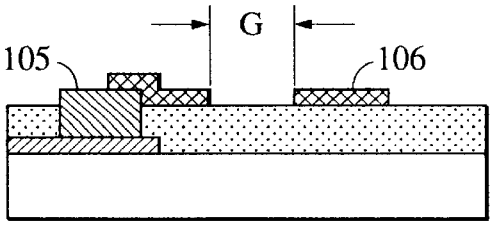
Figure 11F:
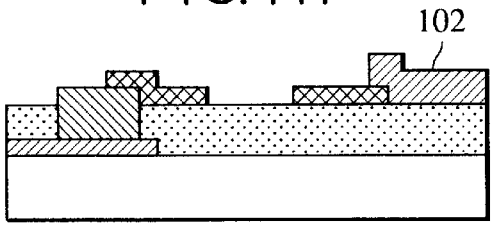
Figure 11G:
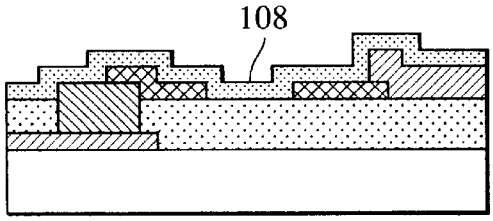

(Step b) Next, an insulating interlayer 104 composed of a silicon oxide film having a thickness of 1.0 $\mu$m was deposited by RF sputtering (refer to FIG. 11B).

(Step c) A photoresist pattern was formed for making a contact hole 107 in the silicon oxide film deposited in step b, and using this as a mask, the insulating interlayer 104 was etched to make the contact hole 107. The etching was performed by a reactive ion etching (RIE) method, using $CF_4$ and $H_2$ gas (refer to FIG. 11C).

(Step d) A pattern was formed on the region excluding the contact hole 107 in a manner such as that for applying a resist, and Ti and Au were deposited by vacuum evaporation to thicknesses of 5 nm and 500 nm, respectively. By removing an unwanted portion by lift-off, the contact hole 107 was embedded (refer to FIG. 11D).

(Step e) Patterns for producing element electrodes 105 and 106 and a gap G between the element electrodes were formed using a photoresist (trade name: RD-2000N-41 manufactured by Hitachi Chemical Co., Ltd.), and Ti and Ni were deposited by vacuum evaporation to thicknesses of 5 nm and 100 nm, respectively. The photoresist pattern was dissolved by an organic solvent, and the Ni/Ti deposition was subjected to lift-off so that the gap G between the element electrodes was set at 3 μm and the width of the element electrodes was set at 300 μm, and thus the element electrodes 105 and 106 were formed (refer to FIG. 11E).

(Step f) After a photoresist pattern for upper wiring 102 was formed on the element electrodes 105 and 106, Ti and Au were deposited by vacuum evaporation to thicknesses of 5 nm and 500 nm, respectively. An unwanted portion was removed by lift-off to form upper wiring 102 having a predetermined pattern (refer to FIG. 11F).

(Step g) A Cr film with a thickness of 100 nm was deposited and patterned by vacuum evaporation, and a Pd-amine complex solution (trade name: ccp4230 manufactured by Okuno Chemical Industries Co., Ltd.) was spin-coated thereon by a spinner. Firing treatment was performed at 300° C. for 10 minutes. A conductive film 108 for forming the electron-emitting section, formed as described above and composed of particulate Pd as a major element, had a thickness of 8.5 nm, and a sheet resistance of $3.9\times10^4$ Ω/square. The particulate film is a film in which a plurality of fine particles are aggregated, and the particulate structure indicates a state where fine particles are dispersed, a state where fine particles lie adjacent to each other, or a state where fine particles overlap (including an island state), and the particle diameter refers to the diameter of fine particles whose particle shapes are recognizable (refer to FIG. 11G).

Figure 11H:
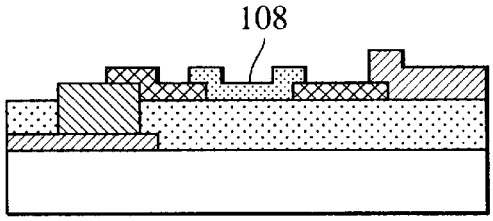
Figure 11X:
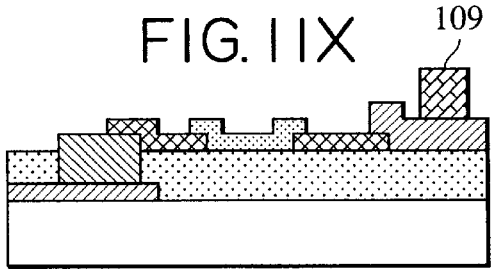

(Step h) The Cr film and the fired conductive film 108 for forming the electron-emitting section were etched by an acid etchant to form a predetermined pattern (refer to FIG. 11H).

Thus, a plurality (100 rows×300 columns) of conductive films 108 for forming the electron-emitting section were connected to a simple matrix comprising the upper wiring 102 and the lower wiring 103 on the electron-source substrate 101.

(Step x) On the upper wiring 102, wire NEG chips 109 (trade name: ST122 manufactured by SAES Getters Co., Ltd.) having a diameter of 0.4 mm, each being cut to a length of 3 cm, were disposed in order, using an inorganic adhesive (trade name: Aron Ceramics-W manufactured by Toagosei Co., Ltd.) (refer to FIG. 11X). As shown in FIG. 1, the adhesive was applied only to the two ends of the NEG chips.

(Step y) Heating treatment was performed in air at 150° C. for 60 minutes to fire the inorganic adhesive. Firing was performed on the entire electron-source substrate.

Thus, the electron-source substrate 1 provided with getters in the image display region, namely, in-plane getters, was formed.

(Step i) Next, a faceplate 4 shown in FIG. 1 was fabricated as follows. A glass substrate 6 was thoroughly cleaned using a detergent, pure water, and an organic solvent. ITO was deposited thereon by sputtering to a thickness of 0.1 μm to form a transparent electrode (not shown in the drawing). Next, a fluorescent film 7 was applied thereto by printing, and planarization treatment (generally referred to as "filming") was performed on the surface to form a fluorescent section. The fluorescent film 7 was made in a stripe, as shown in FIG. 6A, in which stripe phosphors (R, G, and B) 13 and black conductive materials (black stripes) 12 were alternately arrayed. On the fluorescent film 7, a metal back 8 composed of an Al thin film was formed by sputtering to a thickness of 0.1 μm.

(Step j) An envelope 5 shown in FIG. 1 was fabricated as described below. After the electron-source substrate 1 was fixed to the rear plate 2, the frame 3 and the faceplate 4 were combined. The lower wiring 103 and the upper wiring 102 of the electron-source substrate 1 were connected to signal input terminals 11 and row selection terminals 10, respectively, and the positions of the electron-source substrate 1 and the faceplate 4 were precisely adjusted, followed by sealing, to form the envelope 5. The method of sealing included the steps of applying frit glass to joints, and performing heat treatment in Ar gas at 450° C. for 30 minutes. The electron-source substrate 1 was fixed to the rear plate 2 by a similar treatment. When the rear plate and the faceplate were disposed, ring getters of Ba were simultaneously disposed at predetermined positions.

A vacuum apparatus used in the subsequent steps will be described with reference to a schematic diagram shown in FIG. 12 which illustrates an evacuating apparatus used for the forming of the image-forming apparatus and the activation step in the present invention.

Figure 12:
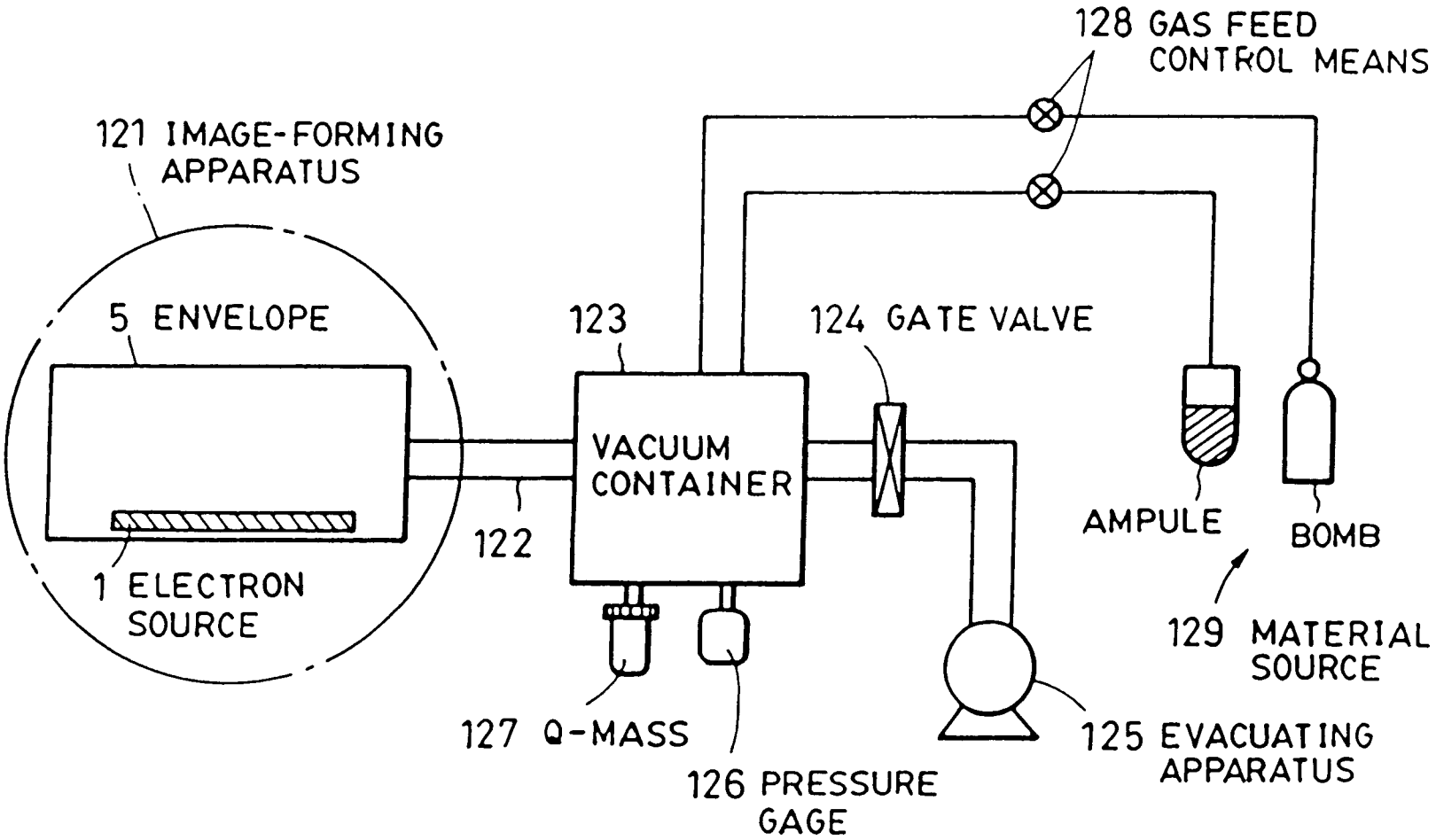
FIG. 12 is a schematic diagram of an evacuating apparatus for performing the forming and activating steps of an image-forming apparatus in the present invention.

In FIG. 12, an image-forming apparatus 121 is connected to a vacuum container 123 through an exhaust pipe 122, and an evacuating apparatus 125 is connected to the vacuum container 123 with a gate valve 124 therebetween. A pressure gauge 126 and a quadrupole mass spectrograph (Q-mass) 127 are mounted on the vacuum container 123 so that the internal pressure and partial pressures of residual gases are monitored. Since it is difficult to directly measure the internal pressure and partial pressures in the envelope 5, the pressure and partial pressures indirectly measured in the vacuum container 123 are considered as the values in the envelope.

The evacuating apparatus 125 is for an ultrahigh vacuum, and includes an adsorption pump and an ion pump. A plurality of gas feeders are connected to the vacuum container 123 so that materials stored in a material source 129 are introduced. Materials to be introduced are filled in a bomb or an ampule depending on the types of materials. The amount introduced can be controlled by a gas-feed controller 128. As the gas-feed controller 128, a needle valve, a mass-flow controller, or the like is used in accordance with the types of materials introduced, the amount of flow, the required control accuracy, etc. In this example, benzonitrile contained in a glass ampule was used as the material source 129, and a slow-leak valve was used as the gas-feed controller 128.

Figure 11K:
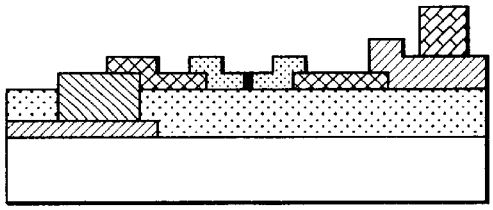
Figure 13:
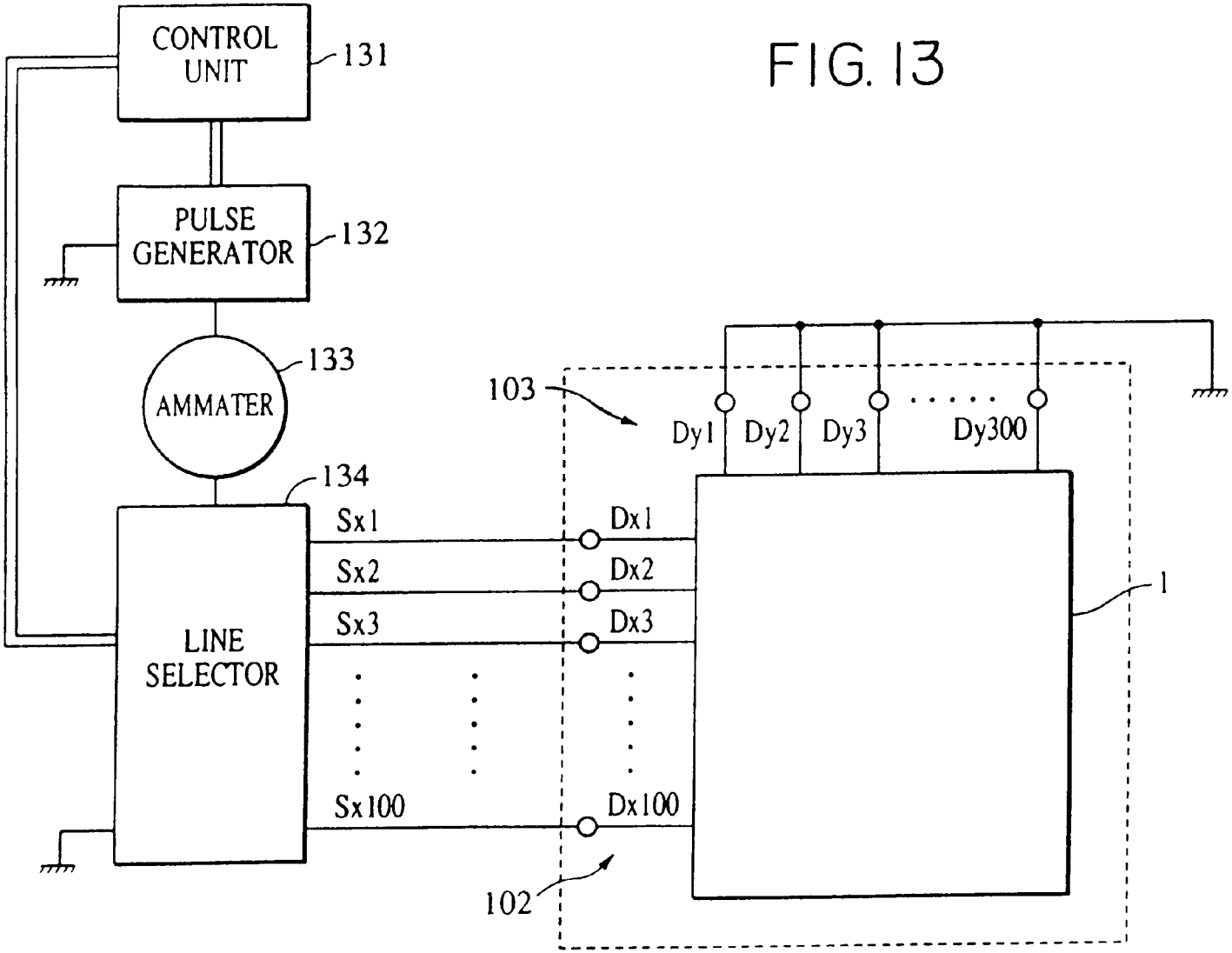
FIG. 13 is a schematic diagram which shows a method of connecting wire for the forming and activating steps of an image-forming apparatus in the present invention.

(Step k) The envelope 5 was evacuated and the pressure was reduced to $1\times10^{-5}$ Pa or less, and the following treatment (hereinafter referred to as "forming") was performed to form the electron-emitting section on the plurality of conductive films 108 (refer to FIG. 11K). As shown in FIG. 13, the wiring 103 in the Y direction was commonly connected and grounded. A control unit 131 controls a pulse generator 132 and a line selector 134. Numeral 133 represents an ammeter. One line was selected from the wiring 102 in the X direction by the line selector 134, and a voltage pulse was applied thereto. The forming treatment was performed by rows (300 elements per row).

Figure 14A:
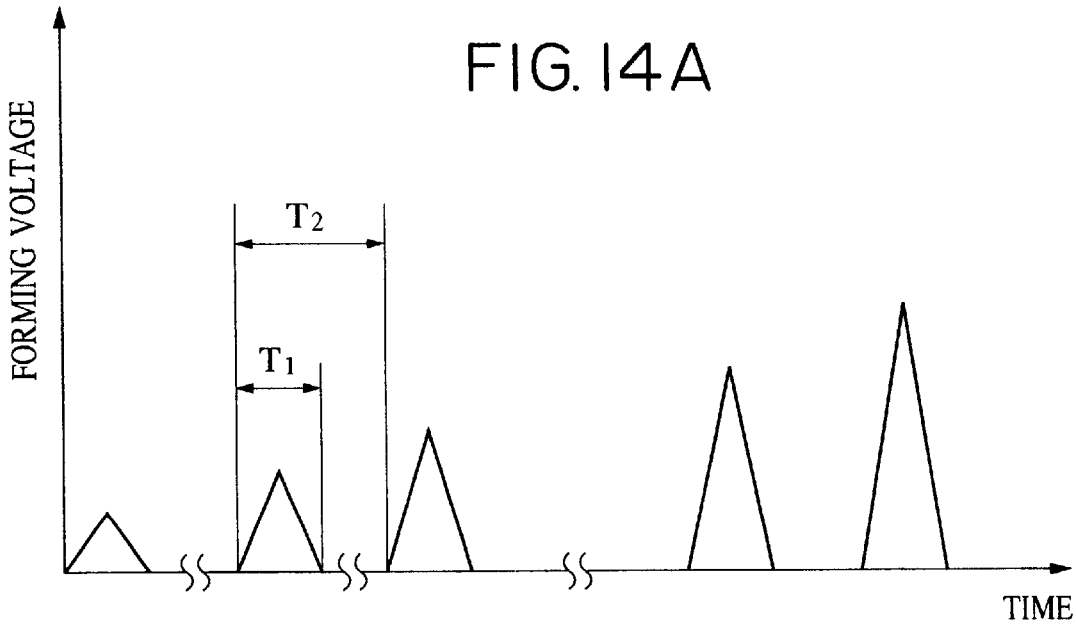
FIGS. 14A and 14B are schematic diagrams which show voltage waveforms used during the forming step of an image-forming apparatus in the present invention.
Figure 14B:
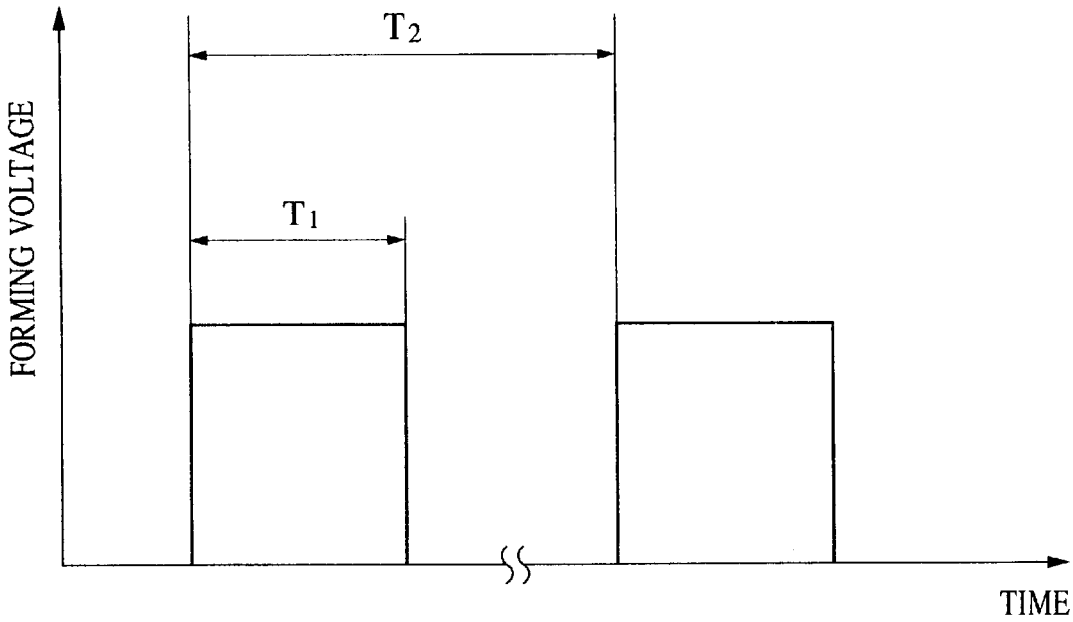

The applied pulse had a triangular wave as shown in FIG. 14A, and the peak value was gradually increased. FIGS. 14A and 14B are schematic diagrams which show voltage waveforms used during the forming step of an image-forming apparatus in the present invention. Pulse width T1 was set at 1 msec and pulse period T2 was set at 10 msec. The resistance in each row was measured by inserting a rectangular pulse having a peak value of 0.1 V between the triangular pulses and by measuring the current. When the resistance exceeded 3.3 kΩ (1 MΩ per element), forming for the row was completed, and forming treatment for the next row was started. Forming treatment was performed for all rows to complete the forming for all the conductive films (conductive films 108 for forming the electron-emitting section). Thus, an electron-emitting section was formed on each conductive film, and an electron-source substrate 1 was produced in which a plurality of surface-conduction electron-emitting elements were wired in a simple matrix.

(Step l) Benzonitrile was introduced into the vacuum container 123 and the pressure was adjusted to $1.3\times10^{-3}$ Pa. Activation treatment was performed by applying a pulse to each electron-emitting element in the electron-source substrate while an element current $I_f$ was measured. The pulse waveform generated by the pulse generator 132 was rectangular, as shown in FIG. 14B. The peak value was 14 V, pulse width T1 was 100 μsec, and the pulse period T2 was 167 μsec. The selected line was shifted from Dx1 to Dx100 in sequence every 167 μsec by the line selector 134, and thus a rectangular wave having a T1 of 100 μsec and a T2 of 16.7 msec was applied to each element row with a slightly shifted phase.

The ammeter 133 was used in a mode in which an average current was detected when the rectangular pulse was ON (at a voltage of 14 V). When the current value was 600 mA (2 mA per element), the activation treatment was finished and the envelope 5 was evacuated.

(Step m) While evacuation treatment was performed, the image-forming apparatus 121 and the vacuum container 123 were kept at 300° C. for 10 hours by a heating unit (not shown in the drawing). By this treatment, benzonitrile and decomposed substances from benzonitrile, which were supposed to have been adsorbed by the inner walls of the envelope 5 and the vacuum container 123 and the like, were removed. This was confirmed by the observation using the Q-mass 127. In this step, degassing was performed and activation treatment for the in-plane getters was also performed by heating and evacuating the image-forming apparatus.

(Step n) After confirming that the pressure was $1.3\times10^{-3}$ Pa or less, the exhaust pipe was sealed off by heating. Evaporative getters which were preliminarily arranged in the exterior of the image display region were flashed by high-frequency heating.

Thus, an image-forming apparatus in example 1 was produced.

EXAMPLE 2

(Steps a through h) Performed in a similar manner to those in example 1.

(Step x) Six wire NEGs (trade name: ST122 manufactured by SAES Getters Co., Ltd.), each having a length of 10.5 cm and a diameter of 0.4 mm, were connected by spot welding to make a long chip 109 having a length of 63 cm. The long chips 109 were disposed in sequence on the upper wiring 102 using an inorganic adhesive (trade name: Aron Ceramics-W manufactured by Toagosei Co., Ltd.). The adhesive was applied only to the two ends of the long NEG chips. The long chips were disposed on the electron-source substrate so that the portions to which the adhesive was applied were not in the image-forming section.

(Step y) Heating treatment was performed in air at 150° C. for 60 minutes to fire the inorganic adhesive. Firing was performed on the entire electron-source substrate.

(Steps i through n) Performed in a similar manner to those in example 1.

Thus, an image-forming apparatus in example 2 was produced.

EXAMPLE 3

(Steps a through h, x, y, and i through l) Performed in a similar manner to those in example 2.

(Step z) Heat treatment was performed (in the same chamber as that in which baking was performed) at 250° C. for 10 hours in a vacuum, which was maintained until baking, to degas the inorganic adhesive.

(Steps m through n) Performed in a similar manner to those in example 2.

Thus, an image-forming apparatus in example 3 was produced.

EXAMPLE 4

(Steps a through h, x, y, and i through l) Performed in a similar manner to those in example 2.

(Step z) Heat treatment was performed (in the same chamber as that in which baking was performed) at 375° C. for 90 minutes in a vacuum, which was maintained until baking, to degas the inorganic adhesive.

(Steps m through n) Performed in a similar manner to those in example 2.

Thus, an image-forming apparatus in example 4 was produced.

EXAMPLE 5

(Steps a through h, x, y, and i) Performed in a similar manner to those in example 2.

Figure 15:
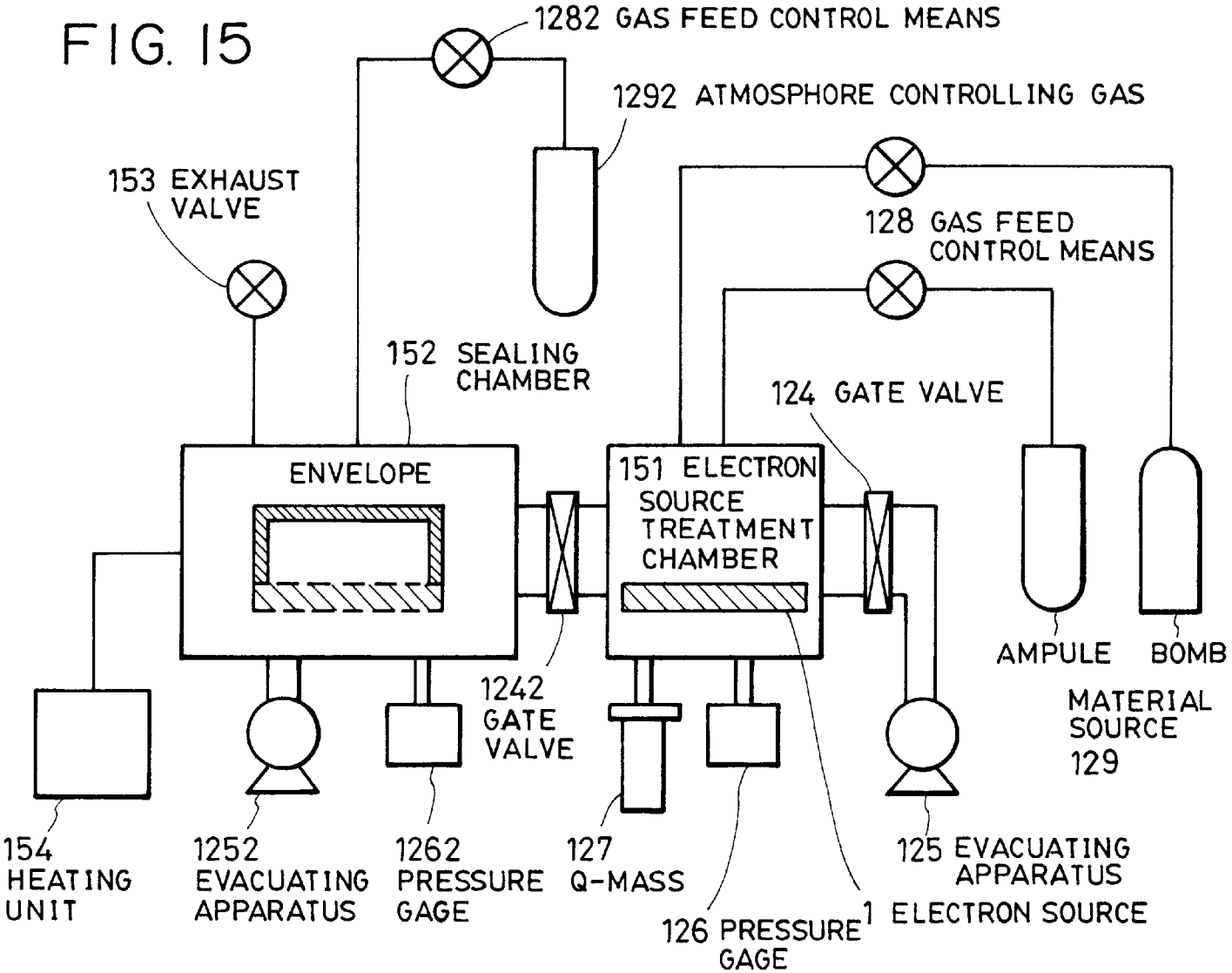
FIG. 15 is a schematic diagram of an evacuating apparatus for performing the forming and activating steps of an image-forming apparatus in the present invention.

A vacuum apparatus used in the subsequent steps will be described with reference to a schematic diagram shown in FIG. 15 which illustrates an evacuating apparatus used for the forming of the image-forming apparatus and the activation step. The electron-source substrate 1 was brought into an electron-source treatment chamber 151, and the forming of the electron source and activation treatment described in steps k and l in examples 1 to 4 were performed. An evacuating apparatus 125 is connected to the electron-source treatment chamber 151 with a gate valve 124 therebetween. A pressure gauge 126 and a quadrupole mass spectrograph (Q-mass) 127 are mounted on the electron-source treatment chamber 151 so that the internal pressure and partial pressures of residual gases are monitored.

The evacuating apparatus 125 is for an ultrahigh vacuum, and includes an adsorption pump and an ion pump. A plurality of gas feeders are connected to the electron-source treatment chamber 151 so that materials stored in a material source 129 are introduced. Materials to be introduced are filled in a bomb or an ampule, depending on the types of materials. The amount introduced can be controlled by a gas-feed controller 128. As the gas-feed controller 128, a needle valve, a mass-flow controller, or the like is used in accordance with the types of materials introduced, the amount of flow, the required control accuracy, etc. In this example, benzonitrile contained in a glass ampule was used as the material source 129, and a slow-leak valve was used as the gas-feed controller 128.

The activated electron-source substrate 1 is delivered to a sealing chamber 152 through a gate valve 1242. A heating unit 154 is attached to the sealing chamber 152 so that the temperature is raised to the required level for sealing. In this structure, the entire sealing chamber 152 functions as a furnace. An evacuating apparatus 1252 and a pressure gauge 1262 are also connected to the sealing chamber 152 so that sealing is performed at a predetermined pressure. A gas source 1292 which can substitute the chamber atmosphere is connected to the sealing chamber 152 through gas-feed controller 1282. An exhaust valve 153 is also provided in order to release the introduced gas when the pressure is equal to or more than the atmospheric pressure.

(Step J) Forming corresponding to step k in example 1 was performed in the electron-source treatment chamber 151 described above.

(Step K) Electron-source activation corresponding to step m in example 1 was performed in the electron-source treatment chamber 151.

(Step M) In the sealing chamber 152, a faceplate, a frame, an exhaust pipe, and Ba ring getters were aligned and sealed to fabricate an envelope 5.

(Step n) Performed in a similar manner to that in example 2.

Thus, an image-forming apparatus in example 5 was produced.

EXAMPLE 6

(Steps a through h, x, y, i, J, and K) Performed in a similar manner to those in example 5.

(Step z) Heat treatment was performed at 250° C. for 10 hours in the sealing chamber 152 of the vacuum apparatus to degas the inorganic adhesive.

(Steps M and n) Performed in a similar manner to those in example 5.

Thus, an image-forming apparatus in example 6 was produced.

EXAMPLE 7

(Steps a through h, x, y, i, J, and K) Performed in a similar manner to those in example 5.

(Step z) Heat treatment was performed at 375° C. for 90 minutes in the sealing chamber 152 of the vacuum apparatus to degas the inorganic adhesive.

(Steps M and n) Performed in a similar manner to those in example 5.

Thus, an image-forming apparatus in example 7 was produced.

Next, in order to clarify the characteristics of the present invention, comparative examples will be described.

COMPARATIVE EXAMPLE 1

(Steps a through h, and Steps i through n) Performed in a similar manner to those in example 1.

Thus, an image-forming apparatus in comparative example 1 was produced.

COMPARATIVE EXAMPLE 2

(Steps a through e) Performed in a similar manner to those in example 1.

Figure 16:
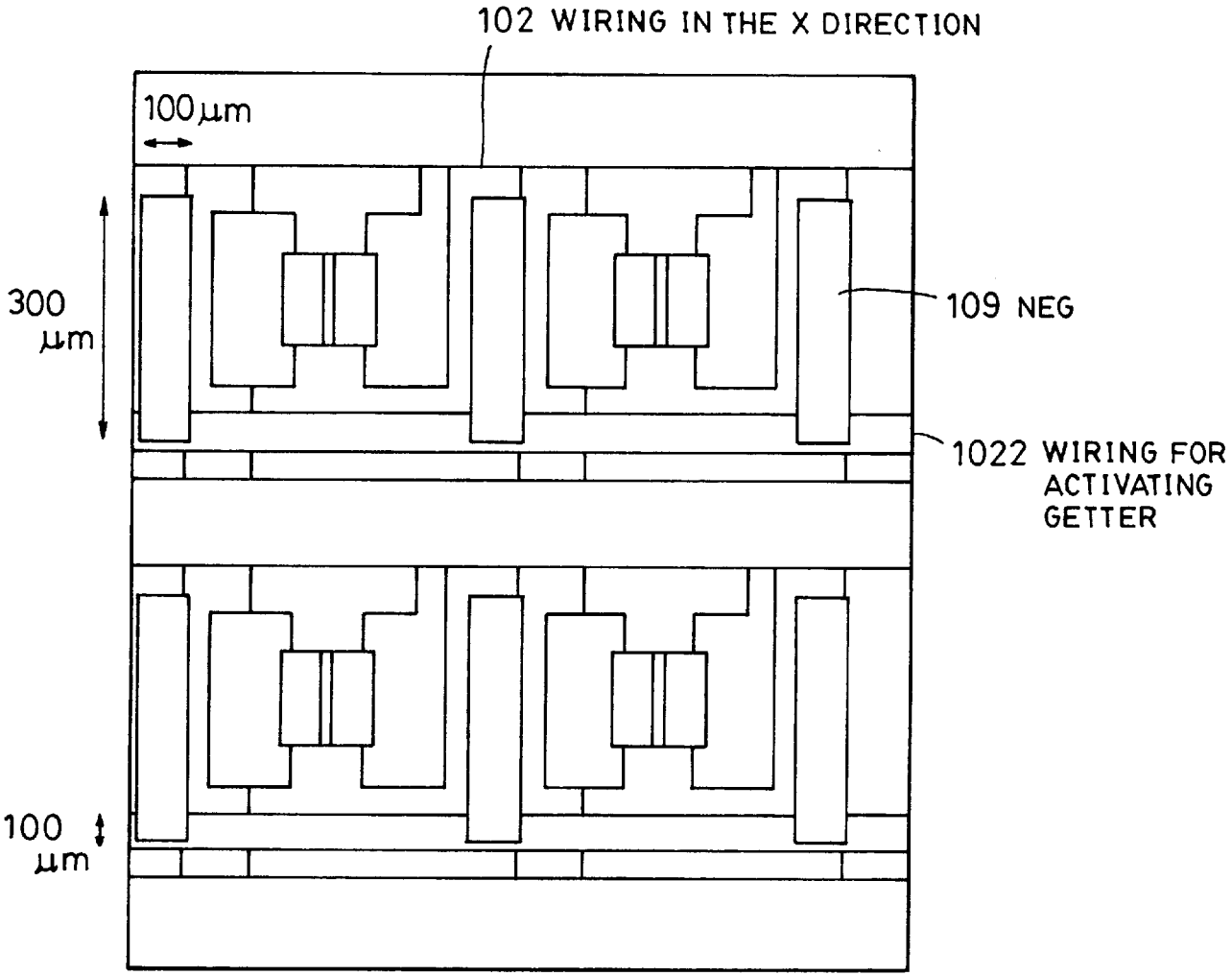
FIG. 16 is a schematic diagram which shows an NEG film and wiring for activating a getter in comparative example 2.

(Step f) After a photoresist pattern for upper wiring 102 was formed on the element electrodes 105 and 106, Ti and Au were deposited by vacuum evaporation to thicknesses of 5 nm and 500 nm, respectively. An unwanted portion was removed by lift-off to form upper wiring 102 having a predetermined pattern and getter-activating wiring 1022 (refer to FIG. 16). FIG. 16 is a schematic diagram which shows an NEG film and getter-activating wiring in this comparative example.

(Steps g and h) Performed in a similar manner to those in example 1.

(Step w) After a metal mask having an opening corresponding to the pattern of the wiring in the X direction (upper wiring) was placed, aligned and fixed on an electron-source substrate 101, the substrate 101 was mounted in a sputtering system. Using an alloy having the composition of Zr—V—Fe=70 wt %:25 wt %:5 wt % as a target, an alloy layer as an NEG film was formed by sputtering to a thickness of 300 nm.

(Steps i through 1) Performed in a similar manner tothose in example 1.

(Step m) While evacuation treatment was performed, the image-forming apparatus 121 and the vacuum container 123 were kept at 300° C. for 10 hours by a heating unit (not shownin the drawing).

(Step v) The getter layer was activated. By applying a pulse which was the same as that in the activation treatment for the electron source (described in step l of example 1), an electron beam was emitted from the electron-emitting element 108. A voltage of −1 kV was applied to the high-tension terminal Hv, and +50 V was applied to the getter-activating wiring 1022. Thus, electrons emitted from the electron-emitting element 108 were drawn by the getter layer 109 disposed nearby, and collided with the getter layer 109, imparting energy thereto. Accordingly, the getters were activated.

(Step n) Performed in a similar manner to that in example 1.

Thus, an image-forming apparatus in comparative example 2 was produced.

(Evaluation)

Figure 17:
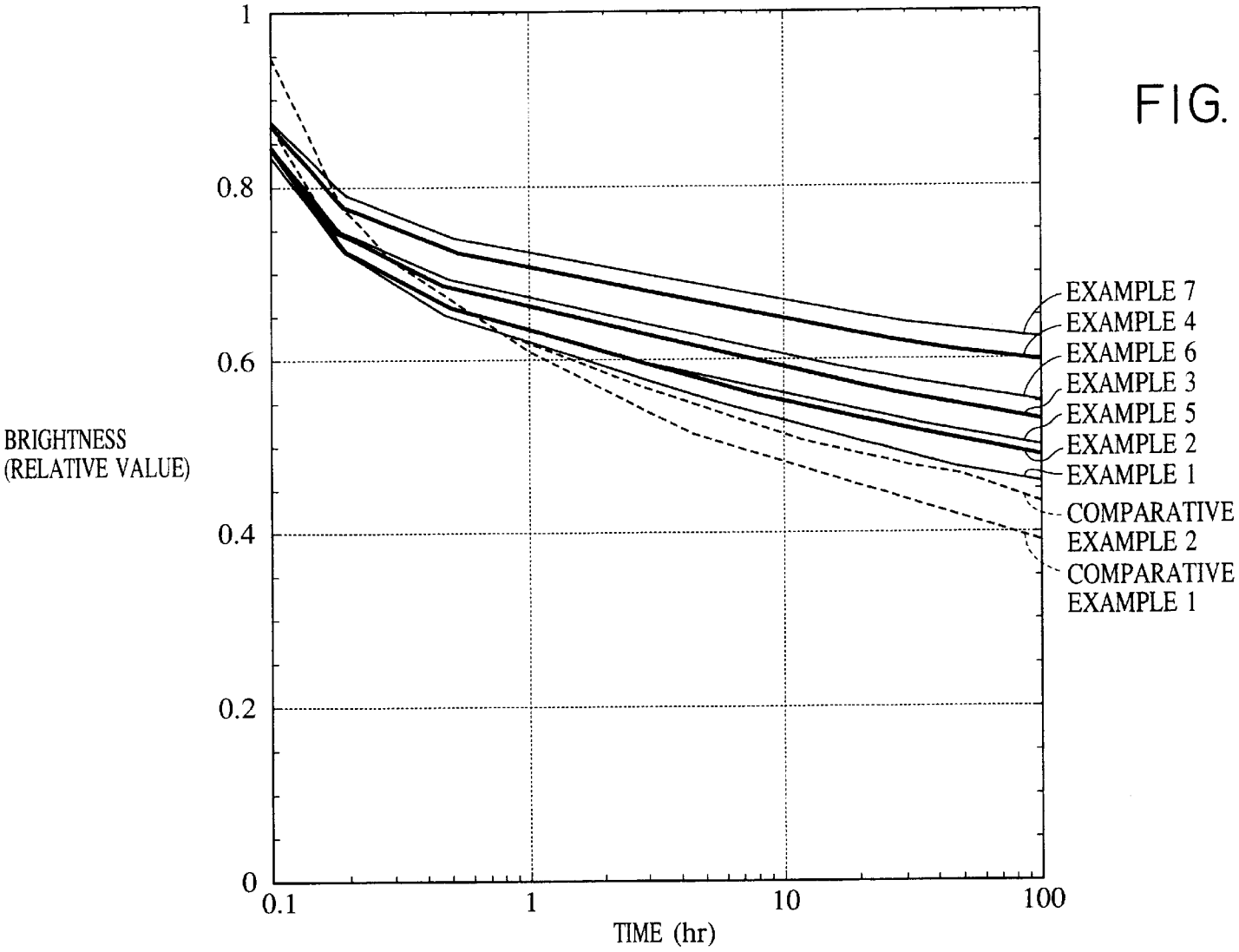
FIG. 17 is a graph which shows a change in brightness over time with respect to image-forming apparatuses in examples and comparative examples.

A change in brightness over time was investigated with respect to image-forming apparatuses in examples and comparative examples which were produced as described above. The results are shown in FIG. 17. With respect to examples according to the present invention shown in solid lines in the drawing, a decrease in brightness was lower in comparison with comparative examples 1 and 2 shown in dotted lines. Moreover, with respect to examples 3, 4, 6, and 7 in which inorganic adhesives were subjected to degassing treatment by heating at 250° C. or more, the extent of the decrease in brightness was lower.

With respect to electron-emitting elements constituting an electron source used in a flat display, it is desirable to simplify the structure and fabrication method in view of production technology, production costs, and the like. The fabrication of electron-emitting elements must be achieved by the deposition of thin films and simple processes, or when a large apparatus is fabricated, the fabrication must be achieved by a technique that does not require a vacuum apparatus, such as by printing.

In this way, in accordance with the present invention, the problem associated with the disclosure in Japanese Patent Laid-Open No. 4-12436 is overcome, in which, in the electron source having the gate electrode composed of a getter material, complex steps in a vacuum apparatus are required for producing conical negative electrodes or for joining semiconductors, and an increase in the size of the apparatus is restricted due to production equipment.

In accordance with the present invention, the problem associated with the disclosure in Japanese Patent Laid-Open No. 63-181248 is also overcome, in which, in the apparatus having controlling electrodes, and so on between the electron source and the faceplate, the structure becomes complex, and complex steps, such as alignment of those members, are required in the production process.

In accordance with the present invention, the problem associated with the disclosure in U.S. Pat. No. 5,453,659 is also overcome, in which, in a method for forming the getter material on the anode plate, the getter material and phosphors must be electrically isolated, and the size of the image display device that can be produced is restricted because of the size of the apparatus used for photolithography for the micro-fabrication process.

As electron-emitting elements having structures which satisfy the requirement of the easy fabrication process described above, lateral field emission-type electron-emitting elements and surface-conduction electron-emitting elements can be referred to. In the lateral field emission-type electron-emitting element, a negative electrode (gate) having a pointed electron-emitting section is opposed to a planar substrate, and electrons are emitted by a thin-film deposition method, such as evaporation, sputtering, or plating, and general photolithography. An example thereof is disclosed in Japanese Patent Laid-Open No. 7-235255.

The electron sources using such elements are not provided with either conical gate electrodes as disclosed in Japanese Patent Laid-Open No. 4-12435 or controlling electrodes as disclosed in Japanese Patent Laid-Open No. 63-181248. Therefore, it is not possible to dispose getters in the image display region in the same manner as that in those patents, and getters are placed in the exterior to the image display region.

As described above, in the image display device, the image display member, such as a fluorescent film, which is bombarded with high-energy electrons, most greatly contributes to the generation of gases. If sufficient degassing treatment is performed, such as long-time baking at high temperatures, the generation of gases may be avoided. However, in the actual apparatuses, since electron-emitting elements and other members are thermally damaged, sufficient degassing treatment cannot always be performed. In such a case, there is a strong possibility of generating gases.

When the pressures of generated gases are relatively low, the gases may be adsorbed by the electron-emitting section of the electron source, thus adversely affecting the characteristics, and gas molecules ionized due to an electric potential emitted by the electron source may be accelerated by an electric field formed by an applied voltage between the image display section and the electron source, or the positive electrode and the negative electrode of the electron source, and may collide with the positive electrode or the negative electrode of the electron source, causing damage.

When the pressures of gasses are locally and momentarily increased, ions accelerated by the electric field may collide with other gaseous molecules to generate ions, thus causing a discharge. In such a case, the electron source is partially broken, resulting in degradation of the electron-emitting characteristics. With respect to the generation of gases from the image display members, when electrons are emitted after the formation of the image display apparatus so that phosphors emit light, gases such as $H_2O$, $H_2$, $CH_4$, CO, $CO_2$, and $O_2$ contained in the phosphors are rapidly released. This may cause a phenomenon such as a large decrease in brightness of the image in the beginning of operation.

Additionally, in the conventional case of providing the getter region in the exterior of the display region, gases generated in the center of the image display region take time to reach the exterior getter region, and before being adsorbed by getters, the gases are adsorbed again by the electron source, resulting in degradation of the electron-emitting characteristics. The getters do not demonstrate sufficient effects to prevent the above, and in particular, the decrease in brightness of the image may be observed in the center of the image display region. Therefore, in the flat image display devices which are not provided with gate electrodes or controlling electrodes, it has been desired that a novel structure for placing the getter member in the image display region is invented so that generated gases are promptly removed.

In order to suppress an increase in pressure due to local gas emission, a getter material must be distributed in the entire surface of the image display region. For example, a specific method therefor is disclosed in Japanese Patent Laid-Open No. 9-82245. However, when a getter material is fixed by evaporation such as sputtering as in such an example, the thickness of the getter member and the film structure are limited, and further the getter characteristics must be improved.

In view of the above, as is clear from the examples described above, in accordance with the present invention, image-forming apparatuses which overcome inconveniences associated with the conventional apparatuses can be provided. In particular, it is possible to provide image-forming apparatuses in which a decrease in brightness over time is reduced and dispersion in brightness over time in the image-forming region is decreased, and also to provide a method for fabricating the same.

Second Embodiment

An embodiment in which metal powder is used as a non-evaporable getter will be described. In this embodiment, basically, non-evaporable getters are provided on wiring for connecting the individual electron-emitting elements on an electron-source substrate in which a plurality of surface-conduction electron-emitting elements are disposed.

Figure 18:
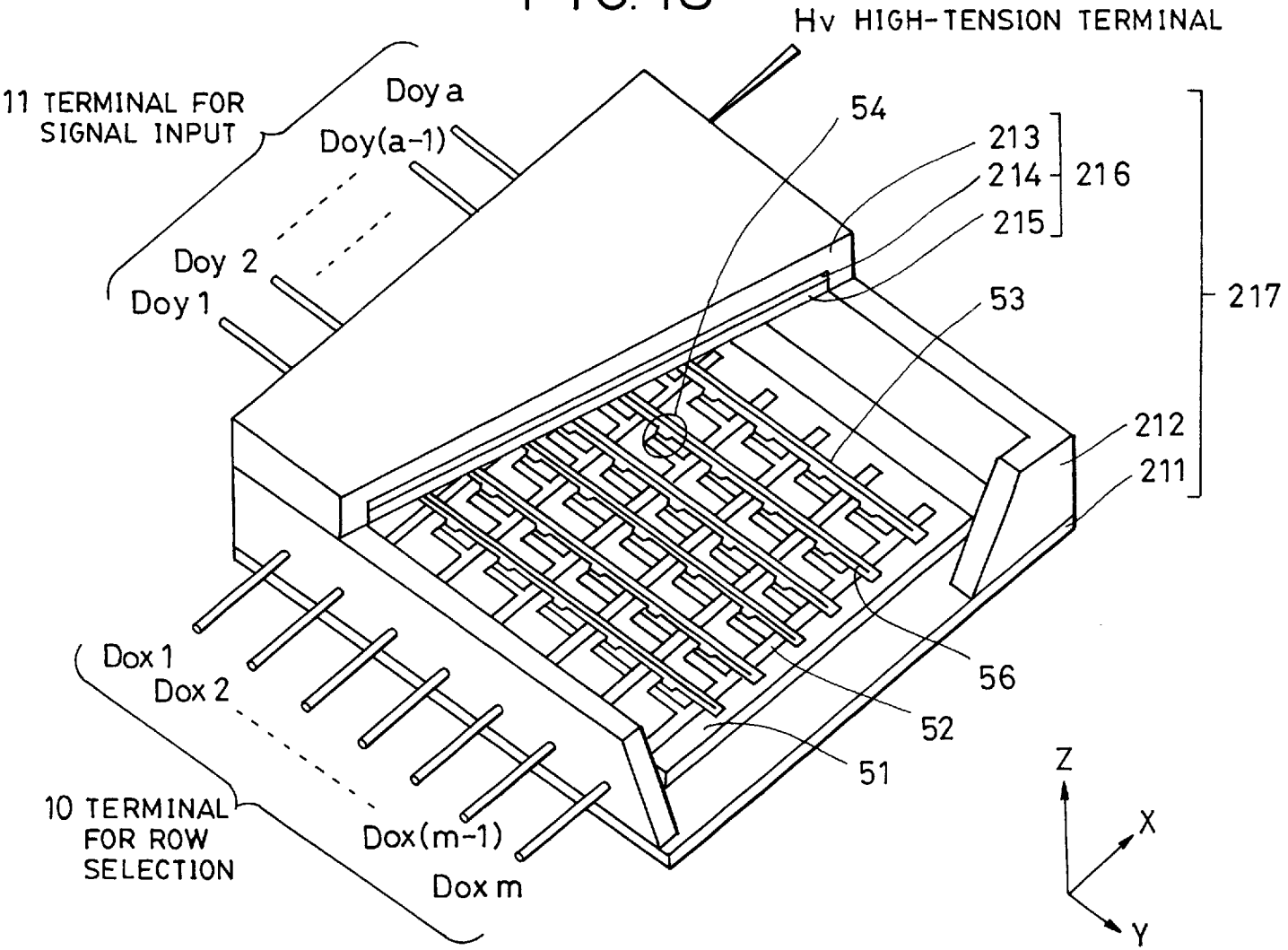
FIG. 18 is a cutaway perspective view which shows a structure of an envelope of an image-forming apparatus as a second embodiment.
Figure 19:
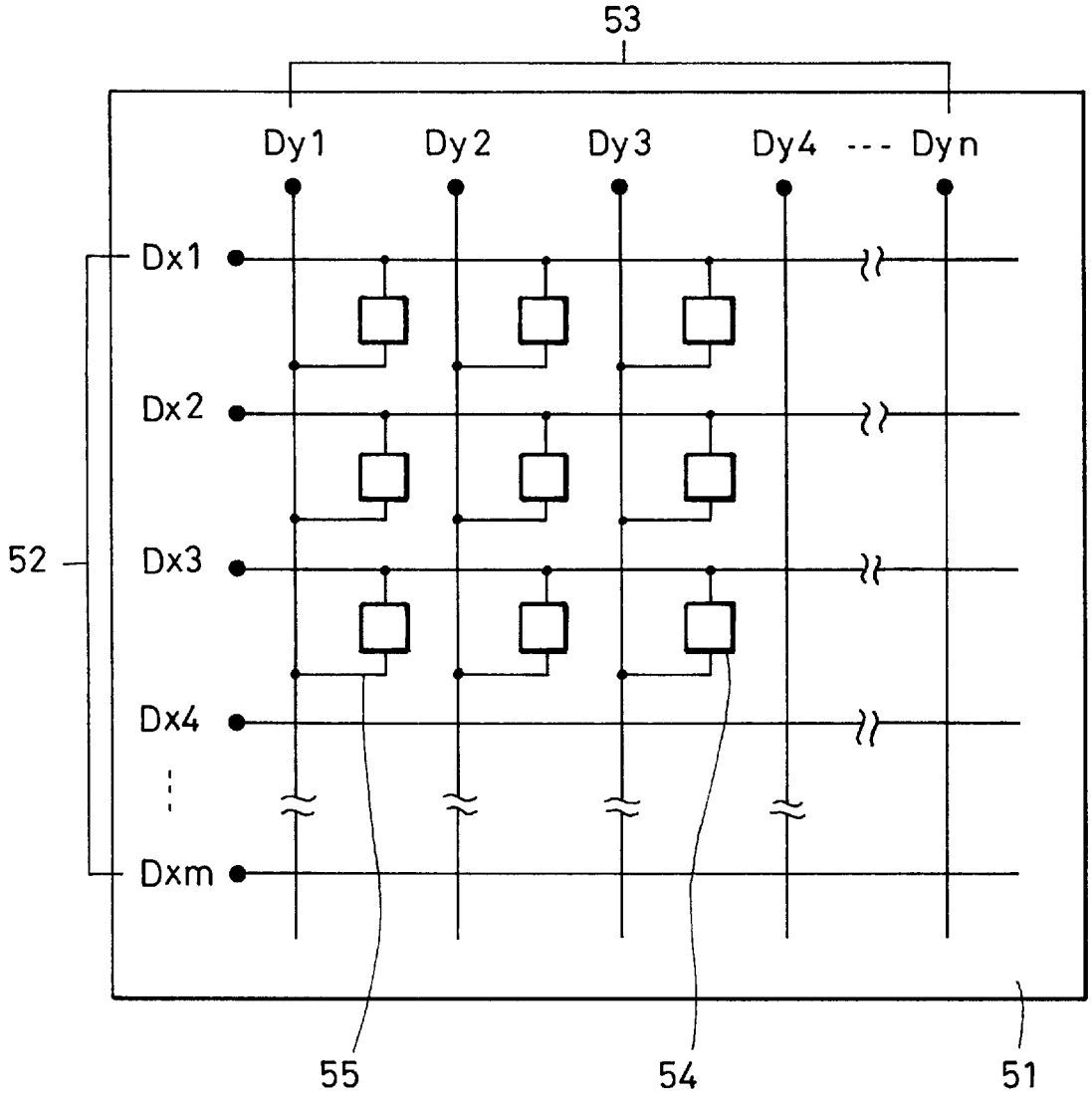
FIG. 19 is a schematic diagram which shows an electron source in the second embodiment.

As described above, in this embodiment, electron-emitting elements are also arrayed in a simple matrix. In FIGS. 18 and 19, numeral 51 represents an electron-source substrate (glass substrate), numeral 52 represents wiring in the X direction, numeral 53 represents wiring in the Y direction, and numeral 54 represents an electron-emitting element (in this case, a surface-conduction electron-emitting element is described as an example).

The wiring 52 in the X direction includes a m number of wires Dx1, Dx2, . . . , Dxm, and is a conductive metal formed by printing, such as screen printing or offset printing. Materials for the wiring, film thickness, and width are appropriately designed. The wiring 53 in the Y direction includes n number of wires Dy1, Dy2, . . . , Dyn, and is composed of a conductive metal the same as the wiring 52 in the X direction. An insulating interlayer (not shown in the drawing) is provided between the m number of the wiring 52 and n number of wiring 53 to electrically isolate both of them (m and n are positive integers). The wiring 52 in the X direction and the wiring 53 in the Y direction are led to external terminals of an envelope 217.

A pair of electrodes constituting the electron-emitting element 54 are electrically connected to each other by m number of wiring 52 in the X direction, n number of wiring 53 in the Y direction, and a connection composed of a conductive metal or the like. Means for applying scanning signals (not shown in the drawing) is connected to the wiring 52 in the X direction so that a scanning signal for selecting a row of electron-emitting elements 54 arrayed in the X direction is applied. On the other hand, means for applying scanning signals (not shown in the drawing) is also connected to the wiring 53 in the Y direction so that a scanning signal for selecting a column of electron-emitting elements 54 arrayed in the Y direction is applied. The drive voltage to be applied to the individual electron-emitting elements is supplied as a difference voltage between a scanning signal and a modulating signal to beapplied to the element.

In the structure described above, the individual elements can be selected and driven independently using simple matrix wiring. The electron-source substrate 51 is generally referred to as a rear plate, and when the electron-source substrate 51 lacks strength, a reinforcing sheet 211 may be added thereto. In such a case, a rear plate comprises the electron-source substrate 51 and the reinforcing sheet 211.

In this embodiment, a non-evaporable getter 56 is disposed on the wiring 53 in the Y direction. The getter metal powder composed of Zr or Zr as a major constituent is mixed using an adhesive which cures by bond between silicon atoms and oxygen atoms, and the mixture is applied in a strip on the wiring in the Y direction by means of a dispenser or the like.

The non-evaporable getter powder used preferably has an average particle diameter of several microns or more so that the surface is thoroughly cleaned by internal diffusion of oxides, carbonates, and nitrides on the metal surface during the getter activation.

Since the non-evaporable getter must be capable of adsorbing gases emitted when the electron source is driven, it is not acceptable if its adsorption power deteriorates by absorbing gases when the non-evaporable getter is activated at high temperatures before driving.

Therefore, the mixture with the adhesive must have small gas emission at high temperatures when the getter is activated. The formation process has also been investigated and it has been found that, in order to increase bond strength between non-evaporable getter powders or between the non-evaporable getter and wiring, satisfactory results can be obtained when a paste in which an adhesive and a non-evaporable getter is mixed is applied for adhesion rather than separately applying the adhesive and the non-evaporable getter for adhesion.

However, in such a case, the adhesive may easily cover the surface of the non-evaporable getter metal powder, and the non-evaporable getter may not be able to demonstrate its adsorption power. In view of the problems described above, in this embodiment of the present invention, a mixture is employed in which the getter is mixed with an adhesive (inorganic adhesive) containing silicon-oxygen bonds.

As the adhesive, for example, an adhesive in which a ladder silicone oligomer is dissolved in an organic solvent is used. The mixture ratio of the non-evaporable getter (powder) to the ladder silicone oligomer is preferably 10:1 to 20:1 so that sufficient bond strength is obtained with the lowest possible percentage of the ladder silicone oligomer. The mixture ratio may be appropriately determined depending on the surface state of the getter material to be adhered.

A faceplate 216 includes a glass substrate 213, a fluorescent film 214, and a metal back 215. The faceplate 216 and a rear plate 51 are bonded to upper and lower faces of a frame 212 using low-melting point frit glass or the like.

Bonding by frit glass is generally performed at temperatures from 400 to 500° C. Although bonding is often performed in an atmosphere where oxygen exists (in air) in order to remove binder components contained in the frit glass, it is not limited to this. For example, after binder components are preliminarily baked out at approximately 300° C. (preliminary firing), bonding may be performed in an atmosphere of an inert gas at 400 to 500° C. At this stage, the non-evaporable getters disposed on the electron-source substrate is subjected to the temperatures of 400 to 500° C. and is activated, developing the capability of adsorbing gases.

As described above, the envelope 217 includes the faceplate 216, the frame 212, and the rear plate 211. By disposing a support called a spacer (not shown in the drawing) between the faceplate 216 and the rear plate 211, a vacuum envelope 217 that has satisfactory strength to resist ambient pressure may be structured.

The faceplate 216 includes a fluorescent film 214 which is similar to that described in the first embodiment. In a monochrome display, the fluorescent film 214 may be composed of a phosphor only. In a color display, the fluorescent film 214 may be composed of a black conductive material 12 and a phosphor 13 as shown in the first embodiment. A black stripe or a black matrix is provided so that mixed colors are unnoted by blackening the boundaries between the individual phosphors of the three primary colors required in the color display and that a decrease in contrast due to reflection of external light in the fluorescent film is suppressed. As the material of the black stripe, although a material having graphite as a major constituent is generally used, a conductive material having low transmittance and reflectance may also be used.

A transparent electrode (metal back) 215 may be provided on the surface of the fluorescent film 214 to increase the conductivity of the fluorescent film 214. When the sealing described above is performed, in the color display, the phosphors of the individual colors and the electron-emitting elements must be matched, and thus thorough alignment is necessary.

Next, an example of a method for fabricating the image-forming apparatus shown in FIG. 18 will be described. First, electrodes and wiring pattern are formed on the glass substrate by combining various methods, such as printing and photolithography, and an electron-emitting material is arrayed to produce an electron-source substrate (rear plate) 51 provided with a plurality of electron-emitting elements. A non-evaporable getter 56 is formed in a strip on the matrix wiring in the electron-source substrate. The non-evaporable getter 56 is composed of metal powder of Zr or having Zr as a major constituent. The powder dissolved in an organic solvent is mixed with a liquid or gel inorganic adhesive such as a ladder silicone oligomer to make a paste, which is applied to the wiring using a dispenser or by printing.

In the inorganic adhesive, bonding is performed by polymerization between silicon atoms and oxygen atoms, and the polymerization rate increases as the temperature is increased. In order to evaporate the organic solvent, firing is preferably performed after application. At this stage the getter is also activated and absorbs gases generated from members during firing. Therefore, since the capability of the getter may be degraded, in this embodiment, firing is performed in a vacuum of $1\times10^{-6}$ Torr or less or in an inert gas, and the firing or the paste is fired at a predetermined range of temperatures.

The patterning of the non-evaporable getter powder and the adhesive is not limited to the dispenser or printing, and may be performed by masking with a metal mask or a photosensitive material followed by the application of the getter powder and the adhesive and by separating the masking.

The non-evaporable getter may be disposed on the wiring 52 in the X direction or on the periphery of the image display region in addition to the wiring in the Y direction, and in such a case, predetermined pattern may be written by a dispenser or by printing, or may be formed by providing a predetermined opening in masking and applying the non-evaporable getter.

On the other hand, the face plate 216 is fabricated by disposing image-forming members including phosphors on another glass substrate. The flat-box envelope 217 is formed with the rear plate 51, the frame 212, and the faceplate 216. These members are bonded with frit glass, and bonding is performed in a vacuum or in an inert gas at approximately 400 to 500° C.

Although the non-evaporable getter is formed on the wiring in the image display region in this embodiment, the method and steps described above may be employed when the non-evaporable getter is formed in the periphery of the image display region or on the faceplate.

The envelope 217 is then evacuated (vacuum-formation step), and required treatment is performed on the electron source including a plurality of electron-emitting elements so that electrons are emitted. When the electron-emitting elements are surface-conduction electron-emitting elements, for example, by performing treatment as disclosed in Japanese Patent Laid-Open No. 7-235255 (electron-source activation step), electrons are emitted from the electron-source by applying a required voltage. Next, by evacuation and degassing by heating (baking step), a satisfactory vacuum is secured in the envelope. By the degassing step by heating, the non-evaporable getter 56 disposed on the electron-source substrate is activated, thus demonstrating the gas-adsorbing function. A vacuum exhaust pipe (not shown in the drawing) is then sealed off by heating. After this, the getter may be activated again, and in such a case, the non-evaporable getter 56 is heat-treated at 250° C. or more.

The circuit configuration for displaying an image in response to NTSC television signals with respect to the display panel using such an electron source arrayed in a simple matrix has been described in the first embodiment (refer to FIG. 8), and thus the description thereof will be omitted.

In the image display device to which the present invention is applicable, electron emission occurs when a voltage is applied to the individual electron-emitting elements through external terminals Dox1 to Doxm, and Doy1 to Doyn. When the electron beam is accelerated by applying a high voltage to the metal back 215 (or a transparent electrode) through a high-tension terminal Hv, the accelerated electrons collide with the fluorescent film 214, and light is emitted for forming an image.

With respect to the structure of the image-forming apparatus provided with non-evaporable getters and the method for forming the non-evaporable getters described in this embodiment, various modifications on design may be made depending on other various image-forming apparatuses to which the present invention is applicable. Although the surface-conduction electron-emitting element is described as an example of the electron-emitting element constituting the electron source, the invention is not limited to this. Image-forming apparatuses in which many electron elements, such as field emission-type electron-emitting elements or metal/insulating layer/metal type (MIM type) elements, are arrayed may also be acceptable. Although the simple matrix is described as a method for arraying electron-emitting elements, the invention is not limited to this. Ladder arrangement or the like may also be acceptable. Input signals are not limited to the NTSC signals described above, and PAL, SECAM, and other television signals comprising more scanning lines (for example, a high-definition television system such as MUSE) may be employed. The image-forming apparatuses in accordance with the present invention may be used as image-forming apparatuses for photo printers which include photosensitive drums, in addition to display devices for television broadcasting, and as display devices for video conference systems and computers.

The second embodiment of the present invention described above will be described in detail with reference to the following examples. It is to be understood that the invention is not limited to the examples and the invention is intended to cover various modifications and changes in design within the scope of the invention.

EXAMPLE 1

Figure 20:
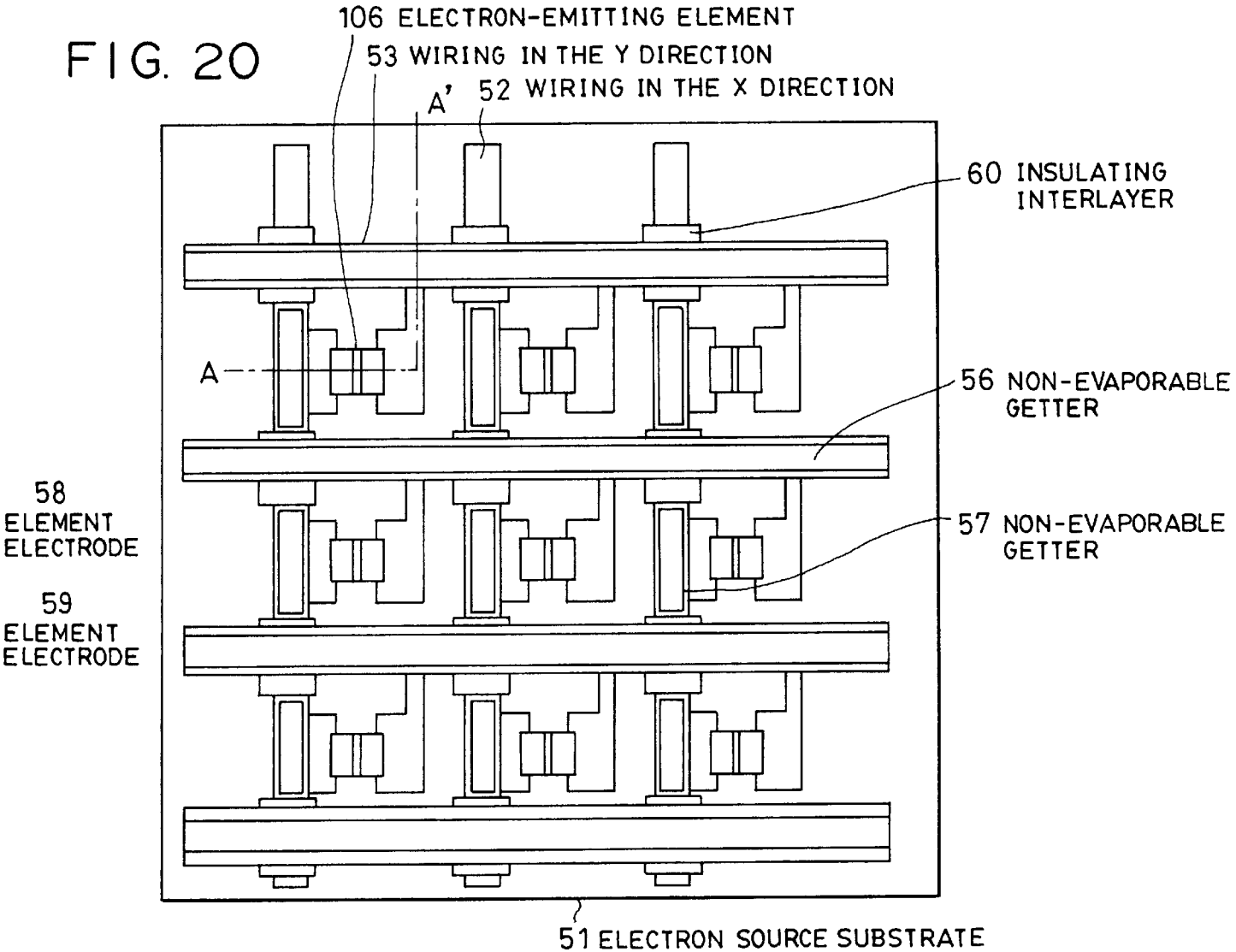
FIG. 20 is a plan view of the electron source in the second embodiment.
Figure 21:
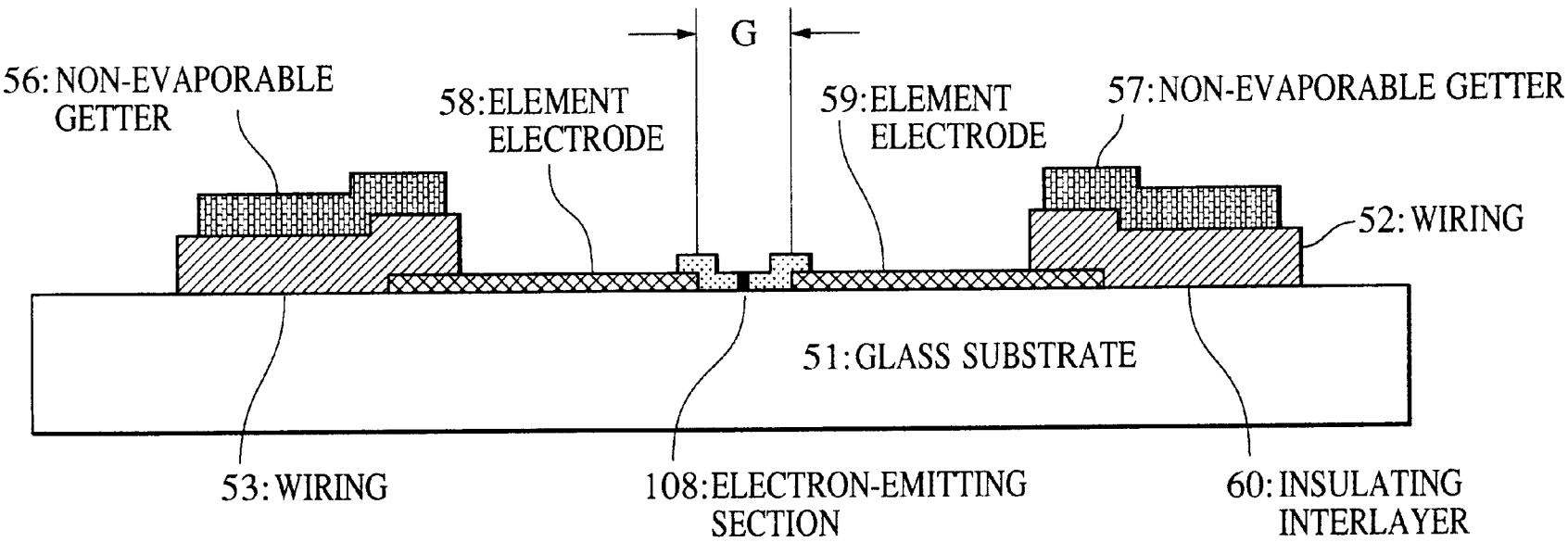
FIG. 21 is a sectional view taken along the line A–A' in FIG. 20.
Figure 22:
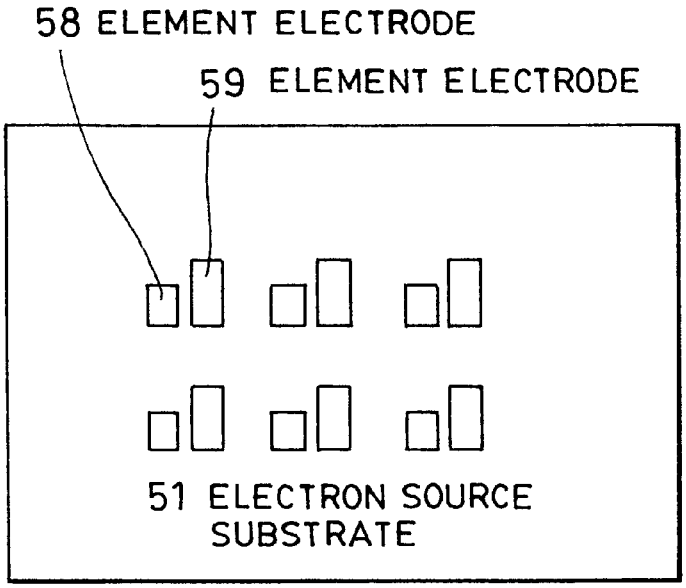
FIG. 22 illustrates a step of fabricating an electron source in the second embodiment.

An image-forming apparatus in this example has the same structure as that of the apparatus schematically shown in FIG. 18. Non-evaporable getters 56 are arrayed on the wiring 53 in the Y direction (upper wiring) formed by printing. The image-forming apparatus in this example is provided with an electron source in which a plurality (100 rows×300 columns) of surface-conduction electron-emitting elements are wired in a simple matrix on a substrate. FIG. 20 is a plan view showing a portion of the electron source in this example. FIG. 21 is a sectional view taken along the line A–A' in FIG. 20. In FIGS. 20 and 21, the same components are marked with the same symbols. Numeral 51 represents an electron-source substrate, numeral 52 represents wiring in the X direction (lower wiring or signal-wiring) corresponding to Doxm in FIG. 18, numeral 53 represents wiring in the Y direction (upper wiring or scanning-wiring) corresponding to Doyn in FIG. 18, numeral 108 represents a conductive film including an electron-emitting section of a surface-conduction electron-emitting element, numerals 58 and 59 represent element electrodes, numeral 60 represents an insulating interlayer, and numeral 57 represents a non-evaporable getter on the wiring 52 in the X direction.

A method for fabricating the image-forming apparatus in this example will be described with reference to FIGS. 22 through 27 and FIGS. 28A and 28B. FIGS. 22 through 27 illustrate steps of fabricating the electron source substrate, and FIGS. 28A and 28B are schematic diagrams which show a process for forming the non-evaporable getter 56 on the upper wiring 53 using a paste containing non-evaporable getter powder and an adhesive.

Figure 29:
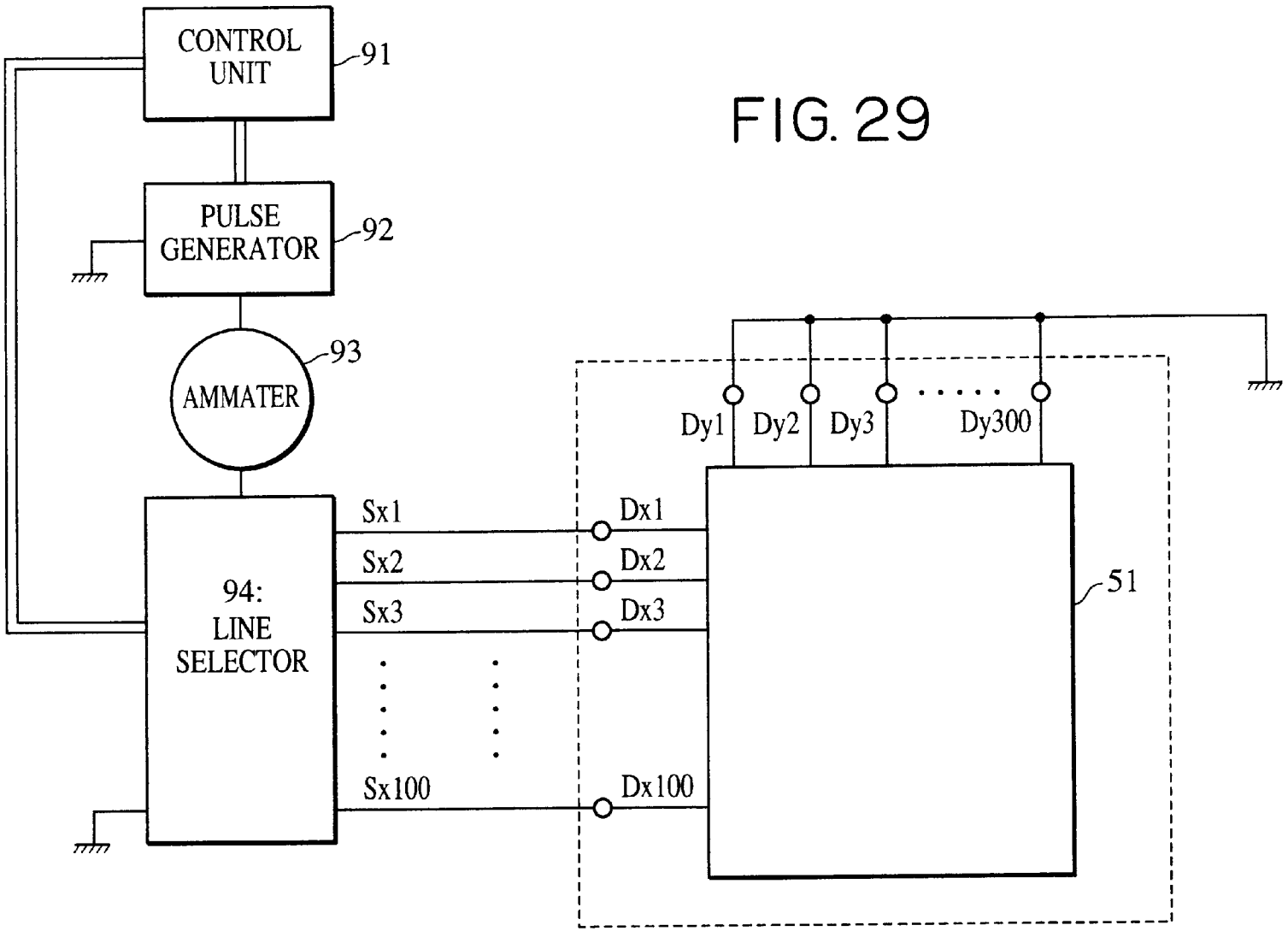
FIG. 29 is a schematic diagram which shows a circuit configuration used for forming treatment and activating treatment in the fabrication process for an image display apparatus.
Figure 30A:
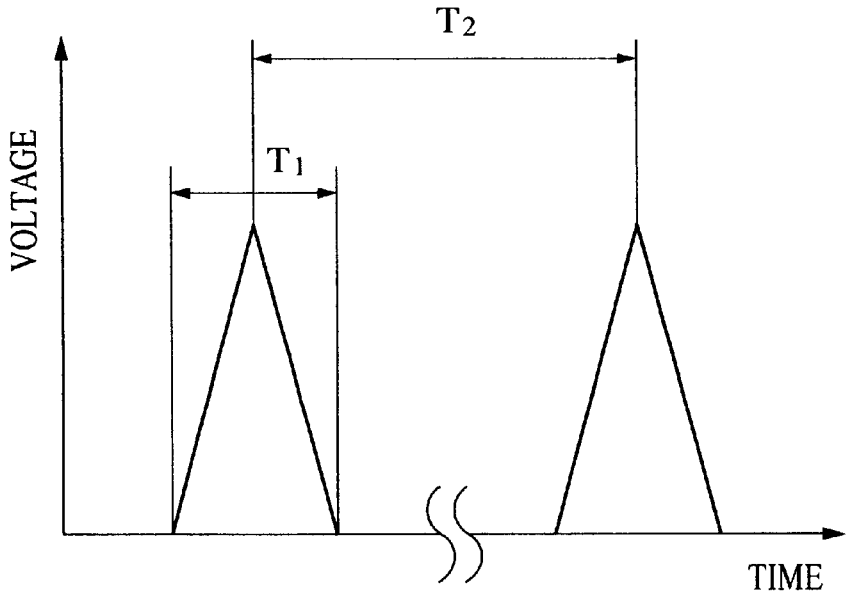
FIGS. 30A and 30B are schematic diagrams which show voltage waveforms used for forming treatment and activating treatment.
Figure 30B:
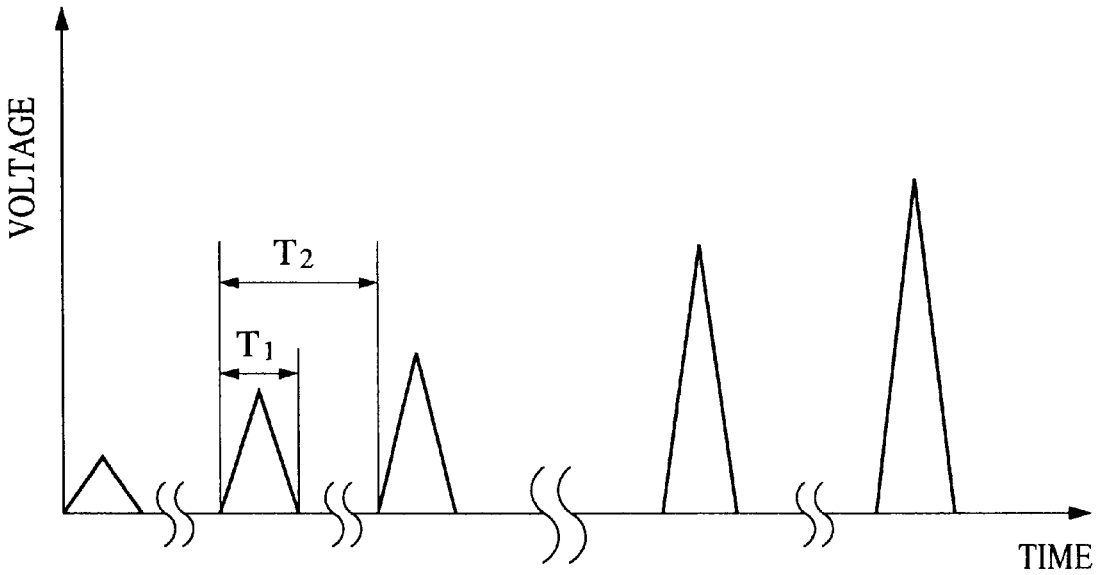

FIG. 29 is a schematic diagram which shows a circuit configuration used for forming treatment and activating treatment in the fabrication process for an image display apparatus. FIGS. 30A and 30B are schematic diagrams which show voltage waveforms used for forming treatment and activating treatment.

(Step a) A substrate was cleaned thoroughly using a detergent, pure water, and an organic solvent. A silicon oxide film was formed thereon by sputtering to a thickness of 0.5 $\mu$m to produce an electron-source substrate 51.

A pattern for element electrodes 58 and 59 and a gap G between the element electrodes was formed on the electron-source substrate 51 using a photoresist (RD-2000N-41 manufactured by Hitachi Chemical Co., Ltd.). Ti and Ni were deposited by vacuum evaporation to thicknesses of 5 nm and 100 nm, respectively. The photoresist pattern was melted with an organic solvent, the Ni/Ti deposition was removed by lift-off to form the element electrodes 58 and 59 with the gap G between the element electrodes at 3 $\mu$m and the width of the elements electrodes at 300 $\mu$m (refer to FIG. 22).

Figure 23:
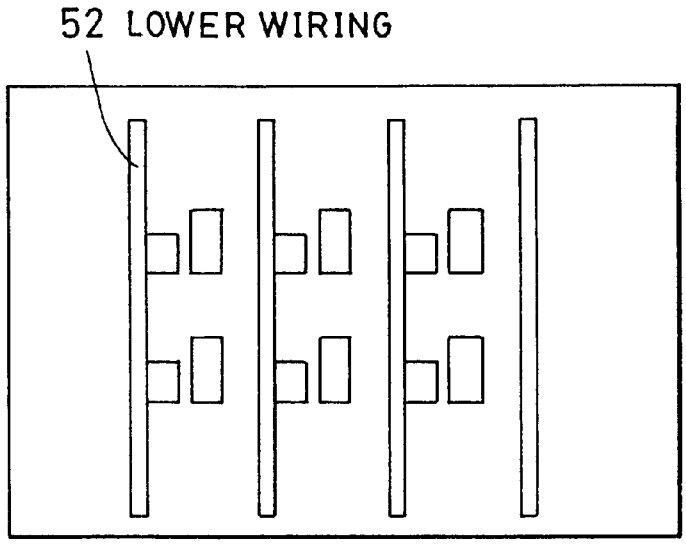
FIG. 23 illustrates a step of fabricating the electron source in the second embodiment.
Figure 24:
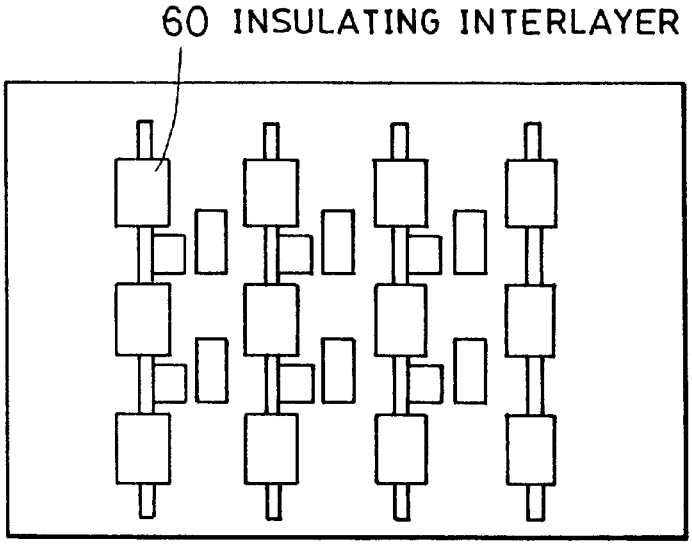
FIG. 24 illustrates a step of fabricating the electron source in the second embodiment.
Figure 25:
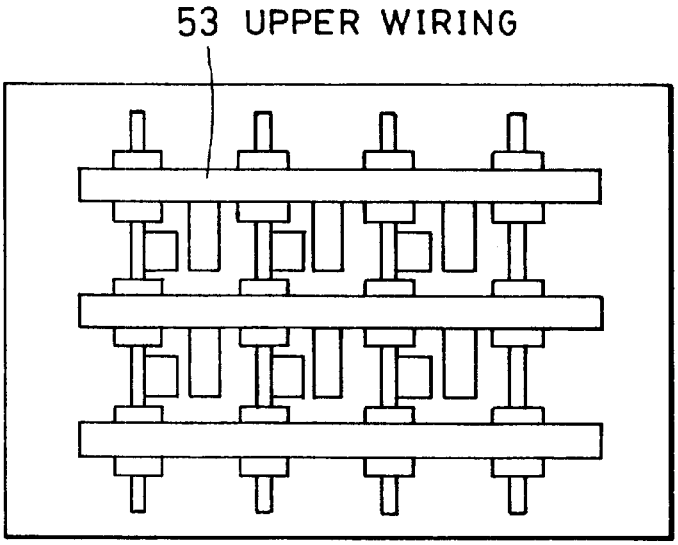
FIG. 25 illustrates a step of fabricating the electron source in the second embodiment.

(Step b) Next, lower wiring 52 was formed by screen printing so as to be in contact with one side of the element electrode 58, and firing was performed at 400° C. to produce a predetermined shape (refer to FIG. 23).

(Step c) A predetermined insulating interlayer 60 was formed by screen printing at a section in which upper and lower wirings intersect, followed by firing at 400° C. (refer to FIG. 24).

(Step d) Upper wiring 53 was formed by screen printing so as to be in contact with the electron electrode 59 that was not in contact with the lower wiring 52, followed by firing at 400° C. (refer to FIG. 25).

(Step e) A Cr film with a thickness of 100 nm was deposited and patterned by vacuum evaporation, and a Pd-amine complex solution (trade name: ccp4230 manufactured by Okuno Chemical Industries Co., Ltd.) was spin-coated thereon by a spinner. Firing treatment was performed at 300° C. for 10 minutes. A conductive film 108 for forming the electron-emitting section, formed as described above and composed of particulate Pd as a major element, had a thickness of 8.5 nm, and a sheet resistance of $3.9\times10^4$ Ω/square.

The particulate film is a film in which a plurality of fine particles are aggregated, and the particulate structure indicates a state where fine particles are dispersed, a state where fine particles lie adjacent to each other, or a state where fine particles overlap (including an island state), and the particle diameter refers to the diameter of fine particles whose particle shapes are recognizable.

Figure 26:
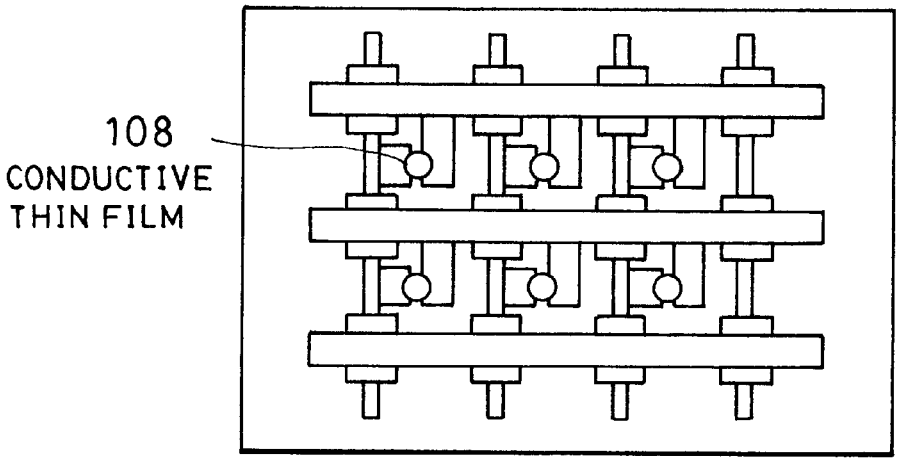
FIG. 26 illustrates a step of fabricating the electron source in the second embodiment.

Next, The Cr film and the fired conductive film 108 for forming the electron-emitting section were etched by an acid etchant to form a predetermined pattern (refer to FIG. 26). Thus, a plurality (100 rows×300 columns) of conductive films 108 for forming the electron-emitting section were connected to a simple matrix comprising the lower wiring 52 and the upper wiring 53.

(Step f) To the upper wiring pattern fabricated in step d, a paste 80 containing non-evaporable getter powder and an adhesive was applied using a dispenser 61 (refer to FIG. 28A). As the non-evaporable getter, a non-evaporable getter (HS405 powder manufactured by Japan Getters Co., Ltd.) having an average particle diameter of 20 μm, sieved with a 50 μm mesh, was used, and as the adhesive, a ladder silicone oligomer (GR650 manufactured by 01-NEG TV Products, Inc., U.S.) dissolved in an organic solvent, cyclohexanol, was used. The weight ratio thereof was as follows. Non-evaporable getter:GR650:cyclohexanol=10:1:10.

Figure 27:
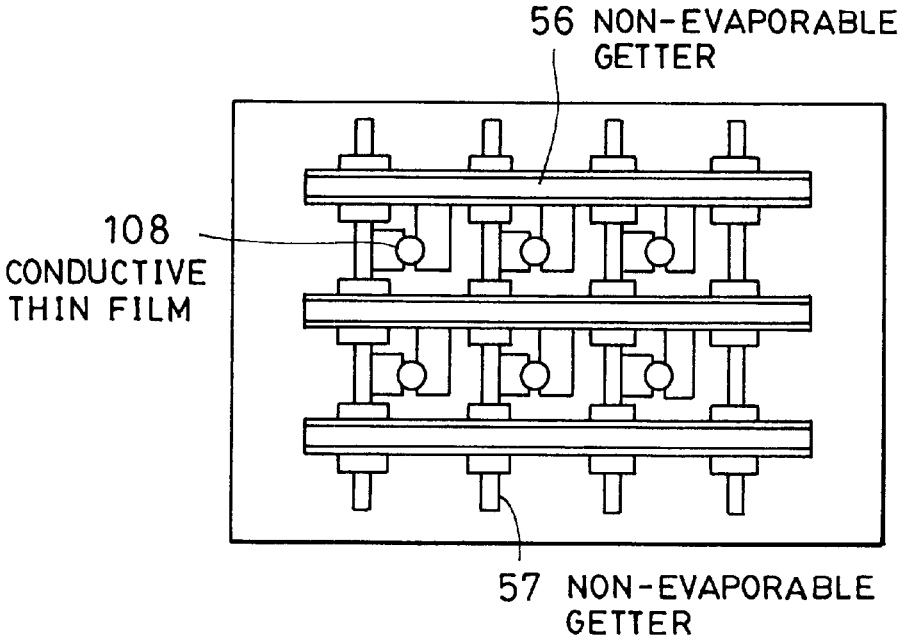
FIG. 27 illustrates a step of fabricating the electron source in the second embodiment.
Figure 28A:
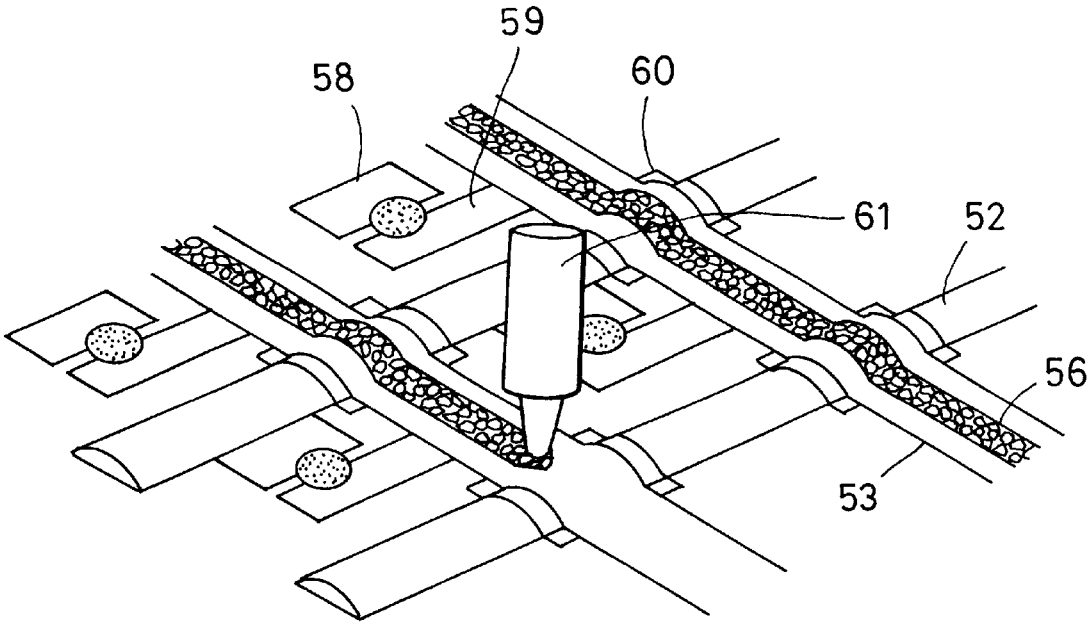
FIGS. 28A and 28B are schematic diagrams which show a process for applying a paste containing a non-evaporable getter and an adhesive, using a dispenser.
Figure 28B:
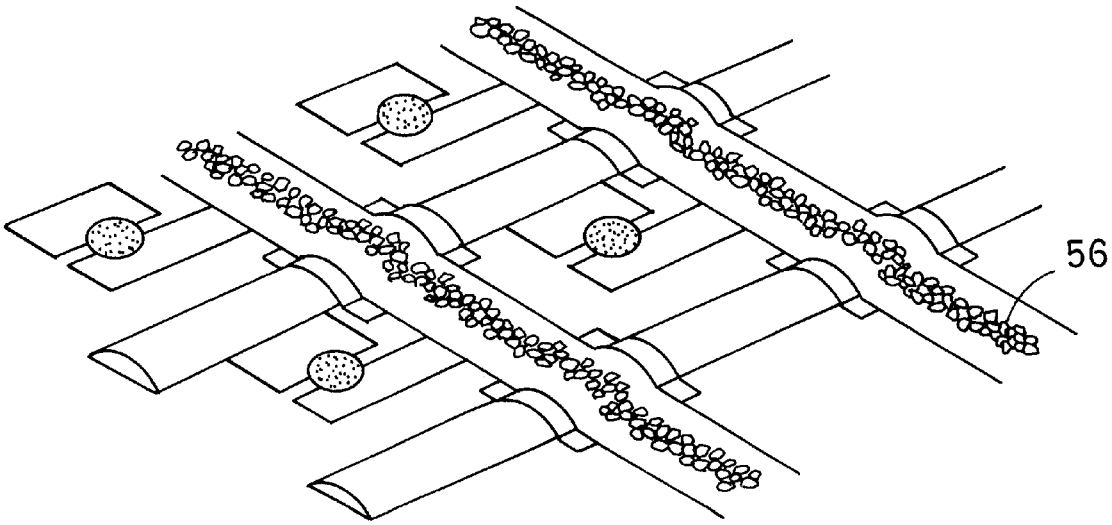

Firing was performed at 280° C. in an atmosphere of $1\times10^{-6}$ Torr or less to evaporate cyclohexanol and to accelerate the bonding reaction between the silicon atoms and oxygen atoms in the adhesive, and thus the non-evaporable getter 56 was bonded to the upper wiring 53 (refer to FIGS. 18, 27, and 28B). The silicone adhesive did not greatly emit gases and the performance of the non-evaporable getter 56 was not greatly degraded.

In the paste having the ratio described above, satisfactory adhesion between the non-evaporable getter 56 and the wiring 53 was obtained, no detachment was observed, and silicon did not cover the metal surface of the non-evaporable getter 56. The paste containing the non-evaporable getter and the adhesive may be applied by printing such as screen printing or offset printing, instead of using a dispenser. Alternatively, a metal mask having opening corresponding the wiring section may be brought into close contact with the electron-source substrate and the paste may be applied thereon. Although the organic solvent for dissolving ladder silicone oligomer is not limited to cyclohexanol, in view of easy patterning, a high-viscosity solvent which evaporates at a lower temperature than that of activation of the non-evaporable getter is preferably used.

In this example, as shown in FIGS. 20, 21, and 27, a non-evaporable getter 57 in the form of a paste was also formed on the lower wiring 52.

(Step g) A faceplate 216 shown in FIG. 18 was fabricated in a similar manner to that in the first embodiment. That is, a fluorescent film 214 was formed on the surface of a glass substrate 213 by printing. The fluorescent film 214 was made in a stripe, as shown in FIG. 6A, in which stripe phosphors (R, G, and B) 13 and black conductive materials (black stripes) 12 were alternately arrayed. On the fluorescent film 214, a metal back 215 of an Al thin film was formed by sputtering to a thickness of 50 nm.

(Step h) An envelope 17 shown in FIG. 18 was fabricated as described below. The electron-source substrate 51 was combined with the frame 212 and the faceplate 216. The lower wiring 52 and the upper wiring 53 of the electron-source were connected to row selection terminals 10 and signal input terminals 11, respectively, and the positions of the electron-source substrate 51 and the faceplate 16 were precisely adjusted, followed by sealing through frit glass, to form the envelope 17. The method of sealing included the steps of applying frit glass upper and lower faces of the frame 212, preliminarily firing in air at 300° C., and performing heat treatment in Ar gas at 400° C. for 10 minutes.

The vacuum apparatus used in the subsequent steps had the same structure as that shown in FIG. 13, and was used in the same manner. Therefore, the description thereof will be omitted.

(Step i) The envelope 17 was evacuated so that the pressure was reduced to $1\times10^{-3}$ Pa or less, and the following forming treatment was performed to form the electron-emitting section on the plurality of conductive films arrayed on the electron-source substrate 51.

That is, as shown in FIG. 29, the wiring in the Y direction was commonly connected and grounded. A control unit 91 controls a pulse generator 92 and a line selector 94. Numeral 93 represents an ammeter. One line was selected from the wiring in the X direction by the line selector 94, and a voltage pulse was applied thereto.

The forming treatment was performed by rows (300 elements per row). The applied pulse had a triangular wave as shown in FIG. 30A, and the peak value was gradually increased. Pulse width T1 was set at 1 msec and pulse period T2 was set at 10 msec. The resistance in each row was measured by inserting a rectangular pulse having a peak value of 0.1 V between the triangular pulses and by measuring the current. When the resistance exceeded 3.3 kΩ (1 MΩ per element), forming for the row was completed, and forming treatment for the next row was started. Forming treatment was performed for all rows to complete the forming for all the conductive films. Thus, an electron-emitting section was formed on each conductive film, and a plurality of surface-conduction electron-emitting elements were wired in a simple matrix in the electron-source substrate 51.

(Step j) Benzonitrile $C_6H_5CN$ was introduced into the vacuum container 123 (refer to FIG. 12) and the pressure was adjusted so that the partial pressure reached $1.3\times10^{-3}$ Pa. Activation treatment was performed by applying a pulse to the electron-source while an element current $I_f$ was measured. The pulse waveform generated by the pulse generator 92 was rectangular, as shown in FIG. 30B. The peak value was 14 V, pulse width T1 was 100 μsec, and the pulse period T2 was 167 μsec.

The selected line was shifted from Dx1 to Dx100 in sequence every 167 μsec by the line selector 94, and thus a rectangular wave having a T1 of 100 μsec and a T2 of 167 μsec was applied to each element row with a slightly shiftedphase.

The ammeter 93 was used in a mode in which an average current was detected when the rectangular pulse was ON (at a voltage of 14 V). When the current value was 600 mA (2 mA per element), the activation treatment was finished and the vacuum container 123 was evacuated.

(Step k) While evacuation treatment was performed, the entire image-forming apparatus (including the vacuum envelope 217) was kept at 300° C. for 24 hours by a heating unit (not shown in the drawing). By this treatment, benzonitrile and decomposed substances from benzonitrile, which were supposed to have been adsorbed by the inner walls of the envelope 217 and the vacuum container 123 and the like, were removed. This was confirmed by the observation using the Q-mass 127. Simultaneously, partial pressures of major inorganic gases in the envelope 217 were decreased in comparison with those before step k. Heating treatment in this step k also functions as getter-activation treatment, and thus the non-evaporable getter 56 provided on the upper wiring 53 in the electron-source substrate 51 adsorbed gases in the envelope 217.

(Step l) Next, a step for displaying an image in the image-forming apparatus according to example 1 was performed. The electron source was driven in line sequence, and 60 Hz electron emission was caused in elements of each row. First, 4 kV of Va was applied to the high-tension terminal Hv connected to the metal back 15. The Va was then raised to 6 kV to cause gas emission from phosphors. In the apparatus in this example, use at Va=5 kV was assumed, and since irradiation was preliminarily made at a higher voltage, gas emission in actual use was reduced.

(Step m) After confirming that the pressure was $1.3\times10^{-5}$ Pa or less, the exhaust pipe was sealed off by heating with a burner. Thus, an image-forming apparatus in this example was produced.

COMPARATIVE EXAMPLE 1

This comparative example is described in order to compare an image-forming apparatus provided with a non-evaporable getter with an image-forming apparatus not provided with a getter. In comparative example 1, steps a through e were performed in a similar manner to those in example 1 of the second embodiment, and step g and subsequent steps were performed to fabricate an image-forming apparatus without a non-evaporable getter.

The partial pressures in the envelope of the image-forming apparatus without a non-evaporable getter as described above were measured with the Q-MASS 127, and the values were compared with those of the image-forming apparatus provided with the non-evaporable getter in example 1. As a result, with respect to the image-forming apparatus provided with the deposition-type non-evaporable getters, the partial pressures of major inorganic gases (mass nos. 2, 18, 28, 32, and 44) were lower by one-digit or more in comparison with the image-forming apparatus without a getter.

After confirming that the pressure was $1.3\times10^{-5}$ Pa or less, the exhaust pipe was sealed off by heating with a burner. Thus, an image-forming apparatus in comparative example 1 was produced.

(Evaluation)

The image-forming apparatuses in example 1 and comparative example 1 were compared. Changes in brightness over time were observed when the entire surfaces of the image-forming apparatuses were continuously lighted by simple matrix driving. Brightness in the beginning was different in each image-forming apparatus. However, when continuous lighting was maintained for a long time, a decrease in brightness was clearly observed in the image-forming apparatus in comparative example 1. In the image-forming apparatus in example 1, the extent of a decrease in brightness was lower than that in comparative example 1, and long-time operation was enabled. Thus, it was confirmed that by forming a non-evaporable getter in an envelope using an adhesive, the degree of vacuum in the envelope was maintained low, and thus a decrease in brightness was suppressed.

EXAMPLE 2

Figure 31A:
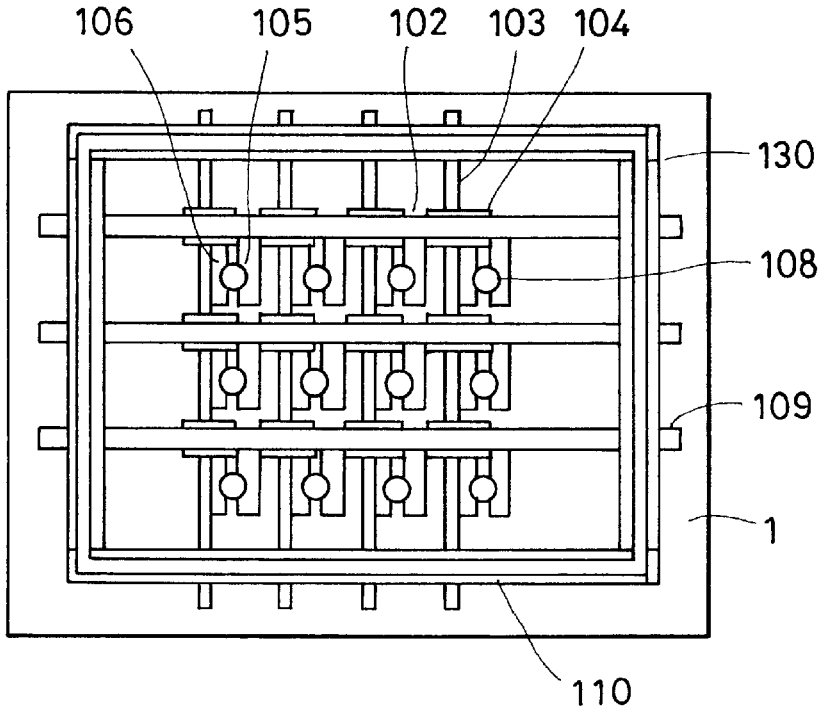
FIGS. 31A and 31B are arrangement plans of non-evaporable getters in variation examples in the second embodiment.

In this example, a non-evaporable getter was disposed in the periphery of the image display region, the arrangement plan is shown in FIG. 31A. Shown in the figure are element electrodes 105 and 106, insulating interlayer 104 and wirings 103 and 109, all within frame 110. In example 2, steps a through e were performed in a similar manner to those in example 1 of the second embodiment.

(Step f') An insulating layer 130 was printed on the peripheral wiring by screen printing as shown in FIG. 31A, and firing was performed at 400° C. A paste composed of a non-evaporable getter and an adhesive, the same as that in step f of example 1, was applied on the insulating layer 130 by a dispenser. Firing was performed at 280° C. in an atmosphere of $1\times10^{-6}$ Torr or less to bond the non-evaporable getter on the insulating layer 130.

Step g and subsequent steps were performed in a similar manner to those in example 1, and an image-forming apparatus was produced.

(Evaluation)

With respect to the image-forming apparatus produced as described above, the same brightness evaluation was made as that in example 1. A decrease in brightness was lower than that in comparative example 1, the degree of vacuum was maintained low, and thus a decrease in brightness was suppressed.

EXAMPLE 3

Figure 31B:
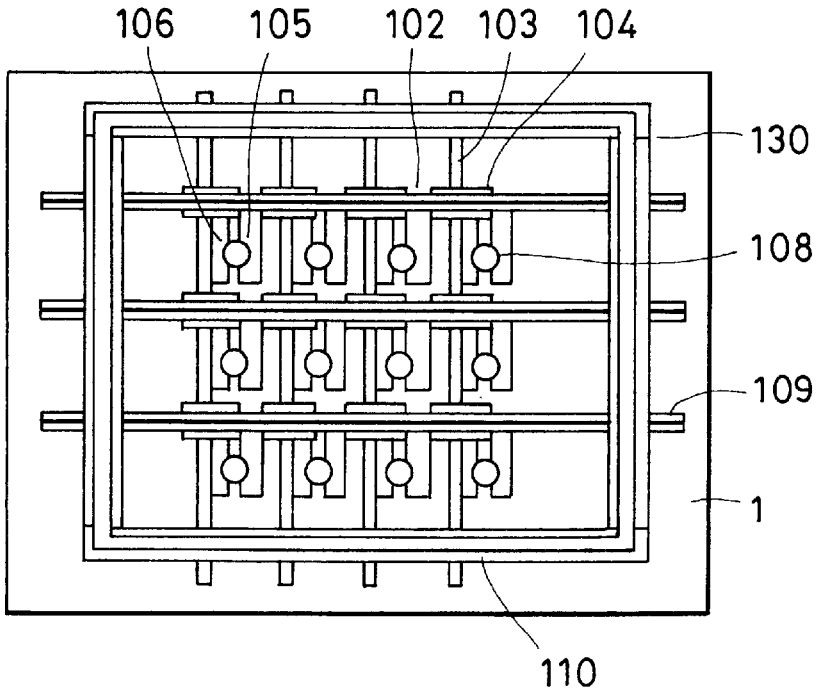

In this example, non-evaporable getters were disposed both in the periphery of the image display region and in the image display region, and the arrangement plan thereof is shown in FIG. 31B. This example is applicable to a large image display region. In this example, steps a through e were performed in a similar manner to those in example 1.

(Step f") An insulating layer 130 was printed on the peripheral wiring by screen printing in a similar manner to that in step f' of example 2, as shown in FIG. 31A, firing was performed at 400° C., and a non-evaporable getter was formed on the insulating layer 130. The same paste containing a non-evaporable getter and an adhesive as that in step f of example 1 was applied on the upper wiring, the lower wiring and the insulating layer 130, and firing was performed at 280° C. in an atmosphere of $1\times10^{-6}$ Torr or less to bond the non-evaporable getter on the insulating layer 130 (refer to FIG. 31B).

Step g and subsequent steps were performed in a similar manner to those in example 1, and an image display device was produced.

(Evaluation)

With respect to the image display device of example 3 produced as described above, the same brightness evaluation was made as those in examples 1 and 2. A decrease in brightness was significantly lower than those in comparative example 1 and examples 1 and 2, and a longer operation was enabled.

As described above, in examples 1 to 3 of the second embodiment, since a non-evaporable getter is disposed, a vacuum in the envelope can be maintained for a long time, and the effect of generated gases is decreased, thus preventing a decrease in brightness. By using an adhesive, the non-evaporable getter can be formed in an envelope without using vacuum evaporation or photolithography, and as described in examples 1 to 3, even if the position and area where the non-evaporable getter is disposed are changed, satisfactory performance of the getter can be obtained with respect to a decrease in brightness after a long-time operation. The position where the non-evaporable getter is placed may be selected depending on the size of the image display device.

Third Embodiment

Figure 32A:
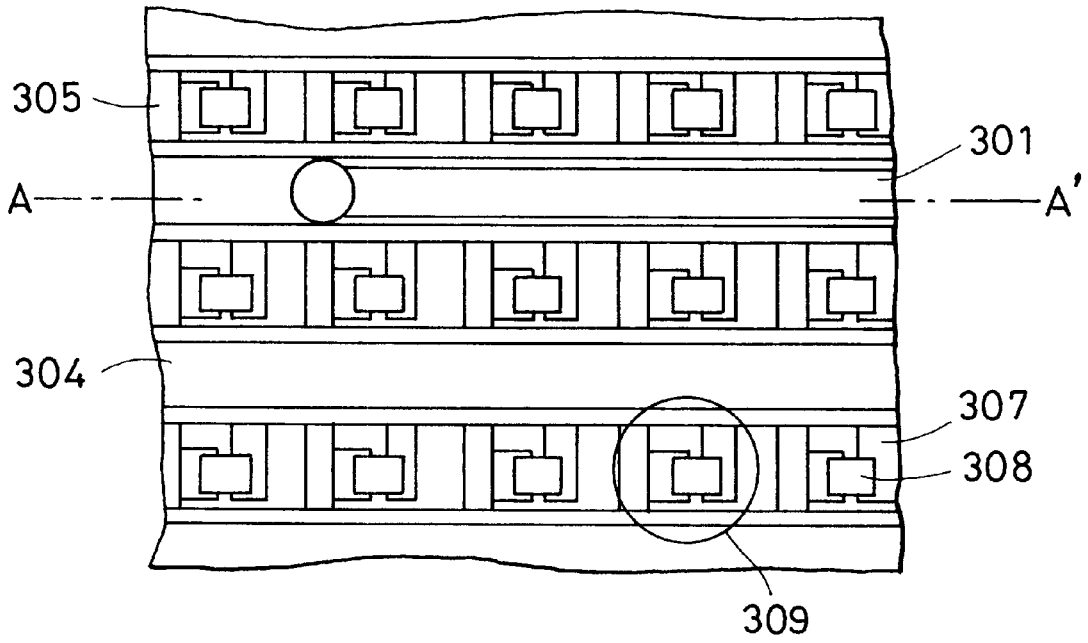
FIGS. 32A and 32B are a schematic plan view and a schematic sectional view, respectively, of the fixed portion of a non-evaporable getter in an electron beam display in accordance with a third embodiment.
Figure 32B:
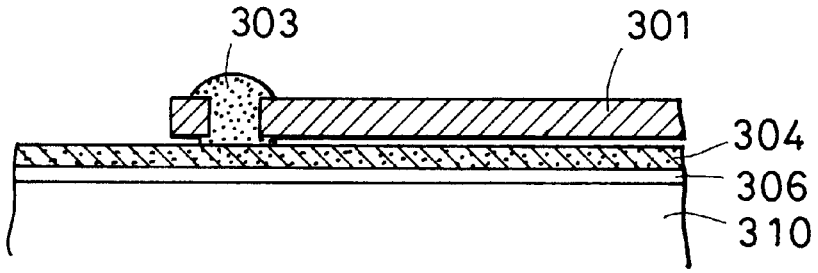

The third embodiment of the present invention will be described in detail with reference to FIGS. 32 and 33. A plurality of electron-emitting elements are provided on the surface of an insulating substrate (electron-source substrate) 310. In order to drive the electron-emitting elements, wiring (wiring in the X direction) 304 is formed on the surface of the insulating substrate adjacent to the electron-emitting elements. A ribbon non-evaporable getter 301 is fixed on the wiring 304.

Figure 33A:
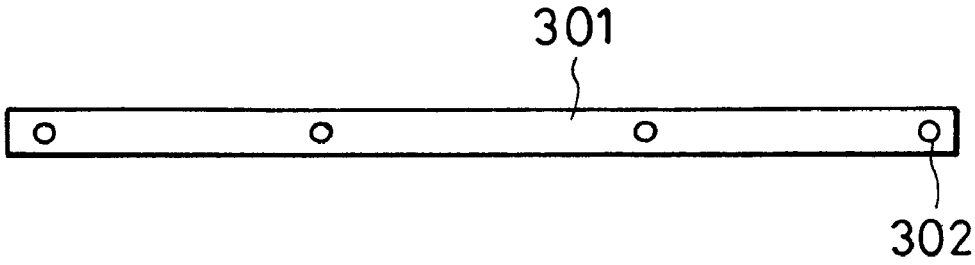
FIGS. 33A and 33B are schematic diagrams which show outer shapes of non-evaporable getters.
Figure 33B:
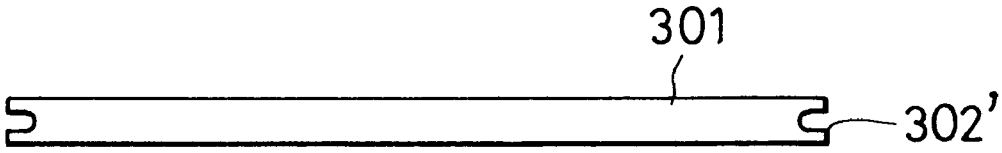
Figure 34:
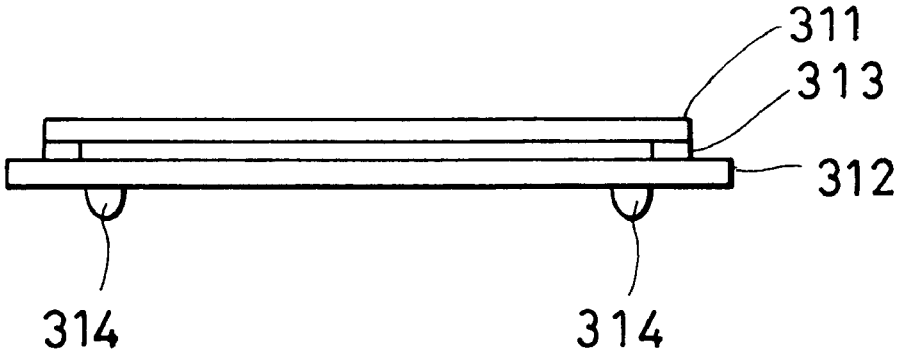
FIG. 34 is a schematic diagram of an electron beam display.

In such a case, the non-evaporable getter 301 is provided with a hole 302 as shown in FIG. 33A or a cut-out section 302' as shown in FIG. 33B. A conductive adhesive is inserted into the hole 302 or the cut-out section 302' to fix the getter 301 to the wiring 304.

Numeral 305 represents modulating-signal wiring (wiring in the Y direction), numeral 306 represents an insulating layer, and numeral 307 represents an element electrode. Numeral 308 represents an electron-emitting section of the electron-emitting element 309. In this embodiment, the electron-emitting element 309 is a field emission-type electron-emitting element which emits electrons from its needle or pyramidal tip or a cold-cathode electron-emitting element such as a surface-conduction electron-emitting element. The non-evaporable getter 301 includes powder of an alloy of metals, such as Zr, Nb, and Ti, having high gas-adsorbability attached to a metal base. In the cases of a Zr—Al—Ti alloy and a V—Fe—Zr—Ti alloy (for example, manufactured by Saes Getters Co., Ltd.), activation is enabled without the degradation of getters after the frit step for forming a vacuum container, and gas-adsorbability is maintained after the sealing step.

The shape of the hole 302 or the cut-out section 302' is not limited to a circle as shown in FIGS. 33A and 33B, and other shapes such as an ellipse may be acceptable. Preferably, the hole 302 or the cut-out section 302' is preliminarily made in the base of the getter 301. Although boring may be performed after the getter 301 is formed, since the metal of the getter 301 is active, the adsorbability of the getter material in the periphery of the hole may be decreased by boring. Thus, the former method is preferred.

The hole 302 or the cut-out section 302' prevents the conductive adhesive from protruding, and also effectively functions as a window for melting or curing the conductive adhesive 303. If the hole 302 or the cut-out section 302' is not provided, a portion of the adhesive may be protruded from the getter 301, resulting in short-circuiting of the electron-emitting element, or the like.

As the base of the non-evaporable getter 301, generally, a resistive material, such as an Ni—Cr alloy, is used so that the non-evaporable getter 301 is activated (gas-adsorption power is imparted to the non-evaporable getter 301) by heating due to a current applied to the base. In the present invention, since heating by passing an electric current is not employed for activating the non-evaporable getter 301, the base material is not necessarily composed of the alloy. That is, in the present invention, a metal or a conductive compound having a coefficient of thermal expansion close to that of a display envelope (corresponding to substrates 311 and 312 and a frame 313) is preferably used. For example, when the envelope is composed of soda glass, Ti or Nb, an alloy thereof, or an Ni—Fe alloy having 60 to 70 wt. % of Ni is preferably used, and when the envelope is composed of borosilicate glass, a 40 to 50% Ni—Fe alloy is preferably used.

When the wiring 304 and the non-evaporable getter 301 are not electrically connected to each other, the electrical potential of the getter 301 is unstable, resulting in a discharge between the wiring 304 and the getter 301 or the accelerating electrode formed on the substrate (faceplate). Therefore, in the present invention, the conductive adhesive 303 is used for fixing the getter 301 so that the non-evaporable getter 301 and the wiring 304 have the same electrical potential.

As the conductive adhesive 303, a resin adhesive containing a conductive filler, glass frit, a solder, or the like may be used. The conductive adhesive 303 must resist heating in the vacuum-container formation step. Since glass frit is generally used for sealing an electron beam display, conductive glass frit or a high-melting point solder ispreferably used.

As the solder, a material which forms a solid solution with wiring is preferably used. For example, an Ag—Sn solder having 10 wt. % of Ag or less is an eutectic alloy, and has a melting point 300° C. or less, thus enabling low-temperaturebonding. The wiring 304 is generally formed by printing Ag. Approximately 90% of the fired wiring is composed of Ag. In the case of the wiring having Ag as a major constituent, since the Ag—Sn solder and the wiring 304 form a solid solution to produce an eutectic alloy, even if the temperature is increased when the container is sealed with frit, the solder does not flow. Thus, the bond with the wiring 304 can be maintained and protrusion does not occur. A solder composed of an Sn—Ag alloy containing Bi, Cu, In, and Sb as additional elements may be used in a similar manner.

The conductive adhesive 303 is applied as a dot to the position corresponding to the hole 302 or the cut-out section 302' of the non-evaporable getter 301 on the wiring 304. Additionally, the conductive adhesive 303 may be applied by printing using a mask pattern corresponding to the hole or the cut-out of the non-evaporable getter. The conductive adhesive 303 preliminarily applied on the wiring 304 as described above is melted by heating after the non-evaporable getter 301 is aligned on the wiring 304. Although the entire substrate may be heated to a melting temperature of the adhesive or higher, it is advantageous to heat only the conductive adhesive by a laser because damage to the non-evaporable getter 301 is avoided and energy consumed in the bonding step is greatly decreased.

The third embodiment of the present invention will be described in detail with reference to the following examples.

EXAMPLE 1

(Fabrication of Rear Plate)

The electron source of an electron beam display in the example included 240×960 pieces of surface-conduction electron-emitting elements formed on a glass substrate. The structure as shown in FIG. 32A was employed. An element electrode 307 was composed of a Pt thin film evaporated by sputtering, and scanning-signal wiring (wiring in the X direction) 304 and modulating-signal wiring (wiring in the Y direction) 305 were formed by screen printing Ag paste. The element electrode 307 included a pair of electrodes with a space of 20 microns therebetween. One of the electrodes was connected to the scanning-signal wiring 304 through a via-hole (not shown in the drawing) of an insulating layer 306, and the other was connected to the modulating-signal wiring 305. An organic Pd complex was applied by ink-jet between the element electrodes 304. followed by firing, to form an ultrafine-particle film of palladium and palladium oxide to make an electron-emitting section 308. Forming treatment and formation of a carbon film were performed as described below for electron emission.

Next, a solder paste 303 composed of 4%Ag—Sn was applied by a dispenser to the position on the scanning-signal wiring 304 corresponding to a hole 301 provided on a non-evaporable getter 301. The non-evaporable getter 301 was aligned, and the solder paste 303 was irradiated with a YAG laser to melt the solder, and thus the non-evaporable getter 301 was fixed. The non-evaporable getter 301 had a width of 0.3 mm and a length of 10 mm, in which getter fine particle film of a V—Fe—Zr—Ti alloy was formed to a thickness of approximately 50 microns on a 65%Ni—Fe alloy having a thickness of 100 microns.

(Fabrication of Faceplate)

In a fluorescent film as an image-forming member, phosphors of the individual colors extended in the Y direction in a stripe. A black conductive material for dividing phosphors of each color was formed first, and the phosphors of each color were applied to the spaces therebetween. As the black conductive material (black stripe), a material having graphite as a major constituent, that is commonly used, was employed. A slurry method was used for applying the phosphors to the glass substrate. The inner surface of the fluorescent film was subjected to planarization treatment (generally referred to as "filming"), and an Al film as a metal back was formed thereon by vacuum evaporation.

(Fabrication of Electron Beam Display Panel)

A faceplate 311 was disposed 1 mm above the electron source with a frame 313 therebetween, and a rear plate 312, the faceplate 311, and the frame 313 were fixed and supported on supports 314. Frit glass was applied to the joints between the rear plate and the frame and between the frame and the faceplate, and firing was performed at 430° C. for 10 minutes or more. Thus, each joint was sealed.

The atmosphere in the resultant envelope was evacuated through an exhaust pipe (not shown in the drawing) by a vacuum pump. After a satisfactory degree of vacuum was obtained, a voltage was applied to the element electrode 307 of the electron-emitting element through the wirings 304 and 305 via external terminals (not shown in the drawing). Thus, forming treatment was performed for the electron-emitting section 308 composed of the ultrafine-particle film. The forming treatment was performed using a triangular pulse having a peak value of 10 V, a pulse width of 1 msec, and a repetitive frequency of 100 Hz.

Next, acetone was introduced to the vacuum container to reach 1 mTorr, and by periodically applying a pulse voltage to the external terminals, carbon or carbon compounds were deposited on the electron-emitting section 308. Thus, the electron source was activated by passing a current. The activation of the electron source by passing a current was performed by applying a 100 Hz square-wave voltage having a pulse width of 1 msec. The peak value was increased from 10 V to 15 V by 1 V per minute.

While the entire container was heated, evacuation was performed for 10 hours. The non-evaporable getter is normally activated at 500° C. or more, activation can be performed at 300° C. by maintaining a vacuum for a long time. While a vacuum of $10^{-6}$ Torr was maintained, the exhaust pipe was welded by heating with a gas burner to seal the envelope. Lastly, a Ba getter in a getter chamber was evaporated by high-frequency heating.

In the fabrication process described above, the non-evaporable getters were not detached. In the electron beam display, scanning signals and modulating signals were applied to the wirings 304 and 305 by a signal-generating unit (not shown in the drawing) to cause electron emission from the electron-emitting section 308. The emitted electrons were accelerated by the application of a high voltage to the metal back, collided with the fluorescent film to excite the phosphors for emission of light. Thus, an image was displayed. The high-tension voltage was set at 2 kV to 5 kV, and a voltage of 14 V was applied between the wirings 304 and 305. Under those driving conditions, an image was displayed for a long period of time, dispersion in brightness in the screen, that easily occurs due to a difference in degradation among electron-emitting elements, was not observed. The degradation of the electron source due to abnormal discharge was not observed.

EXAMPLE 2

In this example, instead of the non-evaporable getter in example 1, a getter including a Ti film having a thickness of 100 microns and a Zr—Al—Ti film formed thereon at a thickness of 50 microns was employed. The non-evaporable getter had a width of 0.35 mm and a length of 30 mm, and was provided with circular cut-out sections 302' on both ends, as shown in FIG. 33B. Frit glass added with an Au conductive filler was applied to the cut-out sections 302', and preliminary firing was performed at 380° C.

The non-evaporable getter 301 was aligned on scanning-signal wiring 304 formed in a similar manner to that in example 1 of the third embodiment, and the frit glass was melted by YAG laser irradiation to fix the non-evaporable getter 301 on the scanning-signal wiring 304.

The subsequent fabrication process, such as formation of the faceplate and the envelope and activation of the electron source, was performed in a similar manner to that in example 1, and an electron beam display was produced. In the display in this example, dispersion in brightness did not occur, and damage to the electron source due to discharge did not occur.

Although surface-conduction electron-emitting elements were used as the electron sources in the examples described above, in addition to this, the structure in accordance with the present invention is applicable to, for example, electron beam displays using a field emission-type electron-emitting element as a cold-cathode electron-emitting element.

In accordance with the examples described above, by mounting the non-evaporable getter in the envelope, gases generated in the envelope were promptly adsorbed by the getter material, and thus the degradation of the characteristics of electron-emitting elements can be suppressed.

Consequently, an image-forming apparatus can be provided in which even if operated for a long time, an image can be formed with high brightness and excellent operational stability. Since wiring or a container for evaporation is not required as in the conventional evaporative getter, the flat and thin envelope can be structured. By activating the non-evaporable getter, adsorption of gases in the sealed envelope can be securely done. Therefore, a method for fabricating an image-forming apparatus with excellent productivity can be obtained.

The getter may be disposed in the image display region, in the periphery of the image display region, or both in the image display region and in the periphery of the image display region, without using vacuum evaporation or photolithography. In particular, since the non-evaporable getter is mounted in the envelope using an inorganic adhesive, adsorbability is not greatly degraded and recursive adsorbing power can be demonstrated. Although the present invention is particularly effective in an image display device which does not have an electrode structure such as controlling electrodes between the electron source and the image-forming member, the same effect is expected when the present invention is applied to an image display device having controlling electrodes or the like.

In the third embodiment described above, in the electron beam display in which a plurality of electron-emitting elements are formed on a substrate, and an image is displayed by colliding electrons emitted from the electron-emitting elements into a vacuum to phosphors that is opposed to the substrate, ribbon non-evaporable getters provided with holes or cut-out sections are fixed on wiring on the substrate by the conductive adhesive.

Therefore, by fixing the ribbon non-evaporable getters provided with hole or cut-out sections on the wiring on the substrate by the conductive adhesive, an excellent electron beam display can be fabricated in which degradation of electron-emission characteristics due to generated gasses is avoided, the resultant dispersion in brightness is suppressed, and abnormal discharge does not occur.

The individual examples described above or their conditions may be combined for use.

In the above-mentioned apparatus disclosed in Japanese Patent Laid-Open No 4-12436, in which an electron source having a gate electrode composed of a getter material is employed, complex steps in a vacuum are required for the fabrication of conical negative electrode chips or for the joining of semiconductors, an increase in the size of the apparatus is restricted due to production equipment. In contrast, in accordance with the examples described above, the fabrication process is simplified and the size is easily increased.

In an apparatus having controlling electrodes, and so on between the electron source and the faceplate, as disclosed in Japanese Patent Laid-Open No. 63-181248, the structure becomes complex, and complex steps, such as alignment of those members, are required in the production process. In contrast, in accordance with the examples described above, the production process is simplified.

In a method for forming the getter material on the anode plate, as disclosed in U.S. Pat. No. 5,453,659, the getter material and phosphors must be electrically isolated, and since patterning by photolithography is repeatedly performed for the micro-fabrication process, the steps become complex. The size of the image display device that can be produced is restricted because of the size of the apparatus used therefor. In contrast, in accordance with the examples described above, the production process is simplified, and an increase in the size of the apparatus is easily made.

In particular, in surface-conduction electron-emitting elements, electrons are emitted by applying a given electric current to conductive thin films having a portion of high resistance (an example thereof is disclosed in Japanese Patent Laid-Open No. 7-235255).

The electron sources using such elements are not provided with either conical gate electrodes as disclosed in Japanese Patent Laid-Open No. 4-12435 or controlling electrodes as disclosed in Japanese Patent Laid-Open No. 63-181248, Therefore, it is not possible to disposed getters in the image display region in the same manner as that in those patents, and getters are placed in the exterior to the image display region. However, as described above, in the thin image-forming apparatus, gases generated in the image display region are not adsorbed efficiently.

In order to overcome such a problem, getters may be disposed in the image display region of an image-forming apparatus using surface-conduction electron-emitting elements (refer to Japanese Patent Laid-Open No. 9-82245). However, since new wiring is required for activating getters, the fabrication of the electron-source substrate may become complex, and since getters are provided in the vicinity of electron-emitting elements, electrical conduction with wiring or electrodes may be caused. Additionally, since a Ba getter as an evaporative getter used on wiring is heated for evaporation while being kept in a container, the container remains in the envelope after evaporation, and the Ba getter must be aligned. Such problems are also improved in accordance with the examples described above.

In the structures in the examples, containers are not required, and thus the alignment thereof is not required.

In particular, non-evaporable getters differ from evaporative getters, such as a Ba getter, in that after the envelope of the image-forming apparatus is sealed, evaporation in the inner vacuum is not required for use. When the non-evaporable getters are given energy (activated) by heating by passing a current or the like, metal oxides, carbonates, nitrides covering the surfaces thereof are diffused into the getters, and new metals are deposited on the surfaces. Reaction on residual gases in the vacuum is recurring, thus enabling to improve the degree of vacuum more suitably.

With respect to evaporative getters, in the envelope, an area for evaporating the getters must be secured at a position opposing the getters, and the spacing therebetween must be increased. Therefore, evaporative getters are unsuitable for thin image-forming apparatuses. In this respect, non-evaporable getters used in the examples described above does not have such a restriction, and even if residual gases are adsorbed on the surfaces and their adsorbing power is saturated, by reactivation, metal oxides, carbonates, nitrides on the surfaces diffuse into the getters to enable deposition of new metals on the surfaces. In this way, the range for maintaining recurring activation of non-evaporable getters depends on the environment where the getters are used, and a higher vacuum is advantageous. Therefore, by heating in an atmosphere having a given degree of vacuum at a given temperature, non-evaporable getters are activated, thus maintaining their adsorbing power, and can satisfactorily adsorb generated gases in the image display region even in the case of a flat envelope.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

a hermetically sealed container;

an electron-emitting element;

a wiring for applying a signal to said electron-emitting element so as to emit an electron; and a getter provided in said hermetically sealed container, said getter being fixed by an inorganic high polymer or a substance originating from the inorganic high polymer on said wiring.

2. An image-forming apparatus comprising:

a hermetically sealed container;

an electron-emitting element;

a wiring for applying a signal to said electron-emitting element so as to emit an electron; and a getter provided in said hermetically sealed container, said getter being fixed by a silicate adhesive or a substance originating from the silicate adhesive on said wiring.

3. An image-forming apparatus comprising:

a hermetically sealed container;

an electron-emitting element;

a wiring for applying a signal to said electron-emitting element so as to emit an electron; and a getter provided in said hermetically sealed container, said getter being fixed by a phosphate adhesive or a substance originating from the phosphate adhesive on said wiring.

4. An image-forming apparatus comprising:

a hermetically sealed container;

an electron-emitting element;

a wiring for applying a signal to said electron-emitting element so as to emit an electron; and a getter provided in said hermetically sealed container, said getter being fixed by a colloidal silica adhesive or a substance originating from the colloidal silica adhesive on said wiring.

5. An image-forming apparatus comprising:

a hermetically sealed container;

an electron-emitting element;

a wiring for applying a signal to said electron-emitting element so as to emit an electron; and a getter provided in said hermetically sealed container, said getter being fixed by a ladder silicone adhesive or a substance originating from the ladder silicone adhesive on said wiring.

6. An image-forming apparatus comprising:

a hermetically sealed container;

an electron-emitting element;

a wiring for applying a signal to said electron-emitting element so as to emit an electron; and a getter provided in said hermetically sealed container, said getter being fixed by a ladder silicone oligomer or a substance originating from the ladder silicone oligomer on said wiring.

7. An image-forming apparatus comprising:

a hermetically sealed container;

an electron-emitting element;

a wiring for applying a signal to said electron-emitting element so as to emit an electron; and a getter provided in said hermetically sealed container, said getter being fixed by an adhesive comprising silicon-oxygen bonds on said wiring.

8. An image-forming apparatus comprising:

a hermetically sealed container;

an electron-emitting element;

a wiring for applying a signal to said electron-emitting element so as to emit an electron; and a getter provided in said hermetically sealed container, said getter being fixed by a solder or a substance originating from the solder on said wiring.

9. An image-forming apparatus comprising:

a hermetically sealed container;

an electron-emitting element;

a wiring for applying a signal to said electron-emitting element so as to emit an electron; and a getter provided in said hermetically sealed container, said getter being fixed by glass frit or a substance originating from the glass frit on said wiring.

10. An image-forming apparatus according to claim 1, wherein said getter comprises a material getter member fixed by the inorganic high polymer or the substance originating from the inorganic high polymer.

11. An image-forming apparatus according to claim 1, wherein said getter comprises a cured and fixed mixture of a particulate getter material and the inorganic high polymer.

12. An image-forming apparatus according to claim 1, wherein said getter comprises a material getter member containing a non-evaporable getter, and said getter member is fixed at a cut-out section of said getter member by the inorganic high polymer or the substance originating from the inorganic high polymer.

13. An image-forming apparatus according to claim 1, wherein at least a portion of said getter is present in an image-forming region in said hermetically sealed container.

14. An image-forming apparatus according to claim 1, wherein said getter is provided both in an image-forming region and in a region excluding the image-forming region in said hermetically sealed container, and at least one fixed portion of said getter is provided in the region excluding the image-forming region.

15. An image-forming apparatus according to claim 1, wherein said getter is obtained by heating a mixture containing a particulate getter material and the inorganic high polymer at a weight ratio of 10:1 to 20:1.

16. An image-forming apparatus according to claim 2, wherein said getter comprises a material getter member fixed by the silicate adhesive or the substance originating from the silicate adhesive.

17. An image-forming apparatus according to claim 2, wherein at least a portion of said getter is present in an image-forming region in said hermetically sealed container.

18. An image-forming apparatus according to claim 2, wherein said getter is provided both in an image-forming region and in a region excluding the image-forming region in said hermetically sealed container, and at least one fixed portion of said getter is provided in the region excluding the image-forming region.

19. An image-forming apparatus according to claim 3, wherein said getter comprises a material getter member fixed by the phosphate adhesive or the substance originating from the phosphate adhesive.

20. An image-forming apparatus according to claim 3, wherein at least a portion of said getter is present in an image-forming region in said hermetically sealed container.

21. An image-forming apparatus according to claim 3, wherein said getter is provided both in an image-forming region and in a region excluding the image-forming region in said hermetically sealed container, and at least one fixed portion of said getter is provided in the region excluding the image-forming region.

22. An image-forming apparatus according to claim 4, wherein said getter comprises a material getter member fixed by the colloidal silica adhesive or the substance originating from the colloidal silica adhesive.

23. An image-forming apparatus according to claim 4, wherein at least a portion of said getter is present in an image-forming region in said hermetically sealed container.

24. An image-forming apparatus according to claim 4, wherein said getter is provided both in an image-forming region and in a region excluding the image-forming region in said hermetically sealed container, and at least one fixed portion of said getter is provided in the region excluding the image-forming region.

25. An image-forming apparatus according to claim 5, wherein said getter comprises a cured and fixed mixture of a particulate getter material and the ladder silicone adhesive.

26. An image-forming apparatus according to claim 5, wherein said getter comprises a cured and fixed mixture containing a particulate getter material and the ladder silicone adhesive at a weight ratio of 10:1 to 20:1.

27. An image-forming apparatus according to claim 6, wherein said getter comprises a cured and fixed mixture of a particulate getter material and the ladder silicone oligomer.

28. An image-forming apparatus according to claim 6, wherein said getter comprises a cured and fixed mixture containing a particulate getter material and the ladder silicone oligomer at a weight ratio of 10:1 to 20:1.

29. An image-forming apparatus according to claim 1, wherein the hermetically sealed container is provided with an electrode for applying an electric potential for accelerating electrons emitted from said electron-emitting element.

30. An image-forming apparatus according to claim 29, wherein a potential difference of 5 kV or more is applied between said electron-emitting element and said electrode during operation.

31. An image-forming apparatus according to claim 1, wherein an inner space of said hermetically sealed container is thin and flat.

32. An image-forming apparatus according to claim 1, wherein, in an inner space of said hermetically sealed container, a diagonal line parallel to a plane for forming an image is 4.5 or more times as long as a length perpendicular to the plane for forming the image.

33. An image-forming apparatus according to claim 1, wherein said getter is electrically connected to said wiring.

34. An image-forming apparatus according to claim 1, wherein said hermetically sealed container is provided with a phosphor irradiated with electrons emitted by said electron-emitting element.

35. An image-forming apparatus according to claim 1, wherein said getter contains a powdered getter material having a particulate diameter of 1 to 300 $\mu$m.

36. An image-forming apparatus comprising:

a hermetically sealed container; and a getter provided in said hermetically sealed container, said getter being fixed by a ladder silicone adhesive or a substance originating from the ladder silicone adhesive on said wiring, wherein said getter comprises a cured and fixed mixture containing a particular getter material and the ladder silicon adhesive at a weight ratio of 10:1 to 20:1.

37. An image-forming apparatus comprising:

a hermetically sealed container; and a getter provided in said hermetically sealed container, said getter being fixed by a ladder silicone oligomer or a substance originating from the ladder silicone oligomer on said wiring, wherein said getter comprises a cured and fixed mixture containing a particulate getter material and the ladder silicone oligomer at a weight ratio of 10:1 to 20:1.

* * * * *

UNITED STATES PATENT AND TRADEMARK OFFICE

CERTIFICATE OF CORRECTION

PATENT NO. : 6,489,720 B1 
DATED : December 3, 2002
INVENTOR(S) : Ihachiro Gofuku et al.

It is certified that error appears in the above-identified patent and that said Letters Patent is hereby corrected as shown below:

Column 10,
Line 18, "MFG.," should read -- MgO, --.

Column 20,
Line 10, "1)" should read -- 1) --, and "tothose" should read -- to those --.
Line 15, "shownin" should read -- shown in --.

Column 23,
Line 4, "beapplied" should read -- be applied --.

Column 29,
Line 7, "shiftedphase." should read -- shifted phase. --.

Column 32,
Line 36, "ispreferably" should read -- is preferably --.
Line 42, "temperaturebonding." should read -- temperature bonding. --.

Signed and Sealed this

Ninth Day of September, 2003

JAMES E. ROGAN
*Director of the United States Patent and Trademark Office*